US006425359B2

(12) United States Patent
Fujii et al.

(10) Patent No.: US 6,425,359 B2
(45) Date of Patent: Jul. 30, 2002

(54) VALVE MOVING APPARATUS OF AN INTERNAL COMBUSTION ENGINE

(75) Inventors: Noriaki Fujii; Hiromu Nakamura; Yuji Matsumochi, all of Wako; Junichi Iwamoto, Haga-machi, all of (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/887,812

(22) Filed: Jun. 22, 2001

(30) Foreign Application Priority Data

| | | |
|---|---|---|
| Jun. 23, 2000 | (JP) | 2000-189489 |
| Nov. 1, 2000 | (JP) | 2000-335160 |
| Mar. 1, 2001 | (JP) | 2001-057430 |

(51) Int. Cl.[7] ..... F01L 1/34

(52) U.S. Cl. ..... 123/90.18; 123/90.17; 123/90.47

(58) Field of Search ..... 123/90.39, 90.4, 123/90.47, 90.27, 90.18, 90.25, 90.31, 90.17

(56) References Cited

U.S. PATENT DOCUMENTS

| | | | | | |
|---|---|---|---|---|---|
| 4,693,214 A | * | 9/1987 | Titolo | ..... | 123/90.18 |
| 5,289,806 A | * | 3/1994 | Hurr | ..... | 123/90.17 |
| 5,887,557 A | * | 3/1999 | Battlogg | ..... | 123/90.17 |
| 5,988,128 A | * | 11/1999 | Moryia et al. | ..... | 123/90.18 |
| 6,067,947 A | * | 5/2000 | Moryia et al. | ..... | 123/90.18 |

FOREIGN PATENT DOCUMENTS

| | | | | | |
|---|---|---|---|---|---|
| GB | 2203489 A | * | 10/1988 | ..... | 123/90.18 |
| JP | 61-201804 A | | 9/1986 | | |
| JP | 05001575 A | * | 1/1993 | ..... | 123/90.47 |
| JP | 05340226 A | * | 12/1993 | ..... | 123/90.47 |
| JP | 06-117207 A | | 4/1994 | ..... | 123/90.15 |

* cited by examiner

*Primary Examiner*—Thomas Denion
*Assistant Examiner*—Ching Chang
(74) *Attorney, Agent, or Firm*—Lahive & Cockfield, LLP

(57) ABSTRACT

A valve moving apparatus of an internal combustion engine has an intake camshaft with an intake variable cam piece for opening and closing an intake valve, and an exhaust camshaft with an exhaust variable cam piece for opening and closing an exhaust valve. Each variable cam piece has a low speed cam section and a high speed cam section and is movable axially relatively to the camshaft. A hydraulic driving mechanism is provided for moving the variable cam piece axially in accordance with engine operation condition. The driving mechanism has a driving piston and arms touching both sides of the variable cam piece. When valve operating characteristic of the intake valve or the exhaust valve is changed corresponding to engine operation condition, response is improved. The engine can be miniaturized.

17 Claims, 36 Drawing Sheets

A1

207
230a
230b
231a1
242a
242a2
247a
247c
235
236
234
G1
G2
G3
232b
232a2
261b
261c
261d
262b
262b1
262b2
224a
224a2
224b
224b1
224b2

VALVE MOVING APPARATUS OF AN INTERNAL COMBUSTION ENGINE

BACKGROUND OF THE INVENTION

1. Field of the Invention

The present invention relates to a valve moving apparatus of an internal combustion engine having a mechanism for changing valve operating characteristic such as lift amount of at least one of an intake valve and an exhaust valve of the internal combustion engine in accordance with operating condition of the engine.

2. Description of the Related Art

Hitherto, as an apparatus for changing valve operating characteristic such as lift amount of an intake valve or an exhaust valve of an internal combustion engine in accordance with operating condition of the engine, a valve timing control apparatus of an engine disclosed in Japanese Laid-Open Patent Publication Hei 6-117207 has been known, for example. This apparatus comprises a rocking cam for opening and closing an intake valve or an exhaust valve, a driving cam for rocking the rocking cam supported on a camshaft rotated by power from a crankshaft, and a valve timing variable mechanism provided at one end of the camshaft for moving the camshaft axially and changing rotational phase of the camshaft with respect to the crankshaft. The driving cam is formed in a shape tapered in direction of axis of the camshaft.

When the camshaft is moved in one axial direction by the valve timing variable mechanism in accordance with engine operating condition, the valve is opened with a smaller lift amount and a smaller operation angle by the rocking cam rocked by the tapered driving cam which moves axially together with the camshaft. On the other hand, when the camshaft is moved in another direction, the valve is opened with a larger lift amount and a larger operation angle. Further, when the camshaft and the driving cam move axially, rotational phase of the camshaft with respect to the crankshaft is changed, and therefore a crank angle at which lift amount of the valve becomes maximum is also adjusted.

In the above prior art, since the driving cam for changing lift amount and operation angle of the valve is moved in a body with the camshaft by the valve timing variable mechanism, weight of an object to be moved by the valve timing variable mechanism (driving cam) is large, and further, sliding resistance of the camshaft supported by an engine main body is added. Therefore, response to change of the valve lift characteristic is not good. If a large driving force is desired in order to improve the response, the valve timing variable mechanism and the engine become large.

The present invention is achieved in view of the foregoing, and an object of the present invention is to provide a valve moving apparatus of an internal combustion engine that response to change of valve operating characteristic of an intake valve or an exhaust valve can be improved and the internal combustion engine can be miniaturized.

SUMMARY OF THE INVENTION

The present invention provides a valve moving apparatus of an internal combustion engine having an intake camshaft provided with at least one intake cam piece for opening and closing an intake valve, and an exhaust camshaft provided with at least one exhaust cam piece for opening and closing an exhaust valve, at least one of the intake cam piece and the exhaust cam piece being a variable cam piece provided with a variable cam section having different valve operating characteristics changing in direction of a rotary axis of the intake camshaft or the exhaust camshaft for opening and closing:the intake valve or the exhaust valve in accordance with the valve operating characteristic including lift amount and operation angle, wherein: the variable cam piece is provided on the intake camshaft or the exhaust camshaft so as to slide in direction of the rotary axis; a driving mechanism for moving the variable cam piece in direction of the rotary axis in accordance with engine operating condition to change the valve operating characteristic of the intake valve or the exhaust valve is provided; the driving mechanism comprises a movable member driven so as to reciprocate along a center axis, and arms extending from the movable member toward the intake camshaft or the exhaust camshaft having contact sections contacted with both side surfaces of the variable cam piece in direction of the rotary axis, respectively; and the center axis of the movable member is positioned near a center line of a cylinder of the internal combustion engine more than the rotary axis of the intake camshaft or the exhaust camshaft.

According to the invention, when the variable cam piece is moved in direction of the rotary axis of the camshaft to change valve operating characteristic of the intake valve or the exhaust valve, the driving mechanism moves the variable cam piece, which is provided on the camshaft so as to slide, in direction of the rotary axis of the camshaft, so that the movable cam section having different valve operating characteristics changing in direction of the rotary axis opens and closes the intake valve or the exhaust valve. Weight of the variable cam piece moved by the driving mechanism is very small compared with total weight of the driving cam and the camshaft of the above-mentioned prior art, therefore, a large driving force is unnecessary and the driving mechanism can be miniaturized.

Since the driving mechanism moves the variable cam piece of light weight when the valve operating characteristic of the intake valve or the exhaust valve is changed, the movement in direction of the rotary axis is carried out rapidly and response to change of the valve operating characteristic is improved, so that operation region that the engine is operated with a most suitable valve operating characteristic is widened and engine performance such as engine output can be improved. Further, since the driving mechanism can be miniaturized, the valve moving apparatus can be miniaturized and therefore the internal combustion engine can be miniaturized.

Since the movable member is positioned near a center of the cylinder more than the intake camshaft and the exhaust camshaft, and the contact section touching the variable cam piece to give driving force of the movable member to the variable cam piece is provided on the arm extending from the movable member toward the intake camshaft or the exhaust camshaft, the driving mechanism can be put within a width of the camshaft in direction of straight line perpendicular to the rotary axis of the camshaft. Therefore, a width of the valve moving apparatus in direction of the straight line does not become large. Further, since the contact sections touché the respective side surfaces of the variable cam piece, the contact sections does not influence rotation of the variable cam piece which rotates together with the intake camshaft and the exhaust camshaft.

As the result, the drive mechanism is disposed between the intake camshaft and the exhaust camshaft, width of the valve moving apparatus in direction of the straight line perpendicular to the rotary axis of the both camshafts does not become large, the valve moving apparatus can be miniaturized and the internal combustion engine can be miniaturized. Further, since the contact sections touch side surfaces of the variable cam piece so as not to influence rotation of the variable cam piece, the intake valve and the exhaust valve can be surely opened and closed by the variable cam piece.

Preferably, the driving mechanism comprises the movable member having a center axis parallel with the rotary axis and a pair of arms extending from the movable member toward the camshaft and having the contact sections, and the movable member has a recess for allowing passing of the rotating variable cam section.

According to this constitution, the movable member can be disposed further close by the camshaft, because of the recess provided on the movable member.

The movable member may have both ends supported by neighboring cam holders respectively. Since the movable member can be supported utilizing the neighboring cam holders, any other member for supporting the movable member is unnecessary. Therefore, number of parts can be reduced, the valve moving apparatus and the internal combustion engine can be miniaturized.

An intake or exhaust rocker arm may be provided between at least one of the intake cam piece and the exhaust cam piece and the intake valve or the exhaust valve to open and close the intake valve or the exhaust valve. The intake or exhaust rocker arm is pivoted on an intake or exhaust rocker shaft and the driving apparatus have an oil passage for applying oil pressure to both end portions of the movable member. The oil passage may be constituted so as to pass through an inner portion of the rocker shaft.

According to such a constitution, an oil passage structure in the valve moving apparatus is not complicated, and arrangement of elements of the valve moving apparatus is not restrained by provision of oil passages for the driving mechanism.

A valve lifter may be disposed between at least one of the intake cam piece and the exhaust cam piece and one of the intake valve and the exhaust valve to come into contact with the intake valve or the exhaust valve. The valve lifter may be provided with a cut portion for escape of the intake cam piece or the exhaust cam piece not coming into contact with the valve lifter.

A cam of the cam piece not coming into contact with the valve lifter, which is adjacent to another cam coming into sliding contact with the valve lifter, rotates passing through the cut portion of the valve lifter without interfering with the valve lifter. Therefore, in a cam piece having a plurality of cams with respective different cam profiles, at least a part of a cam adjacent to a cam coming into sliding contact with the valve lifter can be positioned within a width of the valve lifter in direction of the rotary axis of the camshaft, so that the width of the cam piece in direction of the rotary axis can be made small, and the valve moving apparatus and the internal combustion engine is made compact and light. Further, since size of the cam piece in direction of the rotary axis is small, even in case that a plurality of engine valves for intake and exhaust are provided, cams for these engine valves can be disposed within a limited range of bore diameter of the cylinder. In addition, it is easy to provide cams more than three on one cam piece.

The cut portion may be formed by an opening penetrating the valve lifter so as to connect the inner side with the outer side. Lubricating oil on the outside of the valve lifter flows into the inner side of the valve lifter through the opening forming the cut portion, so that a valve spring disposed in the valve lifter, a retainer and a sliding portion of the engine valve is lubricated easily. Since a part of the valve lifter is cut off for forming the opening, weight of the valve lifter is reduced.

Preferably, each of the intake cam piece and the exhaust cam piece has a first cam section and a second cam section arranged in series in direction of the rotary axis, each of the intake valve and the exhaust valve includes a first engine valve and a second engine valve provided for the same cylinder, the valve lifter includes a first valve lifter disposed between the first engine valve and the first cam section and a second valve lifter disposed between the second engine valve and the second cam section, and the driving mechanism selectively switches over the first cam section and the second cam section coming into sliding contact with the first valve lifter and the second valve lifter respectively.

According to this constitution, the first engine valve and the second engine valve for each cylinder are switched by the same switch means. Namely a common switch means can be used for two engine valves. Therefore, the valve moving apparatus can be made compact.

A valve lifter may be provided between one of the intake cam piece and the exhaust cam piece and the intake valve or the exhaust valve, and the valve lifter may have a cut portion for escape of the arm.

Even if the arm touches a side surface of the cam section at a position radially projected from the base circle portion of the cam, the arm does not come into contact with the valve lifter because the arm is positioned in the cut portion. Therefore, the arm can be positioned within a width of the valve lifter in direction of the rotary axis of the camshaft, so that width of the driving mechanism in direction of the rotary axis can be made small to make the valve moving apparatus and the engine compact and light. Further, since positional relation between the arm and the valve lifter is restrained little, degree of freedom of arrangement of the arm and accordingly degree of freedom of arrangement of the driving mechanism become large.

A valve lifter coming into sliding contact with one of the intake valve and the exhaust valve may be provided between one of the intake cam piece and the exhaust cam piece and the intake valve or the exhaust valve, and a trigger mechanism for setting a switching action beginning time of the driving mechanism when the intake valve or the exhaust valve is closed may be disposed under the intake camshaft or the exhaust camshaft.

Since the trigger mechanism is disposed utilizing a space formed under the camshaft, the valve moving apparatus with the trigger mechanism miniaturized and accordingly the valve moving chamber and the internal combustion engine are miniaturized.

Preferably, the trigger mechanism is disposed between the intake camshaft or the exhaust camshaft and the lifter. The valve moving apparatus can be further miniaturized.

Preferably, the trigger mechanism is disposed overlapping with the lifter in moving direction of the lifter and acts in accordance with movement of the lifter. The valve moving apparatus having the trigger mechanism can be miniaturized in direction of the rotary axis of the camshaft too.

The variable cam piece has cams adjacent to each other having respective base circle portions smoothly connected with each other.

Preferably, the cam section of the cam piece includes a first cam section and a second cam section arranged in series in direction of the rotary axis, the engine valve includes a first engine valve and a second engine valve provided for each cylinder, the lifter includes a first lifter disposed between the first engine valve and the first cam section and a second lifter disposed between the second engine valve and the second cam section, and the trigger mechanism is disposed between the first lifter and the second lifter in direction of the rotary axis. The valve moving apparatus having the trigger mechanism can be miniaturized in direction of the rotary axis.

A lifter holding member may be constituted by a member separated from a cylinder head of the internal combustion engine, and the trigger mechanism may be fixed to the lifter holding member by means of a fixing member for fixing the lifter holding member to the cylinder head. Number of parts and assembling man-hour can be reduced.

DESCRIPTION OF THE PREFERRED EMBODIMENT

Hereinafter, embodiments of the present invention will be described.

Figure 1:
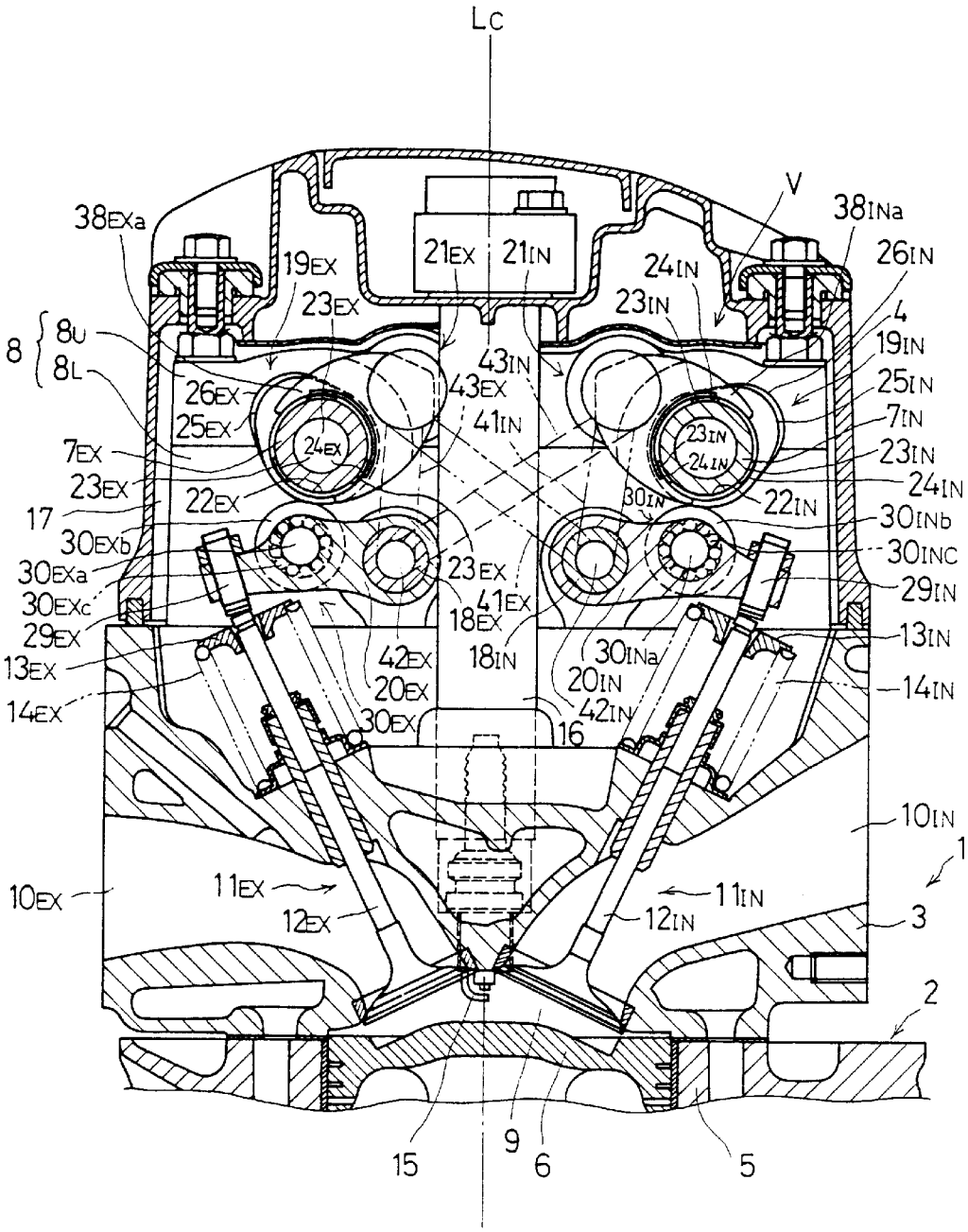
FIG. 1 is a sectional view of an internal combustion engine having a valve moving apparatus according to an embodiment of the present invention corresponding to a partial section taken along the line I—I of FIG. 2.
Figure 2:
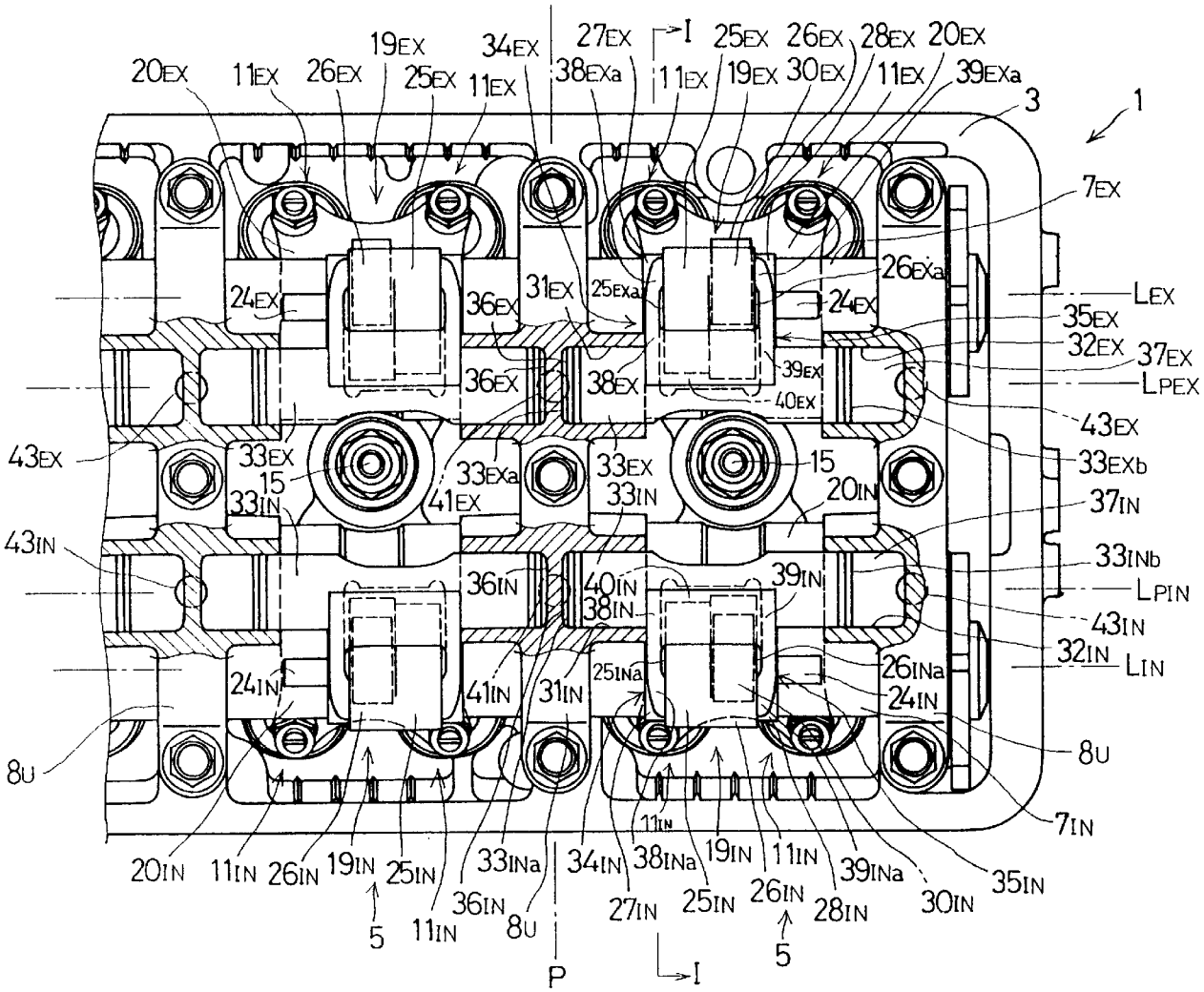
FIG. 2 is a partial plan view of the internal combustion engine of FIG. 1 from which a cylinder head cover is removed.

FIGS. 1 to 5 show the first embodiment of the present invention. The internal combustion engine 1 having a valve moving apparatus according to the present invention is a DOHC type 4-cylinder 4-stroke-cycle internal combustion engine for a vehicle. Referring to FIG. 1 and FIG. 2, on an upper surface of a cylinder block 2 is attached a cylinder head 3, and on an upper surface of the cylinder head 3 is attached a cylinder head cover 4. A piston 6 fitted in each cylinder 5 so as to reciprocate is connected to a crankshaft (not shown) through a connecting rod (not shown). An intake camshaft $\mathbf{7}_{IN}$ and an exhaust camshaft $\mathbf{7}_{EX}$ are arranged in direction of row of cylinders in parallel with each other and rotatably supported by a plurality of cam holder 8 fixed to the cylinder head 3 by bolts. The camshafts $7_{IN}$, $7_{EX}$ are rotated synchronizing with the crankshaft at a speed reduction ratio of 1/2. The cam holders 8 are disposed at both ends of the row of cylinders and between neighboring cylinders. The cam holder 8 consists of an upper cam holder $8_U$ and a lower cam holder $8_L$ which are divided from each other by a plain including a rotary axis $L_{IN}$ of the intake camshaft $7_{IN}$ and a rotary axis $L_{EX}$ of the exhaust cam shaft 7EX. The camshafts $7_{IN}$, $7_{EX}$ are each supported in a circular hole formed by a semi-cylindrical hollow on an upper surface of the lower cam holder $8_L$ and a semi-cylindrical hollow on a lower surface of the upper cam holder $8_U$.

Each cylinder 5 has a combustion chamber 9 formed between the piston 6 and the cylinder head 3 and a pair of intake ports $10_{IN}$ and a pair of exhaust ports $10_{EX}$ are opened to the combustion chamber 9. The intake ports are opened and closed by respective intake valves $11_{IN}$ and the exhaust the exhaust ports are opened and closed by respective exhaust valves $11_{EX}$. The intake valves $11_{IN}$ and the exhaust valves $11_{EX}$ are forced in closing direction by valve springs $14_{IN}$, $14_{EX}$ compressed between the cylinder head 3 and retainers $13_{IN}$, $13_{EX}$ provided at upper ends of valve stems $12_{IN}$, $12_{EX}$, respectively. An ignition plug 15 facing the combustion chamber 9 is screwed to the cylinder head 3 and a cylinder 16 for housing the ignition plug 16 and an ignition coil is fixed to the cylinder head 3.

In a valve moving chamber 17 formed between the cylinder head 3 and the cylinder head cover 4 are accommodated a valve moving apparatus V for opening and closing the intake valve $11_{IN}$ and the exhaust valve $11_{EX}$. The valve moving apparatus comprises the intake (exhaust) camshaft $7_{IN}$ ($7_{EX}$) an intake (exhaust) rocker shaft $18_{IN}$ ($18_{EX}$), an intake (exhaust) variable cam piece $19_{IN}$, $19_{EX}$, an intake (exhaust) rocker arm $20_{NI}$ ($20_{EX}$) and an intake (exhaust) side driving mechanism $21_{IN}$ ($21_{EX}$) for moving the intake (exhaust) variable cam piece $19_{IN}$ ($19_{EX}$). The intake (exhaust) side driving mechanism constitutes an intake (exhaust) side valve characteristic variable mechanism.

Figure 3:
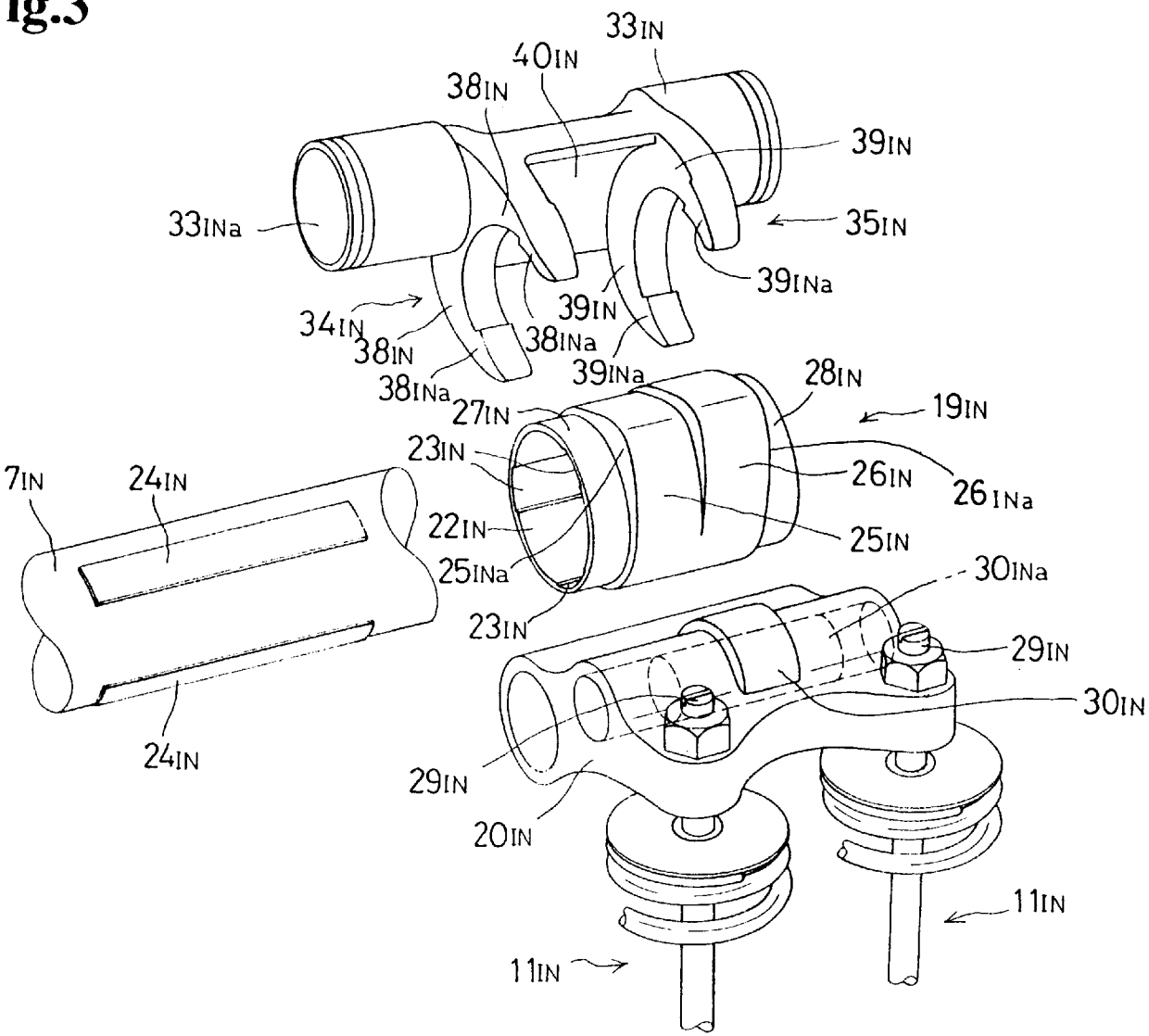
FIG. 3 is a partial exploded view of the valve moving apparatus on intake side.

Referring to FIG. 3 too, the intake variable cam piece $19_{IN}$ having an axial hole $22_{IN}$ which the intake camshaft $7_{IN}$ passes through is engaged with the intake camshaft $7_{IN}$ by splines so as to slide in direction of the rotary axis $L_{IN}$ and rotate together with the intake camshaft $7_{IN}$. In this first embodiment, on a peripheral surface of the axial hole $22_{IN}$, three grooves $23_{IN}$ extending in parallel with each other over the total length of the intake variable cam piece $19_{IN}$ are provided at regular intervals, and on an outer peripheral surface of the intake camshaft 7IN are provided three parallel projecting lines $24_{IN}$ corresponding to the grooves $23_{IN}$.

On the intake variable cam piece $19_{IN}$ are provided integrally a low speed cam section $25_{IN}$ and a high speed cam section $26_{IN}$ neighboring each other in direction of the rotary axis $L_{IN}$. The cam sections $25_{IN}$, $26_{IN}$ constitute an intake variable cam section. The low speed cam section $25_{IN}$ has a cam profile comprising a high portion projecting radially with a relatively small projecting amount and circumferentially over a predetermined operation angle and a base circle portion. The high cam section $26_{IN}$ has a cam profile comprising a high portion projecting radially with a projecting amount larger than that of the low speed cam section $25_{IN}$ and circumferentially over an operation angle larger than that of the low speed cam section $25_{IN}$ and a base circle portion.

The variable cam section of the intake variable cam piece $19_{IN}$ comprising the low speed cam section $25_{IN}$ and the high speed cam section $26_{IN}$ has a first side surface $25_{In}a$ on side of the low speed cam section and a second side surface $26_{IN}a$ on side of the high speed cam section, and the intake variable cam piece 19IN has a first cylindrical section $27_{IN}$ extending from the first side surface $25_{In}a$ in direction of the rotary axis Lin and a second cylindrical section $28_{IN}$ extending from the second side surface $26_{In}a$ in direction of the rotary axis $L_{IN}$.

Under the intake camshaft $7_{IN}$, a hollow intake rocker shaft $18_{IN}$ is fixed to the lower cam holder $8_L$ in parallel with the intake camshaft $7_{IN}$, and intake rocker arms $20_{IN}$ corresponding to respective cylinders 5 are pivoted on the intake rocker shaft $18_{IN}$ so as to rock. A pair of adjustable tappet screws $29_{IN}$ are screwed to a tip end of the intake rocker arm $20_{IN}$. The tappet screws $29_{IN}$ touch upper surfaces of valve stems $12_{IN}$ of a pair of intake valves $11_{IN}$ respectively.

The intake rocker arm $20_{IN}$ has a roller $30_{IN}$ at a middle position between the intake rocker shaft $18_{IN}$ and the pair of intake valves $11_{IN}$. The roller $30_{IN}$ comes into sliding contact with the low speed cam section $25_{IN}$ or the high speed cam section $26_{IN}$ selectively and the intake rocker arm $20_{IN}$ follows the cam sections $25_{IN}$, $26_{IN}$ through the roller $30_{IN}$. The roller $30_{IN}$ has an axis parallel with the intake rocker shaft and comprises a center shaft $30_{IN}a$ fixedly fitted to the intake rocker arm $20_{IN}$, an outer ring $30_{IN}b$ coming into contact with the low speed cam section $25_{IN}$ or the high speed cam section $26_{IN}$, and a plurality of runners $30_{IN}c$ disposed between the center shaft $30_{IN}a$ and the outer ring $30_{IN}b$.

Therefore, in each cylinder, a pair of intake valves $11_{IN}$ are opened and closed by the low speed cam section $25_{IN}$ or the high speed cam section $26_{IN}$ through the intake rocker arm $20_{IN}$ in accordance with a valve operating characteristic including a lift amount and a operation angle determined by the high portion of the cam section.

On the one hand, the exhaust variable cam piece $19_{EX}$ having an axial hole $22_{EX}$ which the exhaust camshaft $7_{EX}$ passes through is engaged with the exhaust camshaft $7_{EX}$ by splines so as to slide in direction of the rotary axis $L_{EX}$ and rotate together with the exhaust camshaft $7_{EX}$. In this first embodiment, on a peripheral surface of the axial hole $22_{EX}$, three grooves $23_{EX}$ extending in parallel with each other over the total length of the exhaust variable cam piece $19_{EX}$ are provided at regular intervals, and on an outer peripheral surface of the exhaust camshaft $7_{EX}$ are provided three parallel projecting lines $24_{EX}$ corresponding to the grooves $23_{EX}$.

On the exhaust variable cam piece $19_{EX}$ are provided integrally a low speed cam section $25_{EX}$ and a high speed cam section $26_{EX}$ neighboring each other in direction of the rotary axis $L_{EX}$. The cam sections $25_{EX}$, $26_{EX}$ constitute an exhaust variable cam section. The low speed cam section $25_{EX}$ has a cam profile comprising a high portion projecting radially with a relatively small projecting amount and circumferentially over a predetermined operation angle and a base circle portion. The high cam section $26_{EX}$ has a cam profile comprising a high portion projecting radially with a projecting amount larger than that of the low speed cam section $25_{EX}$ and circumferentially over an operation angle larger than that of the low speed cam section $25_{EX}$ and a base circle portion.

The variable cam section of the exhaust variable cam piece $19_{EX}$ comprising the low speed cam section $25_{EX}$ and the high speed cam section $26_{EX}$ has a first side surface $25_{EX}a$ on side of the low speed cam section and a second side surface $26_{EX}a$ on side of the high speed cam section, and the exhaust variable cam piece $19_{EX}$ has a first cylindrical section $27_{EX}$ extending from the first side surface $25_{IN}a$ in direction of the rotary axis $L_{EX}$ and a second cylindrical section $28_{EX}$ extending from the second side surface $26_{EX}a$ in direction of the rotary axis $L_{EX}$.

Under the exhaust camshaft $7_{EX}$, a hollow intake rocker shaft $18_{EX}$ is fixed to the lower cam holder $8_L$ in parallel with the exhaust camshaft $7_{EX}$, and intake rocker arms $20_{EX}$ corresponding to respective cylinders 5 are pivoted on the exhaust rocker shaft $18_{EX}$ so as to rock. A pair of adjustable tappet screws $29_{EX}$ are screwed to a tip end of the exhaust rocker arm $20_{EX}$. The tappet screws $29_{EX}$ touch upper surfaces of valve stems $12_{EX}$ of a pair of exhaust valves $11_{EX}$ respectively.

The exhaust rocker arm $20_{EX}$ has a roller $30_{EX}$ at a middle position between the exhaust rocker shaft $18_{EX}$ and the pair of exhaust valves $11_{EX}$. The roller $30_{EX}$ comes into sliding contact with the low speed cam section $25_{EX}$ or the high speed cam section $26_{EX}$ selectively and the exhaust rocker arm $20_{EX}$ follows the cam sections $25_{EX}$, $26_{EX}$ through the roller $30_{EX}$. The roller $30_{EX}$ has an axis parallel with the exhaust rocker shaft and comprises a center shaft $30_{EX}a$ fixedly fitted to the exhaust rocker arm $20_{EX}$, an outer ring $30_{EX}b$ coming into contact with the low speed cam section $25_{EX}$ or the high speed cam section $26_{EX}$, and a plurality of runners $30_{EX}c$ disposed between the center shaft $30_{Ex}a$ and the outer ring $30_{EX}b$.

Therefore, in each cylinder, a pair of exhaust valves $11_{EX}$ are opened and closed by the low speed cam section $25_{EX}$ or the high speed cam section $26_{EX}$ through the exhaust rocker arm $20_{EX}$ in accordance with a valve operating characteristic including a lift amount and a operation angle determined by the high portion of the cam section.

Referring to FIGS. 1 to 5, the intake side driving mechanism 21IN in each cylinder 5 includes a first cylindrical hollow 31IN and a second cylindrical hollow 32IN formed in respective boss sections each projecting from adjacent upper cam holders 8U so as to face each other. The intake side driving mechanism 21IN further includes a cylindrical driving piston (movable member) 33IN having both ends fitted in the cylindrical hollows 31IN, 32IN so as to slide, and a pair of arms formed in one body with the driving piston 33IN and extending from an axially middle portion of the driving piston 33IN toward the intake camshaft 7IN. The center axis $L_{PIN}$ of the driving piston 33IN is positioned near the center axis $L_C$ of the cylinder 5 more than the rotary axis $L_{IN}$ of the intake camshaft 7IN and parallel with the rotary axis $L_{IN}$.

Between a first side surface 33IN*a* of the driving piston 33IN and the first hollow 31IN is formed a first oil pressure chamber 36IN, and between a second side surface 33Inb of the driving piston 33IN and the second hollow 32IN is formed a second oil pressure chamber 37IN. The driving piston reciprocates along the central axis $L_{PIN}$ in accordance with oil pressure supplied to the oil pressure chambers 36IN, 37IN.

A pair of arms is projected from the driving piston 33IN laterally. The distance between the both arms is slightly larger than the length of the intake variable cam piece 19IN. One of the arms is first arm 34IN positioned on side of the first side surface 25IN*a* of the intake variable cam piece 19IN, and another arm is a second arm 35IN positioned on side of the second side surface 26IN*a* of the intake variable cam piece 19IN. The first and second arms 34IN, 35IN have forked manipulating sections 38IN, 39IN surrounding the first and second cylindrical sections 27IN, 28IN, respectively.

The manipulating section 38IN of the first arm 34IN has a first contact sections 38IN*a* touching the first side surface 25IN of the intake variable cam piece 19IN and the outer peripheral surface of the first cylindrical section 27IN. The first contact sections 38IN*a* touch the first side surface 25IN*a* and the outer peripheral surface of the first cylindrical section 27IN at positions equally distant from the rotary axis $L_{IN}$ and opposite to each other in direction of diameter of the intake camshaft 7IN. Similarly, the manipulating section 39IN of the second arm 35IN has a second contact sections 39IN*a* touching the second side surface 26IN*a* of the intake variable cam piece 19IN and the outer peripheral surface of the second cylindrical section 28IN. The second contact sections 39IN*a* touch the second side surface 26IN*a* and the outer peripheral surface of the second cylindrical section 28IN at positions equally distant from the rotary axis $L_{IN}$ and opposite to each other in direction of diameter of the intake camshaft 7IN.

The driving piston 33IN has a recess 40IN formed between the first arm 34IN and the second arm 35IN for allowing passing of the rotating low speed and high speed cam sections 25IN, 26IN.

On the one hand, referring to FIGS. 1 and 2, the exhaust side driving mechanism 21EX in each cylinder 5 includes a first cylindrical hollow 31EX and a second cylindrical hollow 32EX formed in respective boss sections each projecting from adjacent upper cam holders 8U so as to face each other. The exhaust side driving mechanism 21EX further includes a cylindrical driving piston (movable member) 33EX having both ends fitted in the cylindrical hollows 31EX, 32EX so as to slide, and a pair of arms formed in one body with the driving piston 33EX and extending from an axially middle portion of the driving piston 33EX toward the intake camshaft 7EX. The center axis $L_{PEX}$ of the driving piston 33EX is positioned near the center axis $L_C$ of the cylinder 5 more than the rotary axis $L_{EX}$ of the exhaust camshaft 7EX and parallel with the rotary axis $L_{EX}$.

Between a first side surface 33EX*a* of the driving piston 33EX and the first hollow 31EX is formed a first oil pressure chamber 36EX, and between a second side surface 33EX*b* of the driving piston 33EX and the second hollow 32EX is formed a second oil pressure chamber 37EX. The driving piston reciprocates along the central axis $L_{PEX}$ in accordance with oil pressure supplied to the oil pressure chambers 36EX, 37EX.

A pair of arms is projected from the driving piston 33EX laterally. The distance between the both arms is slightly larger than the length of the intake variable cam piece 19EX. One of the arms is first arm 34EX positioned on side of the first side surface 25EX*a* of the exhaust variable cam piece 19EX, and another arm is a second arm 35EX positioned on side of the second side surface 26EX*a* of the exhaust variable cam piece 19EX. The first and second arms 34EX, 35EX have forked manipulating sections 38EX, 39EX surrounding the first and second cylindrical sections 27EX, 28EX, respectively.

The manipulating section 38EX of the first arm 34EX has a first contact sections 38EX*a* touching the first side surface 25EX of the exhaust variable cam piece 19EX and the outer peripheral surface of the first cylindrical section 27EX. The first contact sections 38EX*a* touch the first side surface 25EX*a* and the outer peripheral surface of the first cylindrical section 27EX at positions equally distant from the rotary axis $L_{EX}$ and opposite to each other in direction of diameter of the exhaust camshaft 7EX. Similarly, the manipulating section 39EX of the second arm 35EX has a second contact sections 39EX*a* touching the second side surface 26EX*a* of the exhaust variable cam piece 19EX and the outer peripheral surface of the second cylindrical section 28EX. The second contact sections 39EX*a* touch the second side surface 26EX*a* and the outer peripheral surface of the second cylindrical section 28EX at positions equally distant from the rotary axis $L_{EX}$ and opposite to each other in direction of diameter of the exhaust camshaft 7EX.

The driving piston 33EX has a recess 40EX formed between the first arm 34EX and the second arm 35EX for allowing passing of the rotating low speed and high speed cam sections 25EX, 26EX.

Next, oil passages for working oil will be described. The working oil is a part of oil discharged from an oil pump driven by the crankshaft. The intake side first oil pressure chamber 36IN is connected with a first oil supply passage 42IN formed by a hollow portion of the intake rocker shaft 18IN through an intake side first connecting oil passage 41IN provided in the upper cam holder 8U and the lower cam holder 8L. The exhaust side first oil pressure chamber 36EX is connected with the first oil supply passage 42IN through an exhaust side first connecting oil passage 41EX provided in the upper cam holder 8U and the lower cam holder 8L. To the first oil supply passage is fed working oil controlled by a first control valve (not shown) into high oil pressure or low oil pressure. Similarly, intake side second oil pressure chamber 37IN is connected with a second oil supply passage 42EX formed by a hollow portion of the exhaust rocker shaft 18EX through an intake side connecting oil passage 43IN provided in the upper cam holder 8U and the lower cam holder 8L, and the exhaust side second oil pressure chamber 37EX is connected with the second oil supply passage through an exhaust side second connecting oil passage 43EX provided in the upper cam holder 8U and the lower cam holder 8L. To the second oil supply passage 42EX is fed working oil controlled by a second control valve (not shown) into high oil pressure or low oil pressure.

Figure 4:
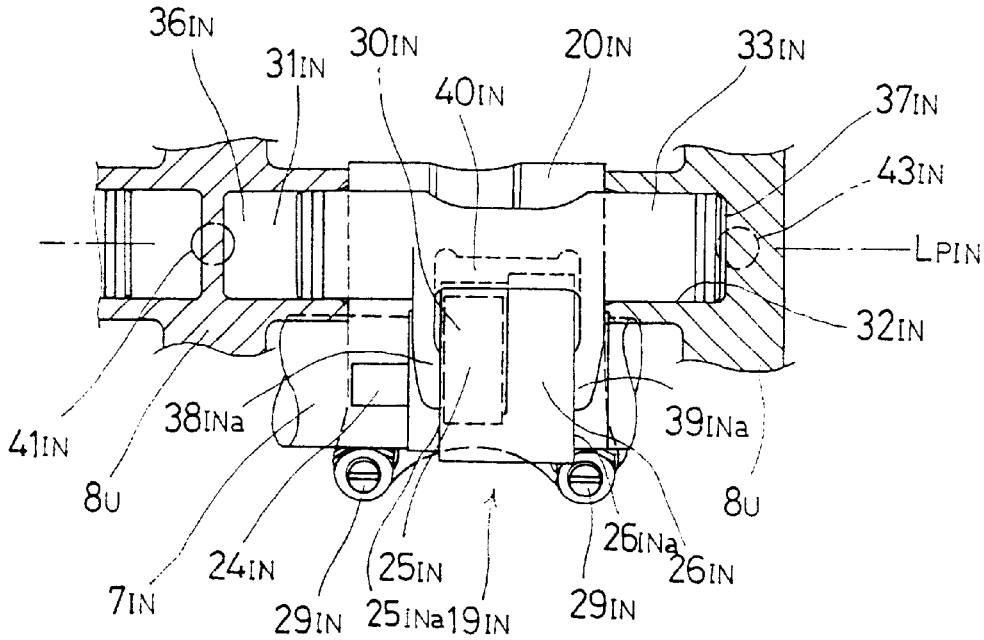
FIG. 4 is a view showing a state of a intake side driving mechanism in a low rotational speed region.

Actions of the first and second control valves are controlled by a control apparatus (not shown) in which a signal detected by a rotational speed sensor (engine operating condition sensor) is inputted. Namely, in a low rotational speed region that rotational speed of the engine 1 is less than a predetermined value, the first control valve supplies working oil of high pressure to the first oil supply passage 42IN and the intake side and exhaust side first connecting oil passage 41IN, 41EX so that both of the intake side and exhaust side first oil pressure chambers 36IN, 36Ex become high pressure, and the second control valve supplies working oil of low pressure to the second oil supply passage 42EX and the intake side and exhaust side second connecting oil passage 43IN, 43EX so that both of the intake side and exhaust side second oil pressure chambers become low pressure. As the result, the intake (exhaust) side driving piston 33IN (33EX) is driven by pressure difference between the first oil pressure chamber 36IN (36EX) and the second oil pressure chamber 37IN (37EX) so that the low speed cam section 25IN (25EX) is moved in direction of the rotary axis LIN (LEX) to come into sliding contact with the roller 30IN (30EX) of the intake (exhaust) rocker arm 20IN (20EX), as shown in FIG. 4.

Figure 5:
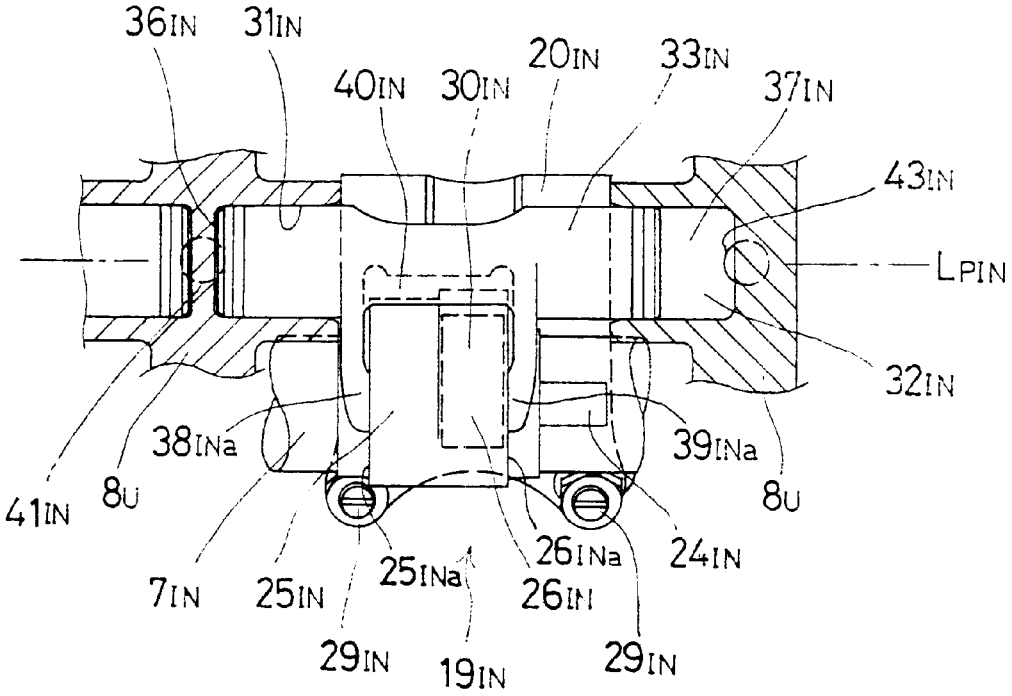
FIG. 5 is a view showing a state of the intake side driving mechanism in a high rotational speed region.

In a high rotational speed region that rotational speed of the engine 1 is more than the predetermined value, the first control valve supplies working oil of low pressure to the first oil supply passage 42IN and the intake side and exhaust side first connecting oil passage 41IN, 41EX so that both of the intake side and exhaust side first oil pressure chambers 36IN, 36Ex become low pressure, and the second control valve supplies working oil of high pressure to the second oil supply passage 42EX and the intake side and exhaust side second connecting oil passage 43IN, 43EX so that both of the intake side and exhaust side second oil pressure chambers become high pressure. As the result, the intake (exhaust) side driving piston 33IN (33EX) is driven by pressure difference between the first oil pressure chamber 36IN (36EX) and the second oil pressure chamber 37IN (37EX) so that the high speed cam section 26IN (26EX) is moved in direction of the rotary axis LIN (LEX) to come into sliding contact with the roller 30IN (30EX) of the intake (exhaust) rocker arm 20IN (20EX), as shown in FIG. 5.

The valve spring 14IN (14EX) and driving force given to the driving piston 33IN (33EX) are set so that shift of the intake (exhaust) rocker arm 20IN (20EX) from rocking by the low speed cam section 25IN (25EX) to rocking by the high speed cam section 26IN (26EX) and from rocking by the high speed cam section 26IN (26EX) to rocking by the low speed cam section 25IN (25EX) is carried out during the roller 30IN (30EX) of the rocker arm 20IN (20EX) is in sliding contact with the base circle section of the low speed cam section 25IN (25EX) or the base circle section of the high speed cam section 26IN (26EX).

As shown in FIG. 2, on both sides of a cam holder 8 positioned between a right side cylinder 5 and a left side cylinder 5 are disposed the intake (exhaust) first oil pressure chamber 36IN (36EX) belonging to the right side cylinder 5 and the intake (exhaust) first oil pressure chamber 36IN (36EX) belonging to the left side cylinder 5 symmetrically, and a first connecting oil passage 41IN (41EX) is used in common. Further, the intake (exhaust) variable cam piece 19IN (19EX), the intake (exhaust) low speed and high speed cam sections 25IN, 26IN (25EX, 26EX), the driving piston 33IN (33EX) and arms 34IN, 35IN (34EX, 35EX) belonging to the left side cylinder 5 and those belonging to the right side cylinder 5 are also disposed symmetrically with respect to the cam holder 8. This is true also regarding other cam holder 8 positioned between two cylinders 5 and other elements of the valve moving apparatus V belonging to the cylinders 5.

The above-mentioned first embodiment works as follows.

In state that the internal combustion engine 1 has started and the oil pump is operated, when the engine 1 is in the low rotational speed region that rotational speed of the engine 1 is less than the predetermined rotational speed, the first control valve acts so that working oil supplied to the intake side and exhaust side first oil pressure chambers 36IN, 36EX through the first oil supply passage 42IN and the intake side and exhaust side first connecting oil passages 41IN, 41EX becomes high oil pressure, simultaneously, the second control valve acts so that working oil supplied to the intake side and exhaust side second oil pressure chambers 37IN, 37EX through the second oil supply passage 42EX and the intake side and exhaust side second connecting oil passages 43IN, 43EX becomes loe oil pressure. Accordingly, the driving piston 33IN of the intake side driving mechanism 21IN occupies a low speed position shown in FIG. 4, which is a state before the engine 1 is started, by pressure difference between the first oil pressure chamber 36IN and the second oil pressure chamber 37IN. The driving piston 33EX of the exhaust side driving mechanism 21EX also occupies a similar low speed position.

Therefore, the low speed cam section 25IN (25EX) of the intake (exhaust) variable cam piece 19IN (19EX) comes into sliding contact with the roller 30IN (30EX) of the intake (exhaust) rocker arm 20IN (20EX), so that a pair of intake (exhaust) valves 11IN (11EX) of each cylinder 5 is opened and closed with a small lift amount and a short valve opening period adapted to valve operating characteristic at the low rotational speed region.

When the engine 1 shifts to a high rotational speed region that rotational speed of the engine 1 is more that the above-mentioned predetermined rotational speed, the first control valve acts so that working oil supplied to the intake side and exhaust side first oil pressure chambers 36IN, 36EX through the first oil supply passage 42IN and the intake side and exhaust side first connecting oil passages 31IN, 41EX becomes low oil pressure, simultaneously, the second control valve acts so that working oil supplied to the intake side and exhaust side second oil pressure chambers 37IN, 37EX through the second oil supply passage 42EX and the intake side and exhaust side second connecting oil passages 43IN, 43EX becomes high oil pressure. Accordingly, the driving piston 33IN of the intake side driving mechanism 21IN is driven so as to move from the low speed position to a high speed position shown in FIGS. 2 and 5, and the driving piston 33EX of the exhaust side driving mechanism 21EX is also driven so as to move to a high speed position shown in FIG. 2.

At that time, if the roller 30IN (30EX) of the intake (exhaust) rocker arm 20IN (20EX) is in sliding contact with the base circle section of the low speed cam section 25IN (25EX), the driving piston 33IN (33EX) immediately moves axially and the intake (exhaust) variable cam piece 19IN (19EX) subjected to driving force through a pair of contact sections 39IN*a* (39EX*a*) of the second arm 35IN (35EX) moves axially. Accordingly, the intake variable cam piece 19IN occupies a position shown in FIGS. 2 and 5 that the high speed cam section 26IN is in sliding contact with the roller 30IN of the intake rocker arm 20IN, similarly, the exhaust variable cam piece 19EX occupies a position that the high speed cam section 26EX is in sliding contact with the roller 30EX of the exhaust rocker arm 20EX (FIG. 2).

When the intake (exhaust) side driving piston 33IN (33EX) is forced to move from the low speed position to the high speed position, if the roller 30IN (30EX) is in sliding contact with the high portion of the lower speed cam section 25IN (25EX), the driving piston 33IN (33EX) moves axially toward the high speed position immediately after the roller 30IN (30EX) comes into contact with the base circle section of the low cam section 25IN (25EX) owing to successive rotation of the camshaft 7IN (7EX). Simultaneously, the intake (exhaust) variable cam piece 19IN (19EX) given driving force through the contact section 39IN (39EX*a*) of the second arm 35IN (35EX) moves axially toward the high speed position that high speed cam section 26IN (26EX) is in slide contact with the roller 30IN (30EX) of the intake (exhaust) rocker arm 20IN (20EX).

Therefore, in the high rotational speed region, a pair of intake (exhaust) valves 11IN (11EX) of each cylinder 5 is opened and closed by the intake (exhaust) side high speed cam section 26IN (26EX) with a large lift amount; and a long valve opening period adapted to valve operating characteristic in the high rotational speed region.

When engine shifts from the high rotational speed region to the low rotational speed region, owing to actions of the first and second control valves, working oil supplied to the intake side and exhaust side first oil pressure chambers 36IN, 36EX becomes high oil pressure, and working oil supplied to the intake side and exhaust side oil pressure chambers 37IN, 37EX becomes low oil pressure. Accordingly, the driving section 33IN (33EX) of the intake (exhaust) side driving mechanism 21IN (21EX) is forced to move from the high speed position to the low speed position by difference of oil pressure between the first oil pressure 36IN (36EX) and the second oil pressure chamber 37IN (37EX). IN that case, immediately if the roller 30IN (30EX) of the intake (exhaust) rocker arm 20IN (20EX) is in sliding contact with the base circle section of the low speed cam section 25IN (25EX), or after the roller 30IN (30EX) comes into contact with the base circle section of the high speed cam section 26IN (26EX) if the roller 30IN (30EX) is in sliding contact with the high portion of the high speed cam section 26IN (26EX), the driving piston 33IN (33EX) moves axially toward the low speed position and the intake (exhaust) variable cam piece 19IN (19EX) given driving force through the contact section 38In*a* (38EX*a*) of the first arm 34IN (34EX) moves axially toward the low speed position that the low speed cam section 25IN (25EX) comes into sliding contact with the roller 30IN (30EX).

Thus, when the intake (exhaust) variable cam piece 19IN (19EX) is moved axially to change valve operating characteristic (lift amount and operation angle) of the intake (exhaust) valve 11IN (11EX), the intake (exhaust) side driving mechanism 21IN (21EX) moves only the intake (exhaust) variable cam piece 19IN (19EX) which is provided on the intake (exhaust) camshaft 7IN (7EX) movably, and as the result, the intake (exhaust) valve 11IN (11EX) is opened and closed by the low speed cam section 25IN (25EX) and the high speed cam section 26IN (26EX) which constitute a variable cam section having different valve operating characteristics changing in direction of the rotary axis $L_{IN}$ ($L_{EX}$). Weight of the intake (exhaust) variable cam piece 19IN (19EX) to be moved by the driving mechanism 21IN (21EX) is very light compared with the driving cam and the camshaft in the aforementioned prior art, therefore the driving mechanism 21IN (21EX) does not require a large driving force and can be miniaturized.

Since driving force of the driving piston 33IN (33EX) for moving the intake (exhaust) variable cam piece 19IN (19EX) in direction of the rotary axis $L_{IN}$ ($L_{EX}$) acts on the first and second side surfaces 25IN*a*, 25IN*a* (25EX*a*, 25EX*a*) of the intake (exhaust) variable cam piece 19IN (19EX) through the contact sections 38IN*a*, 39IN*a* (38EX*a*, 39EX*a*) of the first and second arms 34IN, 35IN (34EX, 35EX), the contact sections 38IN*a*, 39IN*a* (38EX, 39EX) do not influence rotation of the intake (exhaust) variable cam piece 19IN (19EX) which rotates together with the intake (exhaust) camshaft 7IN (7EX). The contact sections 38IN*a*, 39IN*a* (38EX, 39EX) touch the first and second side surfaces 25in*a*, 26IN*a* (25EX*a*, 26EX*a*) of the variable cam piece 19IN (19EX) at positions equally distant from the rotary axis $L_{IN}$ ($L_{EX}$) and opposite to each other diametrically. Therefore, no moment about a straight line perpendicular to the rotary axis $L_{IN}$ ($L_{EX}$) occurs on the intake (exhaust) variable cam piece 19IN (19EX). Accordingly, when the variable cam piece 19IN (19EX) is moved, increase of frictional resistance owing to the above moment is prevented and the variable cam piece 19IN (19EX) can be moved smoothly in direction of the rotary axis $L_{IN}$ ($L_{EX}$).

Since the center axis $L_{PIN}$ ($L_{PEX}$) of the driving piston 33IN (33EX) is parallel with the rotary axis $L_{IN}$ ($L_{EX}$), moving direction of the driving piston 33IN (33EX) is parallel with the rotary axis $L_{IN}$ ($L_{EX}$), and the driving piston 33IN (33EX) can be arranged close to the camshaft 7IN (7EX).

Since the driving piston 33IN (33EX) has the recess 40IN (40EX) allowing passage of the rotating low speed and high speed cam sections 25IN, 26IN (25EX, 26EX), the driving piston 33IN (33EX) can be arranged more closely to the camshaft 7IN (7EX).

Since the driving piston 33IN (33EX) is supported by the first and second hollows 31IN, 32IN (31EX, 32EX) provided in respective upper cam holders 8U of neighboring cam holders 8, any other member for supporting the driving piston 33IN (33EX) is unnecessary.

Since working oil is supplied to the first and second oil pressure chambers 36IN, 37IN (36EX, 37EX) through the first and second oil supply passages 42IN (42EX) formed utilizing the hollow portions of the intake and exhaust rocker shafts 18IN, 18EX, oil passage structure of the valve moving apparatus V is not complicated and arrangement of elements constituting the valve moving apparatus V is not restrained, owing to provision of oil passages for the driving mechanisms 21IN, 21EX.

The center axis $L_{PIN}$ of the driving piston 33IN is positioned near the center axis $L_C$ of the cylinder 5 more than the rotary axis $L_{IN}$ of the intake camshaft 7IN and the center axis $L_{PEX}$ of the driving piston 33EX is positioned near the center axis $L_C$ of the cylinder 5 more than the rotary axis $L_{EX}$ of the exhaust camshaft 7EX. Namely, both the driving piston 33IN of the intake side driving mechanism 21IN and the driving piston 33EX of the exhaust side driving mechanism 21EX are disposed between the intake camshaft 7IN and the exhaust camshaft 7EX. Further, the contact sections 38IN*a*, 39IN*a* (38EX*a*, 39EX*a*) for transmitting driving force of the driving piston 33IN (33EX) to the variable cam piece 19IN (19EX) are provided on the arms 34IN, 35IN (34EX, 35EX) extending from the driving piston 33IN (33EX) toward the camshaft 7IN (7EX). Accordingly, both the intake side driving mechanism 21IN and the exhaust side driving mechanism 21EX can be accommodated between the camshafts 7IN, 7EX so that width of the valve moving apparatus V in direction perpendicular to the rotary axis $L_{IN}$, $L_{EX}$ does not become large.

The above-mentioned first embodiment exhibits following effects.

When valve operating characteristic of the intake (exhaust) valve 11IN (11EX) is changed, the intake (exhaust) side driving mechanism 21IN (21EX) moves only the intake (exhaust) variable cam piece 19IN (19EX) of small weight, therefore, the variable cam piece moves quickly to improve response, operation region that the engine can be operated with a valve operating characteristic most suitable for engine operation condition is widened, and engine performance such as engine output can be improved. Further, since the driving mechanisms 21IN, 21EX can be miniaturized, the valve moving apparatus can be miniaturized, and accordingly the internal combustion engine can be miniaturized.

Since contact sections 38IN*a*, 39IN*a* (38Ex*a*, 39EX*a*) do not influence rotation of the variable cam piece 19IN (19EX), the variable cam piece 19IN (19EX) opens and closes the intake (exhaust) valve 11IN (11EX) surely.

Since the contact sections 38IN*a*, 39IN*a* (38EX*a*, 39EX*a*) come into contact with the variable cam piece 19IN (19EX) at positions equally distant from the rotary axis $L_{IN}$ ($L_{EX}$) and opposite to each other diametrically, the variable cam piece 19IN (19EX) cam be moved axially smoothly with smaller driving force and intake (exhaust) side driving mechanism can be more miniaturized.

Since the axis $L_{PIN}$ ($L_{PEX}$) of the driving piston 33IN (33EX) is parallel with the rotary axis $L_{NI}$ ($L_{EX}$) and therefore direction of reciprocation of the driving piston is parallel with the rotary axis, the driving piston 33IN (33EX) can be disposed near the camshaft 7IN (7EX), and the valve moving apparatus V and the internal combustion engine 1 can be miniaturized.

Since the driving piston 33IN (33EX) has the recess 40IN (40EX) allowing passage of the rotating low speed and high speed cam sections 25IN, 26IN (25EX, 26EX), the driving piston 33IN (33EX) can be arranged more closely to the camshaft 7IN (7EX).

Since the driving piston 33IN (33EX) is supported by the cam holder 8 and other member for supporting the driving piston is unnecessary, number of parts can be reduced, and the valve moving apparatus V and the engine 1 can be miniaturized.

Since working oil is supplied to the first and second oil pressure chambers 36IN, 37IN (36EX, 37EX) through the first and second oil supply passages 42IN (42EX) formed utilizing the hollow portions of the intake and exhaust rocker shafts 18IN, 18EX, oil passage structure of the valve moving apparatus V is not complicated and arrangement of elements constituting the valve moving apparatus V is not restrained, owing to provision of oil passages for the driving mechanisms 21IN, 21EX. Therefore, the valve moving apparatus av and the engine 1 can be miniaturized.

Since both the intake side driving mechanism 21IN and the exhaust side driving mechanism 21EX can be accommodated between the camshafts 7IN, 7EX, width of the valve moving apparatus V in direction perpendicular to the rotary axes $L_{IN}$, $L_{EX}$ does not become large. Therefore, the valve moving apparatus v and the engine 1 can be miniaturized.

Next, partial modifications of the above embodiment will be described.

In the above embodiment, both the intake cam piece and the exhaust cam piece are variable cam pieces. However, at least one of the intake cam piece and the exhaust cam piece may be a variable cam piece, or a part of the intake cam piece and the exhaust cam piece may be formed as a variable cam piece. Further, the variable cam piece may have valve operating characteristic that at least one of the intake valve and the exhaust valve is held in closed state on a specific operating condition of the engine. For example, the variable cam piece may have such valve operating characteristic that in a multi-cylinder internal combustion engine, in order to stop a part of the cylinders on a specific engine operation, the intake and exhaust valves of the stopped cylinder are held in closed state. The intake and exhaust variable cam piece 19IN, 19EX may have respective valve operating characteristics different from each other.

In the above embodiment, the variable cam piece 19IN (19EX) and the camshaft 7IN (7EX) are connected by means of spline-engagement. However, in place of the spline-engagement, a key-engagement may be used. Or, cross-sections of the axial hole of the variable cam piece and a part of the camshaft engaging with the axial hole may be formed in a non-circular shape, elliptical shape for example, so that they rotate in a body. Further, the variable cam piece and the camshaft may be connected by means of a spiral groove and a spiral projection so that when the variable cam piece moves axially relatively to the camshaft, the variable cam piece rotates relatively to the camshaft in a predetermined extent. In this case, when lift amount and operation angle is changed, opening-closing timing of the intake valve or the exhaust valve can be changed maintaining the changed operation angle (valve opening period) of the valves.

In the above embodiment, the intake side and exhaust side driving mechanism 21IN, 21EX have the first and second oil pressure chambers 36IN, 37IN; 36EX, 37EX. However, an oil pressure chamber may be provided on an end of the driving piston and a return spring opposing oil pressure of the oil pressure chamber may be provided on another end of the driving piston.

In the above embodiment, the driving piston has two positions. However, the variable cam section of the variable cam piece may have three cams of different valve operating characteristics so that the driving piston has three positions. In this case, a first state that the first oil pressure chamber is of high oil pressure and the second oil pressure chamber is of low oil pressure, a second state that the first oil pressure chamber is of high oil pressure and the second oil pressure chamber is of high oil pressure, and a third state that the first oil pressure chamber is of low oil pressure and the second oil pressure is of high oil pressure are available, for example.

In the above embodiment, the internal combustion engine 1 has the intake camshaft 7IN and the exhaust camshaft 7EX, However, the internal combustion engine 1 may be a SOHC type internal combustion engine having single camshaft. Each cylinder may have one or more than three intake valves or one or more than three exhaust valves. The internal combustion engine may be a single-cylinder internal combustion engine.

In the valve moving apparatus V of the above embodiment, the intake (exhaust) valve 11IN (11EX) is opened and closed by the intake (exhaust) variable cam piece 19IN (19EX) through the intake (exhaust) rocker arm 20IN (20EX). However, the valve moving apparatus may be a direct type valve moving apparatus in which the intake (exhaust) valve is opened and closed by the intake (exhaust) variable cam piece 19IN (19EX) directly.

According to the above embodiment, response of the intake valve and the exhaust valve when engine is operated at a high rotational speed is improved, and height of the valve moving chamber can be made low to make the internal combustion engine compact. However, in case of the direct type valve moving apparatus, when the intake (exhaust) valve is operated by the intake (exhaust) cam piece having neighboring cams of different cam profiles, interference between a valve lifter of the intake (exhaust) valve and a cam of the intake (exhaust) variable cam section which is not contacted with the valve lifter, especially a high speed cam projected higher than the low speed cam, and interference between the valve lifter and the driving mechanism for moving the cam piece axially become problems.

Hereinafter, another embodiment of the present invention will be described with reference to FIGS. 6 to 13. According to this embodiment, total axial length of a cam piece having cams with different cam profiles arranged in direction of an axis of a camshaft and a driving mechanism can be made small, and a compact and light type valve moving apparatus is provided.

Figure 6:
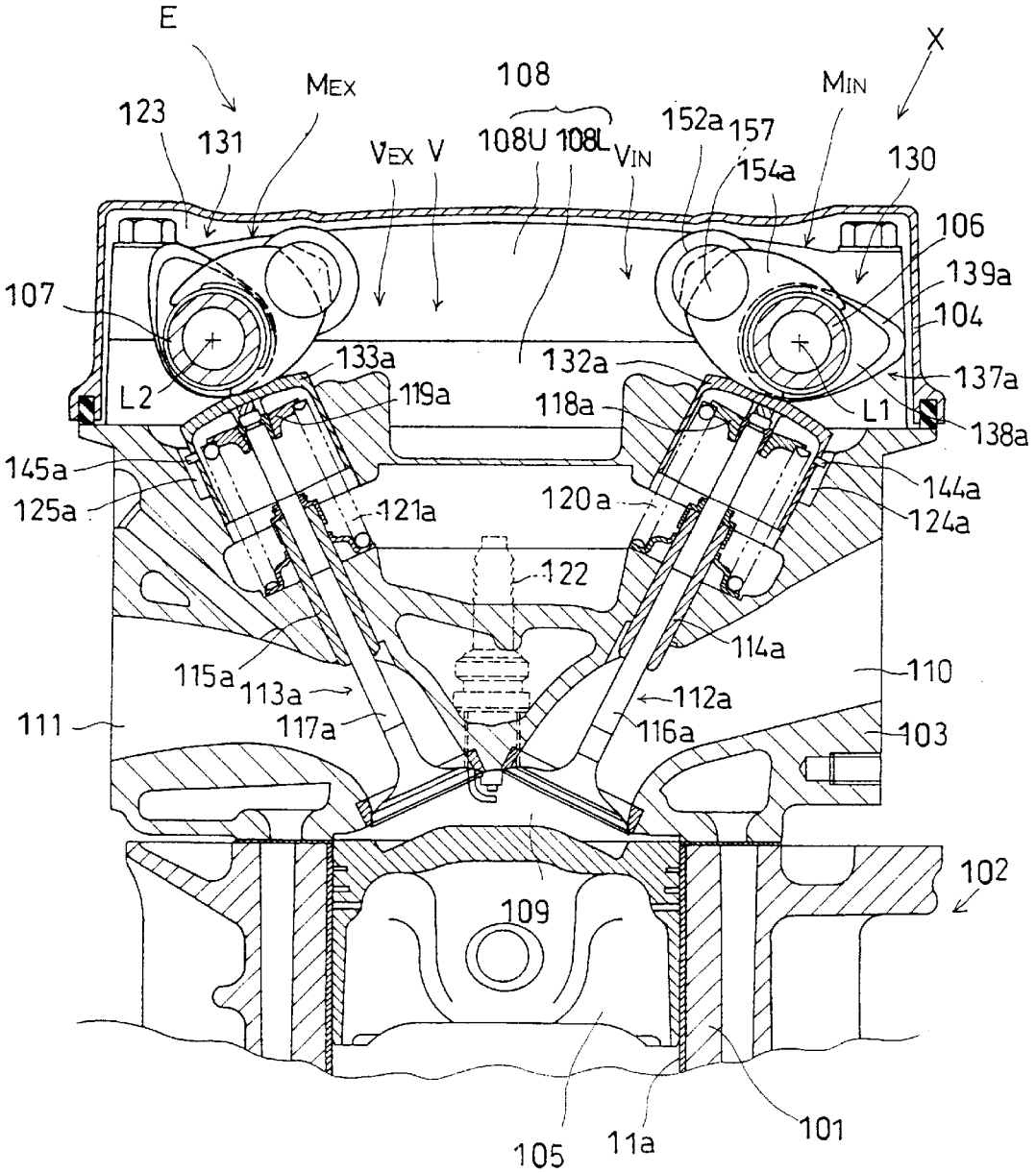
FIG. 6 is a partial longitudinal sectional view of an internal combustion engine having a direct type valve moving apparatus according to another embodiment of the present invention.

An internal combustion engine in this embodiment is a DOHC type in-line 4-cylinder 4-stroke-cycle internal combustion engine. As shown in FIG. 6, the engine E has a cylinder block 102 provided with four cylinders 101 integrally (only one cylinder is shown in FIG. 6). On an upper surface of the cylinder block 102 is attached a cylinder head 103, and on an upper surface of the cylinder head 103 is attached a head cover 104. A piston 105 fitted in each cylinder 101 so as to reciprocate is connected to a crankshaft (not shown) through a connecting rod (not shown). An intake camshaft 106 and an exhaust camshaft 107 are arranged in direction of row of cylinder in parallel with each other and rotatably supported by five cam holders 108 fixed to the cylinder head 103 by bolts. The camshafts 106, 107 are rotated synchronized with the crankshaft at a speed reduction ratio of 1/2. The cam holders 108 are disposed at both ends of the row of cylinders and between neighboring cylinders. The cam holder 108 consists of an upper cam holder 108U and a lower cam holder 108L which are divided from each other by a plain including a rotary axis L1 of the intake camshaft 106 and a rotary axis L2 of the exhaust camshaft 107.

Each cylinder 101 has a combustion chamber 109 formed between the piston 105 and the cylinder head 103, and a pair of intake ports 110 and a pair of exhaust ports 111 are opened to the combustion chamber 109. A first intake valve 112*a* and a second intake valve 112*b* (FIG. 7), which are a pair of engine valves for intake, and a first exhaust valve 113*a* and a second exhaust valve (not shown), which are a pair of engine valves for exhaust),are provided so as to slide in respective valve guides 114*a*, 115*a*. The first and second intake valves 112*a*, 112*b*, the first exhaust valve 113*a* and the second exhaust valve are forced in closing direction by valve springs 120*a*, 120*b*, 121*a* compressed between the cylinder head 103 and retainers 118*a*, 118*b*, 119*a* provided at upper ends of valve stems 116*a*, 117*a*, respectively. A ignition plug 122 facing about central portion of the combustion chamber 109 is screwed to the cylinder head 103.

In a valve moving chamber 123 formed between the cylinder head 103 and the head cover 104 is housed a direct type valve moving apparatus V for opening and closing the intake valves 112*a*, 112*b* and the exhaust valves 113*a*. The valve moving apparatus V comprises an intake side valve moving apparatus $V_{IN}$ including an intake camshaft 106, an intake cam piece 130, intake valve lifters 132*a*, 132*b* and a hydraulic intake side driving mechanism $M_{IN}$ which is an intake side switching means for moving the intake cam piece 130 in direction of a rotary axis of the intake camshaft 106, and an exhaust side valve moving apparatus $V_{EX}$ including an exhaust camshaft 107, an exhaust cam piece 131, exhaust valve lifters 133*a* and a hydraulic exhaust side driving mechanism $M_{EX}$ which is an exhaust side switching means for moving the exhaust cam piece 131 in direction of a rotary axis of the exhaust camshaft 107. The intake side valve moving apparatus $V_{IN}$ and the exhaust side valve moving apparatus $V_{EX}$ have the same construction basically. Therefore, in the following, mainly the intake side valve moving apparatus $V_{IN}$ will be describes.

Figure 7:
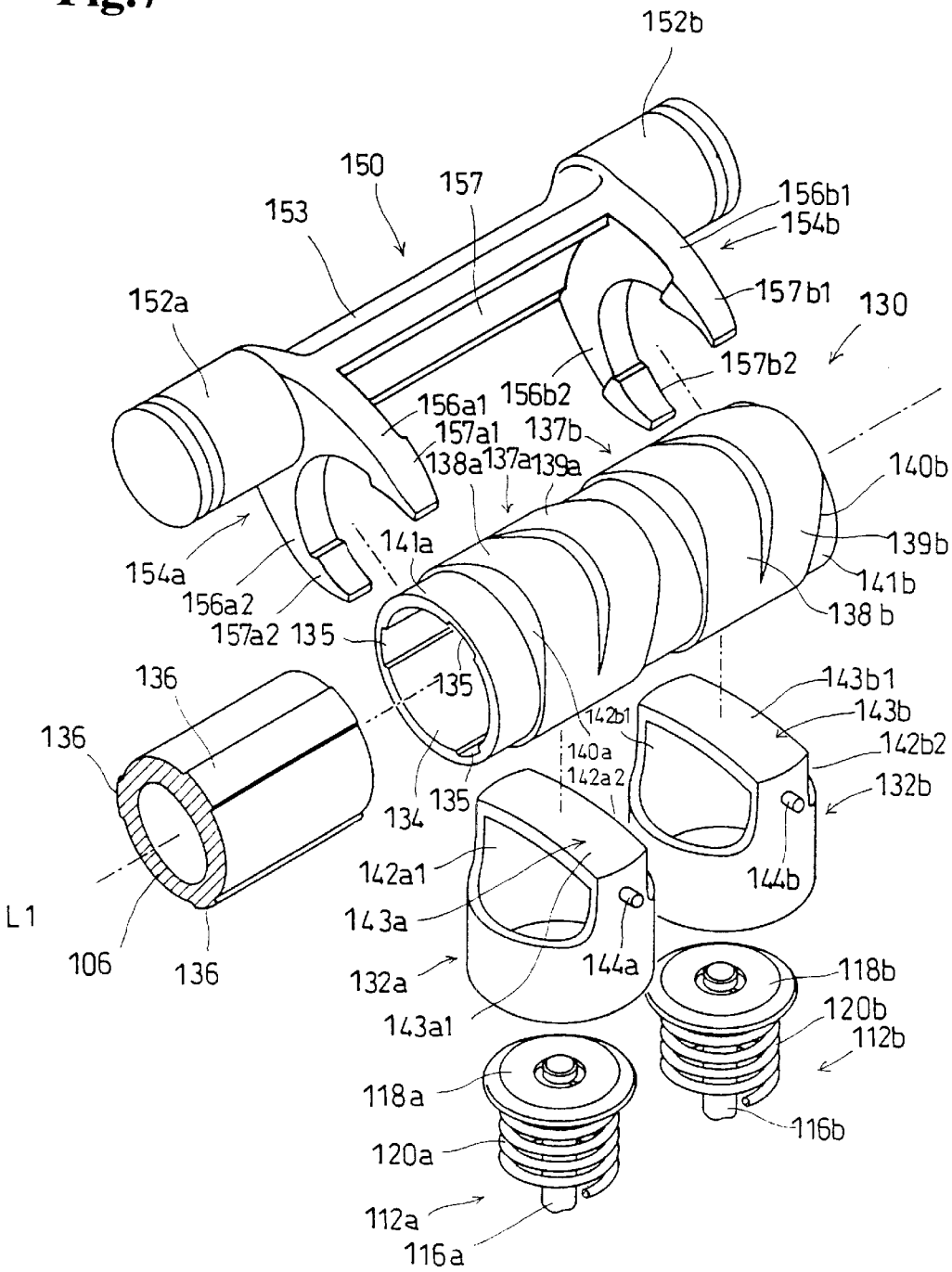
FIG. 7 is a partial exploded view of a intake side valve moving Apparatus of the internal combustion engine of FIG. 6.

Referring to FIG. 7 too, the intake cam piece 130 of each cylinder 101 having an axial hole 134 which the intake camshaft 106 passes through is engaged with the intake camshaft 106 by spline so as to slide axially and rotate together with the intake camshaft 106. In this embodiment, on an inner peripheral surface of the intake cam piece 130, three axial grooves 135 extending in parallel with each other over the total length of the intake cam piece 130 are provided at regular intervals, and on an outer peripheral surface of the intake camshaft 106 are provided three parallel projecting lines 136 corresponding to the grooves 135.

On the intake cam piece 130 are disposed a first cam section 137*a* and a second cam section 137*b* axially in series and at a distance. On each of the first and second intake cam sections 137*a*, 137*b*, a low speed cam 138*a* (138*b*) and a high speed cam 139*a* (139*b*) having profiles different from each other are provided integrally neighboring in direction of the rotary axis L1. Namely, the low speed cam 138*a* (138*b*) has a cam profile comprising a nose portion with a relatively small projecting amount in radial direction and a predetermined operation angle in circumferential direction, and a base circle portion. On the one hand, the high speed cam 139*a* (139*b*) has a cam profile comprising a nose portion with a projecting amount larger than that of the low speed cam 138*a* (138*b*) and an operation angle larger than that of the low speed cam 138*a* (138*b*), and a base circle portion of the same diameter as the base circle portion of the low speed cam 138*a* (138*b*).

The cam section of the intake cam piece 130 comprising the first cam section 137*a* and the second cam section 137*b* has a first side surface 140*a* on side of the low speed cam 138*a* and a second side surface 140*b* on side of the high speed cam 139*b*, and the intake cam piece 130 has a first cylindrical section 141*a* extending from the first side surface 140*a* in direction of the rotary axis L1 and a second cylindrical section 141*b* extending from the second side surface 140*b* in direction of the rotary axis L1. Under the intake cam piece 130, a first intake valve lifter 132*a* is disposed between the first intake cam section 137*a* and the first intake valve 112*a*, and a second intake valve lifter 132*b* is disposed between the second cam section 137*b* and the second intake valve 112*b*. The first and second intake valve lifters 132*a*, 132*b* are fitted in lifter holes provided in the cylinder head so as to slide along axes of the valve stems 116*a*, 116*b*.

Each intake valve lifter 132*a* (132*b*) is formed in a cylinder having an opened lower end and an upper wall and has cut portions 142*a*1, 142*a*2 (142*b*1, 142*b*2) at an upper part and on both sides in direction of the rotary axis L1. The cut portion forms an opening penetrating a side wall of the cylinder to connect the outer side with the inner side. Lubricating oil supplied to the valve moving chamber 123 goes into the inner side of the intake valve lifter 132*a* (132*b*) through the opening to lubricate a valve spring 120*a* (120*b*), a retainer 118*a* (118*b*) and the valve stem 116*a* (116*b*).

Remaining parts of the upper walls of the intake valve lifters 132*a*, 132*b* form bridge-like slipper sections 143*a*, 143*b* coming into sliding contact with the low speed cams 138*a*, 138*b* and high speed cams 139*a*, 139*b*. The outer surface 143*a*1 (143*b*1) of the slipper section 143*a* (143*b*) is formed in a cylindrical surface raised toward the intake cam section 137*a* (137*b*) and having an axis parallel with the rotary axis L1.

Figure 8:
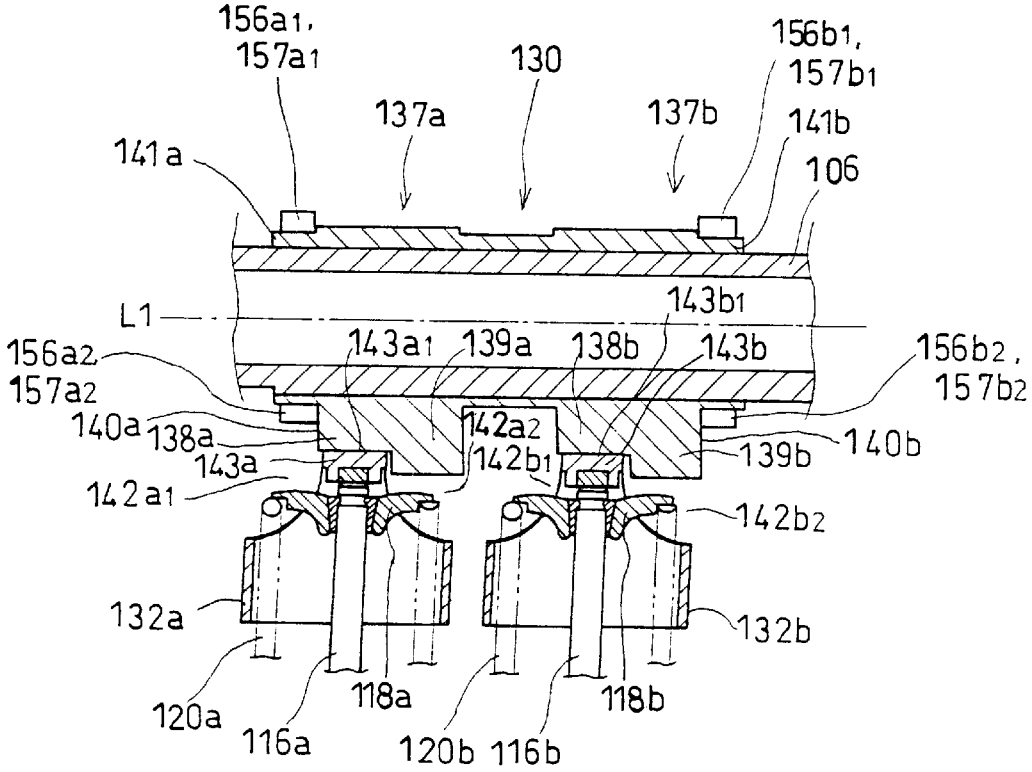
FIG. 8 is a partial sectional view of a intake cam piece and a intake valve lifter in a low speed position taken along a plain including a rotary axis of a intake camshaft and an axis of a valve stem.
Figure 9:
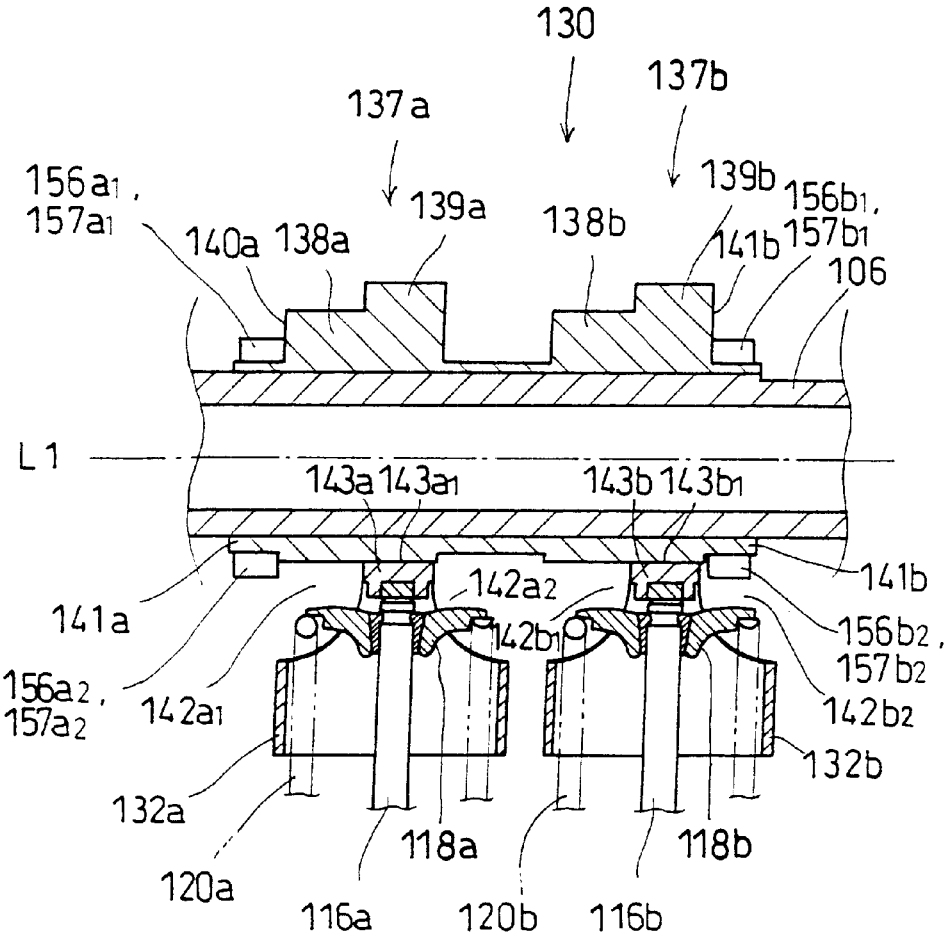
FIG. 9 is a partial sectional view of the intake cam piece and the intake valve lifter in a high speed position similar to FIG. 8.

As shown in FIG. 8, when the low speed cam 138*a* (138*b*) of the first (second) intake cam section 137*a* (137*b*) is in sliding contact with the slipper section 143*a* (143*b*), the high speed cam 139*a* (139*b*) having the nose section higher than that of the low speed cam 138*a* (138*b*) passes through the cut portion 142*a*2 (142*b*2) without touching the intake valve lifter 132*a* (132*b*). Namely, the cut portion 142*a*2 (142*b*2) forms an escape for the high speed cam 139*a* (139*b*). The width of the intake cam section 137*a* (137*b*) in direction of the rotary axis L1 is narrower than that of the intake valve lifter 132*a* (132*b*). The retainer 118*a* (118*b*) is positioned within the cut portions 142*a*1, 142*a*2 (142*b*1, 142*b*2) closely to the highest point of the nose portion of the high speed cam 139*a* (139*b*) so that distance between an end of the valve stem 116*a* (116*b*) and the sliding surface 143*a*1 (143*b*1) of the slipper section 143*a* (143*b*) can be made short to make the valve moving apparatus V compact.

Referring to FIGS. 6 and 7, the first intake valve lifter 132*a* has a first pin 144*a* engaging with a first guide groove 124*a* formed on a peripheral surface of the lift hole in parallel with the axis of the valve stem 116*a*, and the second intake valve lifter 132*b* has a second pin 144*b* engaging with a second guide groove similar to the above-mentioned first guide groove. The first guide grove 124*a* and the second guide groove engaging with the first pin 144*a* and the second pin 144*b* prevent rotation of the intake valve lifters 132*a*, 132*b* allowing axial sliding motion thereof. The exhaust valve lifter also has a similar pin engaging with a guide groove formed in the cylinder head 103. In FIG. 6 are shown a first guide groove 125*a* and a first pin 145*a* for an exhaust valve lifter.

When the intake cam piece 130 is moved axially by the intake side driving mechanism $M_{IN}$, the low speed cams 138*a*, 138*b* and the high speed cams 139*a*, 139*b* of the first and second cam sections 137*a*, 137*b* come into sliding contact with the slipper sections 143*a*, 143*b* selectively, and the first and second intake valves 112*a*, 112*b* are operated in accordance with cam profiles of the cams coming into sliding contact with the slipper sections to open and close the intake ports with lift amounts and opening-closing periods set by the nose portions of the cams.

Next, the intake side driving mechanism $M_{IN}$ will be described with reference to FIGS. 7, 10 and 11. The intake side drive mechanism $M_{IN}$ includes first and second cylindrical sections 151*a*, 151*b* formed in respective boss sections each projecting from adjacent upper cam holders 108U so as to face each other, and a double-action type driving piston (movable member) 150. The driving piston 150 includes first and second piston sections 152*a*, 152*b* supportedly fitted in the respective cylindrical sections 151*a*, 151*b*, a connecting section 153 connecting the both piston sections 152*a*, 152*b* with each other, and a pair of arms (manipulating members) 154*a*, 154*b* extending from the connecting section 153 toward the intake camshaft 105. The center axis of the driving piston 150 is parallel with the rotary axis L1 of the intake camshaft 106 and coincides with canter axes of the first and second cylindrical sections 151*a*, 151*b*.

Between the first piston section 152*a* and the first cylindrical section 151*a* is formed a first oil pressure chamber 155*a*, and between the second piston section 152*b*, and the second cylindrical section 151*b* is formed a second oil pressure chamber 155*b*. The driving piston 150 is subjected to driving force in accordance with pressure of working oil supplied to the both oil pressure chambers 155*a*, 155*b* and reciprocates axially.

The first arm 154*a* is positioned outside of the first side surface 140*a*, and the second arm 154*b* is positioned outside of the second side surface 140*b*. The first (second) arm 154*a* (154*b*) has a pair of manipulating sections 156*a*1, 156*a*2 (156*b*1, 156*b*2) which is forked so as to surround the first (second) cylindrical section 141*a* (141*b*).

The manipulating section 156*a*1 (156*a*2) of the first arm 154*a* has a first contact section 157*a*1 (157*a*2) coming into contact with the first side surface 140*a* and an outer peripheral surface of the first cylindrical section 141*a*. The first contact sections 157*a*1, 157*a*2 touch the first side surface 140*a* and the outer peripheral surface of the first cylindrical section 141*a* at respective positions equally distant from rotary axis L1 and diametrically opposite to each other. Similarly, the manipulating section 156*b*1 (156*b*2) of the second arm 154*b* has a second contact section 157*b*1 (157*b*2) coming into contact with the second side surface 140*b* and an outer peripheral surface of the second cylindrical section 141*b*. The second contact sections 157*b*1, 157*b*2 touch the second side surface 140*b* and the outer peripheral surface of the second cylindrical section 141*b* at respective positions equally distant from rotary axis L1 and diametrically opposite to each other.

The driving piston 150 has a recess 157 between the first and second arms 154*a*, 154*b* for allowing passage of the rotating cams 138*a*, 138*b*, 139*a*, 139*b*.

Next, a hydraulic system of the intake: side driving mechanism $M_{IN}$ will be described. The first oil pressure chamber 145*a* is connected to a working oil passage (not shown) through an opening 158*a*. The working oil passage is formed in the cylinder block 102, the cylinder head 103 and the cam holder 108 to communicate with an oil pump driven by the crankshaft. Working oil pressure in the first oil pressure chamber 155*a* is controlled into high pressure or low pressure by a first control valve (not shown) provided in the working oil passage. Similarly, the second oil pressure chamber 155*b* is connected to a second working oil passage (not shown) through an opening 158*b*, and working oil pressure in the second oil pressure chamber 155*b* is controlled into high oil pressure or low oil pressure by a second control valve.

Actions of the first and second control valves are controlled by a control apparatus (not shown) in which a signal detected by a rotational speed sensor as a engine operation condition sensor is inputted. When the engine E is in a low rotational speed region that the engine rotates at a rotational speed less than a predetermined value, the first control valve controls working oil pressure so that pressure in the first oil pressure chamber 155*a* becomes high oil pressure, and the second control valve controls working oil pressure so that pressure in the second oil pressure chamber 155*b* becomes low oil pressure. The driving piston 150 is driven by pressure difference between pressure in the first oil pressure chamber 155*a* and pressure in the second oil pressure chamber 155*b* to move the intake cam piece 130 axially, and the intake cam piece 130 is positioned at a low speed position shown in FIG. 10 where the low speed cam 138*a* (138*b*) comes into sliding contact with the slipper section 143*a* (143*b*) of the first (second) intake valve lifter 132*a* (132*b*). At that time, the manipulating section 156*a*2 and the contact section 157*a*2 are radially projected compared with the base circle portion of the low speed cam 138*a*, but they are positioned in the cut portion 142*a*1 and do not touch the first intake valve lifter 132*a*. Namely, the cut portion 142*a*1 functions as an escape for the manipulating section 156*a*2 and the contact section 157*a*2, or for the first arm 154*a*.

When rotational speed of the engine E rises beyond the determined value and the engine comes in a high rotational speed region, the first control valve controls working oil so that the first oil pressure chamber 155*a* becomes low oil pressure, and the second control valve controls working oil pressure so that the second oil pressure chamber 155*b* becomes high pressure. The driving piston 150 is driven by pressure difference between pressure in the first oil pressure chamber 155*a* and pressure in the second oil pressure chamber 155*b* to move the intake cam piece 130 axially, and the intake cam piece 130 is positioned at a high speed position shown in FIG. 11 where the high speed cam 139*a* (139*b*) comes into sliding contact with the slipper section 143*a* (143*b*) of the first (second) intake valve lifter 132*a* (132*b*). At that time, the manipulating section 156*b*2 and the contact section 157*b*2 are radially projected compared with the base circle portion of the high speed cam 139*b*, but they are positioned in the cut portion 142*b*2 and do not touch the second intake valve lifter 132*b*. Namely, the cut portion 142*b*2 functions as an escape for the manipulation section 156*b*2 and the contact section 157*b*2, or for the second arm 154*b*.

Shift from a state that the first and second valve lifters 132*a*, 132*b* are pushed by the low speed cams 138*a*, 138*b* to a state that the first and second intake valve lifters are pushed by the high speed cams 138*a*, 138*b*, and shift from a state that the intake valve lifters are pushed by the high speed cams to a state that the intake valve lifters are pushed by the low speed cams, are carried out when the base circle portions of the low speed cams or the high speed cams are in sliding contact with the slipper sections 143*a*, 143*b*.

Figure 10:
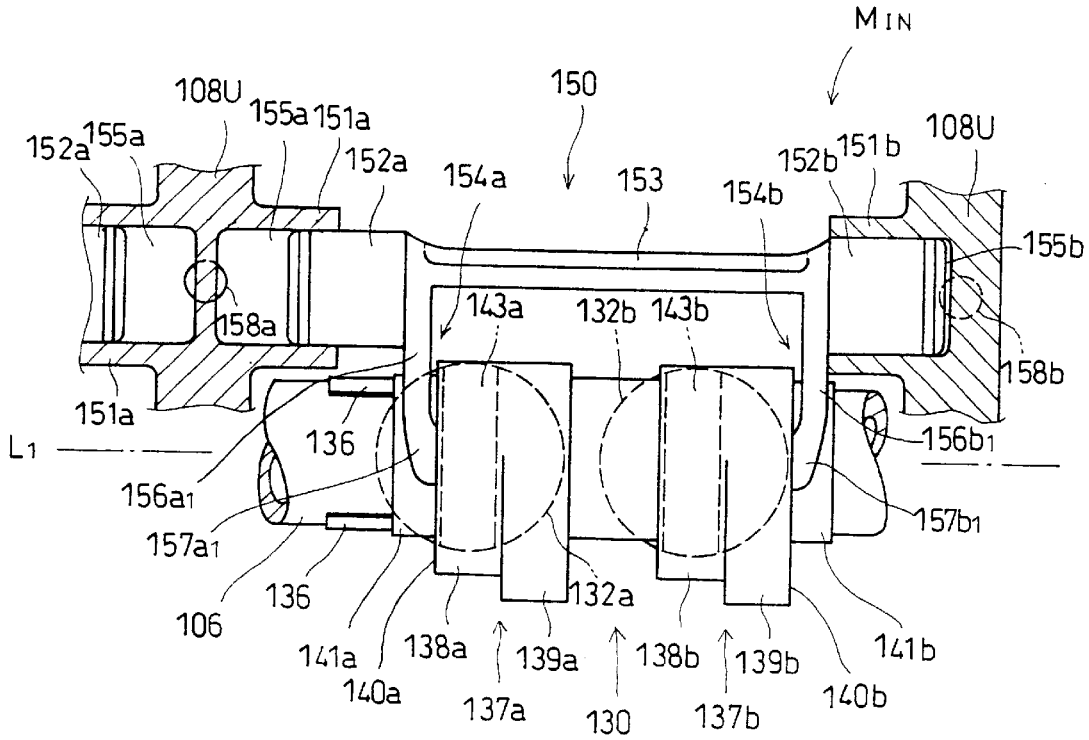
FIG. 10 is a view of the intake cam piece and the intake side driving mechanism in a low speed position viewed in direction of the arrow X of FIG. 6.
Figure 11:
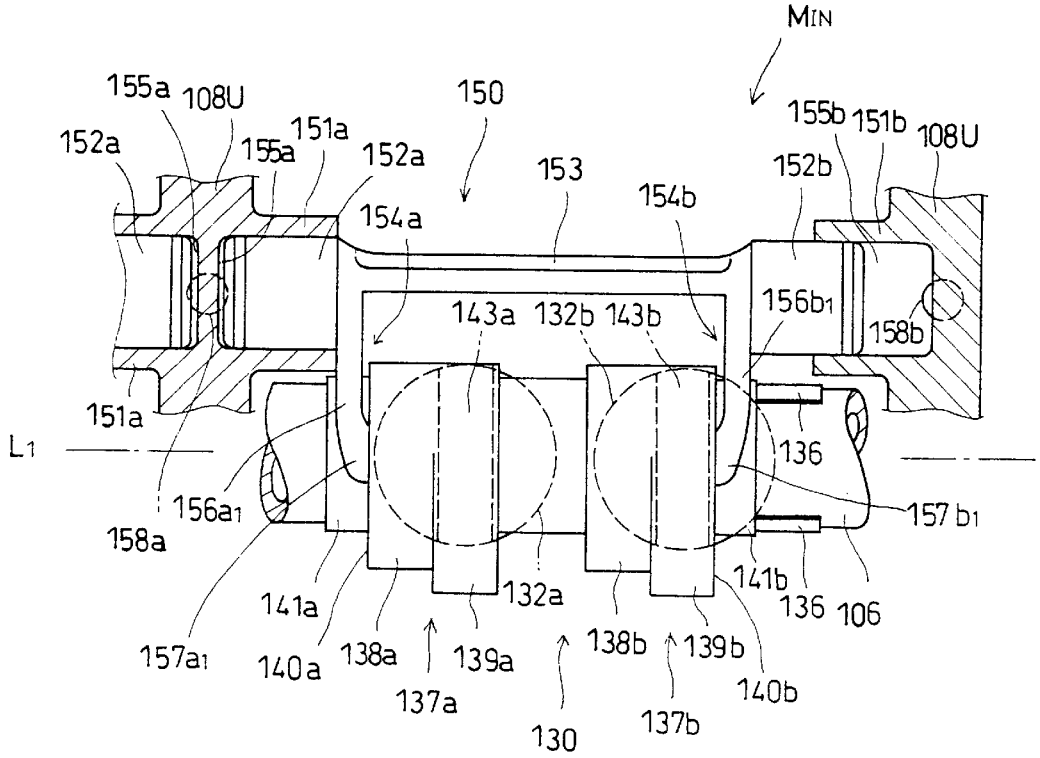
FIG. 11 is a view of the intake cam piece and the intake side driving mechanism in a high speed position similar to FIG. 10.

As shown in FIGS. 10 to 11, on both sides of a cam holder 108 positioned between a right side cylinder 101 and a left side cylinder 101 are disposed the first oil pressure chamber 155*a* belonging to the right side cylinder and the first oil pressure chamber 155*a* belonging to the left side cylinder symmetrically, and a working oil pressure us used in common for the both first oil pressure chambers. This is also true regarding other cam holders positioned between two cylinders and other elements of the valve moving apparatuses V belonging to the cylinders.

The above-mentioned embodiment works as follows.

In state that the engine E has started and the oil pump is operated, when the engine E is in the low rotational speed region that rotational speed of the engine E is less than he predetermined rotational speed, the first control valve acts so that working oil in the first oil pressure chamber 155*a* becomes of high oil pressure, simultaneously, the second control valve acts so that working oil in the second oil pressure chamber 155*b* becomes of low oil pressure. Accordingly, the driving piston 150 of the intake side driving mechanism $M_{IN}$ occupies a low speed position shown in FIG. 10 which is a state before the engine E is started. Therefore, the low speed cams 138*a*, 138*b* of the first and second intake cam sections 137*a*, 137*b* come into sliding contact with the slipper sections 143*a*, 143*b* of the first and second intake valve lifters 132*a*, 132*b*, respectively. A driving piston of the exhaust side driving mechanism $M_{EX}$ is also occupies a low speed position similarly to the intake side driving mechanism $M_{IN}$. Therefore, the first and second intake valves 112*a*, 112*b*, the first exhaust valve 113*a* and the second exhaust valve are opened and closed with a small lift amount, an opening-closing timing and a short valve opening period adapted to valve operating characteristic at the low rotational speed region. At that time, as shown in FIG. 8, the nose portions of the high speed cams 139*a*, 139*b* radially projecting more than the nose portions of the low speed cams 138*a*, 138*b* rotate passing through the cut portions 142*a*2, 142*b*2 without touching the first and second intake valve lifters 132*a*, 132*b*. The manipulating section 156*a*2 and the contact section 157*a*2 near the first intake valve lifter 132*a* do not touch the first intake valve lifter 132*a* because they are positioned in the cut portion 142*a*1. This is true also regarding the exhaust side valve moving apparatus $V_{EX}$.

When rotational speed of the engine E rises beyond the predetermined rotational speed and shifts in a high rotational speed region, the first control valve acts so that working oil in the first oil pressure chamber 155*a* becomes of low oil pressure, and the second control valve acts so that working oil in the second oil pressure chamber 155*b* becomes of high oil pressure. Therefore, the driving piston 150 is driven from the low speed position to the high speed position shown in FIG. 11.

At that time, if the slipper sections 143*a*, 143*b* of the first and second intake valve lifters 132*a*, 132*b* are in sliding contact with the base circle portions of the low speed cams 138*a*, 138*b*, the driving piston 150 moves immediately, simultaneously the intake cam piece 130 is moved axially through the contact sections 178*b*1, 178*b*2 of the second arm 154*b* and occupies a position where the high speed cams 139*a*, 139*b* come into sliding contact with the first and second intake valve lifters 132*a*, 132*b*. When the driving piston 150 is subjected to driving force to move from the low speed position to the high speed position, if the slipper sections 143*a*, 143*b* is in sliding contact with the nose portions of the low speed cams 138*a*, 138*b*, the driving piston 150 is moved toward the high speed position immediately after the base circle of the low speed cams 138*a*, 138*b* are brought into sliding contact with the slipper sections 143*a*, 143*b* owing to successive rotation of the intake camshaft 106. Simultaneously, the intake cam piece 130 given driving force through the contact sections 157*b*1, 157*b*2 of the second arm 154*b* moves axially toward the high speed position where the high speed cams 139*a*, 139*b* come into sliding contact with the slipper sections 143*a*, 143*b*. Therefore, in the high rotational speed region, the high speed cams 139*a*, 139*b* are in sliding contact with the slipper sections 143*a*, 143*b* of the first and second intake valve lifters 132*a*, 132*b*. The driving piston of the exhaust side drive mechanism $M_{EX}$ also occupies a high speed section similarly to the intake side driving mechanism $M_{EX}$. Therefore, the first and second intake valves 112*a*, 112*b*, the first exhaust valve 113*a* and the second exhaust valve are opened and closed with a large lift amount, a opening-closing timing and a long valve opening period adapted to valve operating characteristic at the high rotational speed region. At that time, the manipulating section 156*b*2 and the contact section 157*b*2 positioned near the second intake valve lifter 132*b* radially projecting more than the base circle portion of the high speed cam 139*b* do not touch the second intake valve lifter 132*b* because they are positioned in the cut portion 142*b*2. This is the same in case of the exhaust side valve moving apparatus $V_{EX}$, too.

When the engine shifts from the high rotational speed region to the low rotational speed region, by actions of the first and second control valves, working oil in the first oil pressure chamber 155*a* becomes of high oil pressure and working oil in the second oil pressure chamber 155*b* becomes of low oil pressure. Therefore, the driving piston 150 id forced so as to move from the high speed position to the low speed position by pressure difference between pressure in the first oil pressure chamber 155*a* and pressure in the second oil pressure chamber 155*b*. At that time, if the base circle portions of the high speed cams 139*a*, 139*b* is in sliding contact with the slipper sections 143*a*, 143*b* of the first and second intake valve lifters 132*a*, 132*b*, the driving piston 150 moves toward the low speed position immediately, and if nose portions of the high speed cams 139*a*, 139*b* is in sliding contact with the slipper sections 143*a*, 143*b*, the driving piston 150 moves toward the low speed position immediately after the base circle portions of the high speed cams 139*a*, 139*b* come into sliding contact with the slipper sections 143*a*, 143*b*. Simultaneously, the intake cam piece 130 given driving force through the contact sections 157*a*1, 157*a*2 of the first arm 154*a* moves axially toward the low speed position where the low speed cams 138*a*, 138*b* come into sliding contact with the slipper sections 143*a*, 143*b*. This is the same in case of the exhaust valve moving apparatus $V_{EX}$, too.

The above-mentioned embodiment exhibits following effects.

When the low speed cams 138*a*, 138*b* of the intake (exhaust) cam piece 130 are in sliding contact with the first and second intake (exhaust) valve lifters 132*a*. 132*b*, the high speed cams 139*a*, 139*b* not coming into contact with the first and second intake (exhaust) valve lifters 132*a*, 132*b* rotate passing through the cut portions 142*a*2, 142*b*2 without interfering with the intake (exhaust) valve lifters 132*a*, 132*b*. As the result, since the first and second intake (exhaust) cam sections 137*a*, 137*b* can be positioned within a width of the intake (exhaust) valve lifters 132*a*, 132*b* in direction of the rotary axis L1, the length of the intake (exhaust) cam piece 130 can be made small and the valve moving apparatus V and the engine E can be made compact and light. Further, even in case that a cylinder 101 has the first and second intake valves 112*a*, 112*b*, the first exhaust valve 113*a* and the second exhaust valve, the intake cam piece 130 and the exhaust cam piece for these intake and exhaust valves can be disposed within the diameter of the bore 101*a* of the cylinder 101.

The manipulating sections 156*a*2, 156*b*2 and the contact sections 157*a*2, 157*b*2 of the arms 154*a*, 154*b* project radially outward more than the base circle portions of the low speed cams 138*a*, 138*b* and the high speed cams 139*a*, 139*b*, but they do not come into contact with the first and second intake (exhaust) valve lifters 132*a*, 132*b* because they are positioned in the cut portions 142*a*1, 142*b*2. Therefore, the cams 154*a*, 154*b* can be positioned within a width of the intake (exhaust) valve lifters 132*a*, 132*b* in direction of the rotary axis L1, so that width of the intake (exhaust) driving mechanism $M_{IN}$ ($M_{EX}$) in direction of the rotary axis L1 can be made small, and the valve moving apparatus V and the engine E can be made compact and light. Since the arms 154*a*, 154*b* can be contacted with the first and second side surfaces 140*a*, 140*b* without being restrained by positional relation between the arms 154*a*, 154*b* and the first and second intake (exhaust) valve lifters 132*a*, 132*b*, degree of freedom for arrangement of the arms 154*a*, 154*b* and degree of freedom for arrangement of the intake (exhaust) side driving mechanism $M_{IN}$ ($M_{EX}$) become large.

Since lubricating oil in the valve moving chamber 123 enters the first and second intake (exhaust) valve lifters 132*a*, 132*b* through the cut portions 142*a*1, 142*a*2, 142*b*1, 142*b*2, sliding parts such as the valve springs 120*a*, 120*b*, the retainers 118*a*, 118*b* and the first and second intake (exhaust)valves 112*a*, 112*b*, disposed in the valve lifters 132*a*, 132*b* are supplied with lubricating oil easily. Therefore, durability of the sliding parts is improved. Since a portion of the valve lifter 132*a* (132*b*) is cut off by forming the cut portions 142*a*1, 142*a*2 (142*b*1, 142*b*2), the valve lifters 132*a*, 132*b* are made light and accordingly the engine E also can be made light.

The low speed cams 138*a*, 138*b* and the high speed cams 139*a*, 139*b* provided on the same intake (exhaust) cam piece 130 are switched selectively and simultaneously by the same intake (exhaust) side driving mechanism $M_{IN}$, ($M_{EX}$) for operating the first intake (exhaust) valve 112*a* and the second intake (exhaust) valve 112*b*, therefore the intake (exhaust) cam piece 130 and the intake (exhaust) side driving mechanism $M_{IN}$ ($M_{EX}$) can be used in common for the both intake (exhaust) valves 112*a*, 112*b*, so that the valve moving apparatus V can be made compact.

Since the sliding contact surface 143*a*1, 143*b*1 of the slipper sections 143*a*, 143*b* of the first and second intake (exhaust) valve lifters 132*a*, 132*b* are formed in convex surfaces facing the first and second intake (exhaust) cam sections 137*a*, 137*b*, diameters of the intake (exhaust) valve lifters 132*a*, 132*b* can be made small and the cylinder head 193 can be miniaturized. Further, it is possible to give the slipper sections 143*a*, 143*b* necessary rigidity without increasing thickness and weight.

The retainers 118*a*, 118*b* are positioned in the cut portions 142*a*1, 142*a*2, 142*b*1, 142*b*2 near the nose portions of the high speed cams 139*a*, 139*b*, so that distance between ends of the valve stems 116*a*, 116*b* and the sliding contact surfaces 143*a*1, 143*b*1 of the slipper sections 143*a*, 143*b* can be made small as possible. Therefore, the valve moving apparatus V can be made compact.

Next, partial modifications of the above embodiment will be described.

Figure 12:
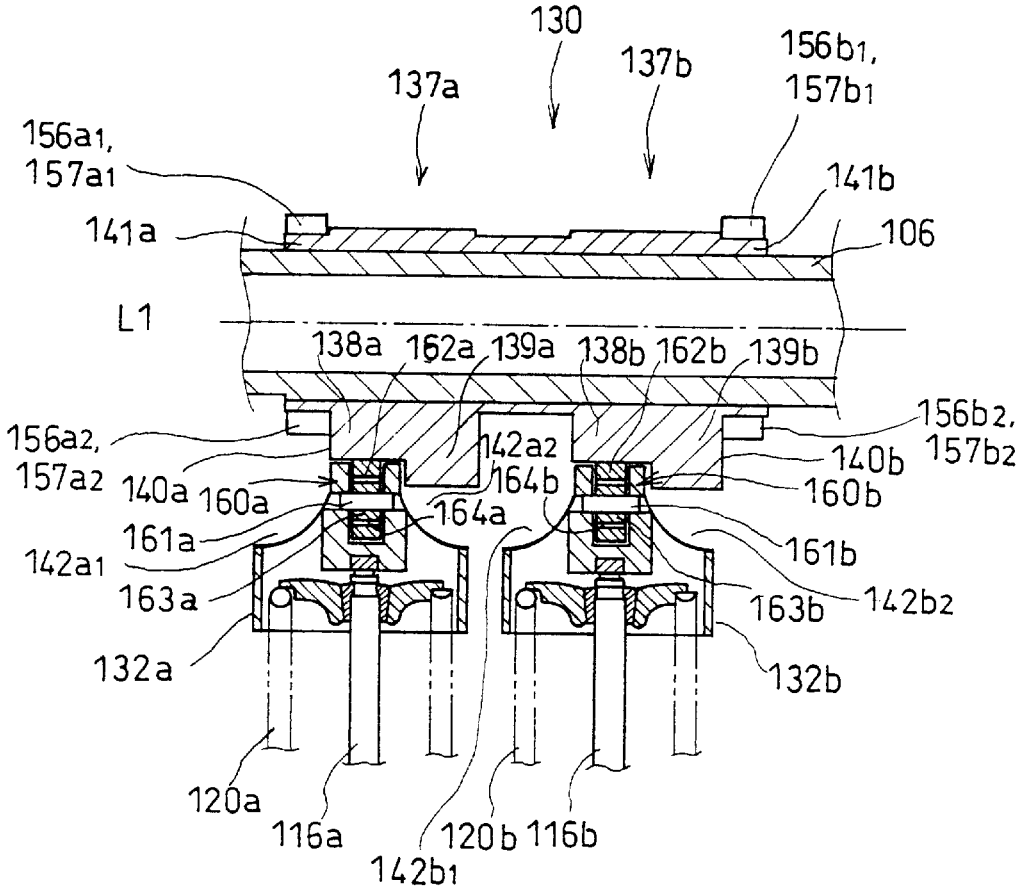
FIG. 12 is a sectional view of a direct type valve moving apparatus having a valve lifter with a roller according to other embodiment of the present invention.

In the above embodiment, the low speed cams and the high speed cams come into sliding contact with the outer surfaces of the slipper sections of the valve lifters. But, as shown in FIG. 12, first and second rollers 160*a*, 160*b* may be provided on top walls of the first and second intake valve lifters 132*a*, 132*b* so as to bring the low speed cams 138*a*, 138*b* and the high speed cams 139*a*, 139*b* into sliding contact with the rollers 160*a*, 160*b*. The first and second rollers 160*a*, 160,b are supported by first and second support shaft 161*a*, 161*b* fixed to the first and second intake valve lifters 132*a*, 132*b*, and comprise first and second outer rings 162*a*, 162*b* coming into sliding contact with the low speed cams 138*a*, 138*b* and the high speed cams 139*a*, 139*b*, first and second inner rings 163*a*, 163*b* fitted on the support shafts 161*a*, 161*b*, and many runners 164*a*, 164*b* disposed between the outer rings 162*a*, 162*b* and the inner rings 163*a*, 163*b*. Friction between the valve lifter and the cam can be reduced and loss of output can be reduced. The above is the same regarding the exhaust side valve moving apparatus $V_{EX}$.

Figure 13:
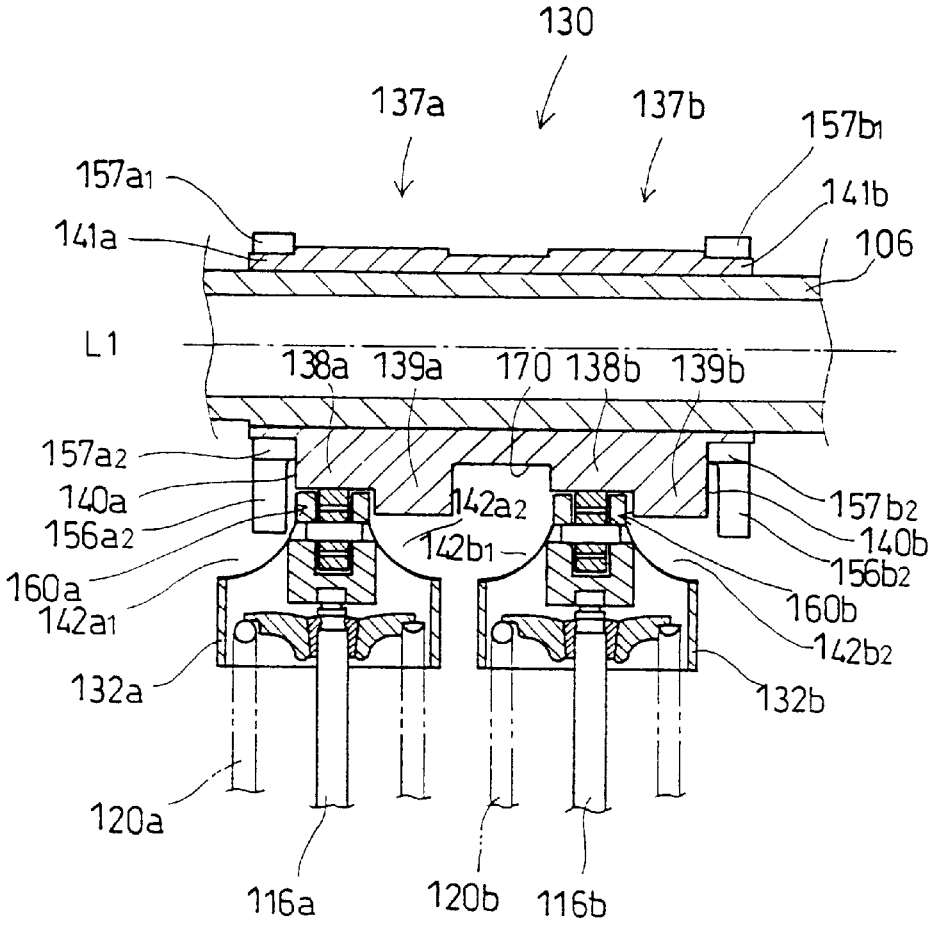
FIG. 13 is a sectional view showing further embodiment of the present invention.

As shown in FIG. 13, the intake cam piece 130 may be provided with one or more reinforcing ribs 170 connecting the first and second intake cams 137*a*, 137*b* with each other. The intake side driving mechanism $M_{IN}$ may be positioned near the cylinder 101 compared with its position shown in FIG. 6. The manipulating sections 156*a*2, 156*b*2 and the contact sections 157*a*2, 157*b*2 may be positioned near the first and second intake valve lifters 132*a*, 132*b* more than those in the above embodiment, and projected radially outward more than the nose portions of the low speed cams 138*a*, 138*b* and the high speed cams 139*a*, 139*b*.

Also in this intake side driving mechanism $M_{IN}$, as shown in FIG. 13, when the engine is in the low rotational speed region and the low speed cams 138*a*, 138*b* is in sliding contact with the rollers 160*a*, 160*b* of the valve lifters 132*a*, 132*b*, the manipulating section 156*a*2 and the contact section 157*a*2 near the first intake valve lifter 132*a* are positioned in the cut portion 142*a*, though they are projected more than the nose portions of the low speed cam 138*a* and the high speed cam 139*a*, and do not touch the first intake valve lifter 132*a*. Similarly, when the engine is in the high rotational speed region and the high speed cams 139*a*, 139*b* is in sliding contact with the rollers 160*a*, 160*b*, the manipulating section 156*b*2 and the contact section 157*b*2 near the second intake valve lifter 132*b* are positioned in the cut portion 142*b*2, though they are projected more than the nose portions of the low speed cam 138*b* and the high speed cam 139*b*, and do not touch the second intake valve lifter 132*b*.

Also in the exhaust side valve moving apparatus $V_{EX}$, an exhaust side driving mechanism similar to the above-mentioned intake side driving mechanism $M_{IN}$ may be used.

According to this embodiment, rigidity of the intake (exhaust) cam piece 130 (131) is improved by the reinforcing rib 170 and since the intake (exhaust) side driving mechanism $M_{IN}$ ($M_{EX}$) is disposed near the cylinder 101, height of the valve moving chamber 123 and the engine E can be made low.

In the above-mentioned embodiment, both first and second cam sections of the intake (exhaust) cam piece 130 (131) are constituted by the low speed cam and the high speed cam. But, any one cam section may be constituted by a pause cam for keeping one of the intake (exhaust) valves in closing state and the high speed cam, so that in the low rotational speed region, one of the intake (exhaust) valves are closed and another intake (exhaust) valve is operated by the low speed cam, and in the high rotational speed region, both intake (exhaust) valves are operated by the high speed cams. Similarly, in a multi-cylinder engine, both cam sections of any one cylinder may be constituted by pause cams for keeping the intake (exhaust) valve in closing state and the high speed cams, so that in the low rotational speed region, both intake (exhaust) valves are closed to let the corresponding cylinder pause, and in the high rotational speed region, both intake (exhaust) valves of all cylinders are operated by the high speed cams.

In the above-mentioned embodiment, both the intake (exhaust) valves of each cylinder 101 are operated by respective cam sections through respective valve lifters. But, both the intake (exhaust) valves may be operated by a single cam section through a single valve lifter.

In the above-mentioned embodiment, the driving piston of the intake (exhaust) side driving mechanism has two positions. However, the cam section of the intake (exhaust) cam piece may have three cams of different cam profiles so that the driving piston has three positions. In this case, a first state that the first oil pressure chamber 155*a* is of high oil pressure and the second oil pressure chamber 155*b* is of low oil pressure, a second state that the first oil pressure chamber is of high oil pressure and the second oil pressure chamber is of high oil pressure and a third state that the first oil pressure chamber is of low oil pressure and the second oil pressure chamber is of high oil pressure are available, for example. Cams not contacted with the valve lifter pass through the cut portion of the valve lifter, so that the valve moving apparatus can be made contact though the cam section is provided with three cams.

In the above-mentioned embodiment, the engine E has the intake camshaft 106 and the exhaust camshaft 107. However, the engine may be a SOHC type internal combustion engine having a single camshaft. Each cylinder may have one or more than three intake valves or one or more than three exhaust valves. The engine may be a single-cylinder internal combustion engine.

In the above-mentioned embodiment, the intake (exhaust) cam piece 130 (131) is moved by two arms 154*a*, 154*b*. However, the cam piece may be moved by a single arm coming into sliding contact with a cylindrical portion formed between the first and second cam sections.

Hitherto, a valve moving apparatus including cams having different cam profiles for changing valve operating characteristic, switch means for switching over the cams selectively and a trigger lever for setting switching action beginning time of the switch means has been disclosed in Japanese Laid-Open Patent Publication Sho 61-201804. The valve moving apparatus comprises a cam column (cam piece) having a middle, low speed cam and a high speed cam which are provided on a camshaft adjacent to each other and have different cam profiles, a rocker arm touching any one of the cams, switch mechanism (switch means) for moving the cam column in direction of rotary axis of the camshaft, and a trigger lever supported by a trigger lever support shaft parallel with the camshaft so as to rock. An end of the trigger lever is engaged with a trigger cam formed on the camshaft, and another end of the trigger lever is adapted to be fitted in a piston of the switch mechanism. When the trigger lever is rocked by the trigger cam to be released from engagement with the groove, switching action begins.

In the above-mentioned customary valve moving apparatus, since the trigger lever support shaft and the trigger lever is positioned above the camshaft, the valve moving apparatus is large-sized and accordingly a valve moving chamber for housing the valve moving apparatus and the internal combustion engine are also large-sized. Further, in the above customary valve moving apparatus, a rocker arm support shaft is disposed besides the trigger lever support shaft in the neighborhood of the camshaft, and it is necessary to ensure a space for rocking of the trigger lever and a rocker arm supported by the trigger lever support shaft and the rocker arm support shaft respectively. Therefore, the valve moving apparatus is apt to be more large-sized. In addition, in the above customary valve moving apparatus, the trigger cam is provided on the camshaft side by side with the cam column in order to operate the trigger lever, so that length of the valve moving apparatus in direction of the rotary axis of the camshaft becomes long, and operating mechanism of the apparatus becomes complicated.

The following embodiment is accomplished in view of the foregoing and aims at miniaturization of the valve moving apparatus provided with the trigger mechanism, simplification of the operating mechanism for operating the trigger mechanism and reduction of number of parts and assembling man-hour.

The embodiment will be described with reference to FIGS. 14 to 36.

Figure 14:
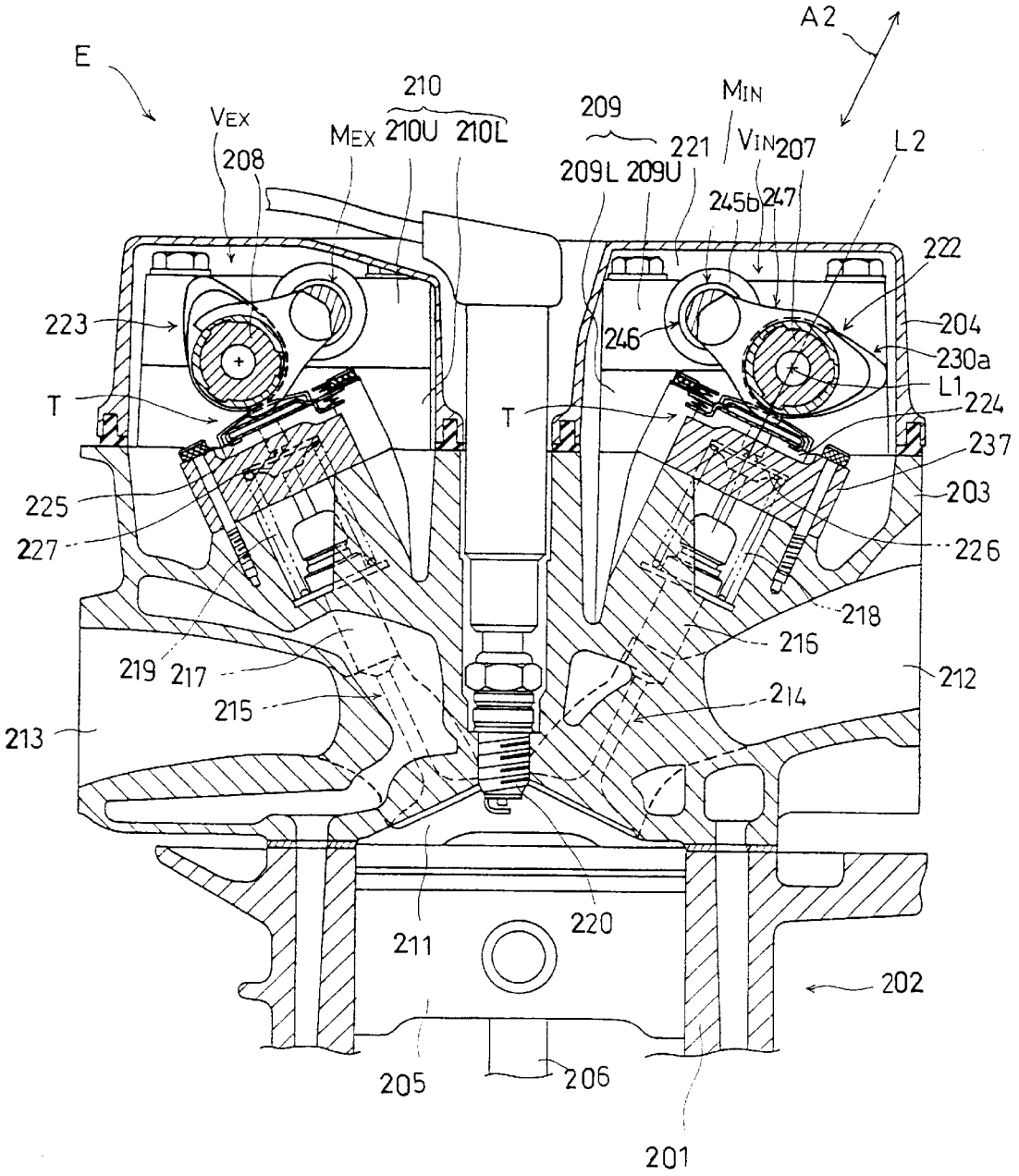
FIG. 14 is a partial longitudinal sectional view of an internal combustion engine having a direct type valve moving apparatus according to further another embodiment of the present invention.

An internal combustion engine E shown in FIGS. 14 to 28 is a DOHC type in-line 4-cylinder 4-stroke-cycle internal combustion engine with a direct type valve moving apparatus for a vehicle. As shown in FIG. 14, the engine E has a cylinder block with four cylinders 201 (only one cylinder is shown in FIG. 14), a cylinder head 203 attached on an upper surface of the cylinder head, and a head cover 204 attached on an upper surface of the cylinder head 203.

In a bore of each cylinder 201 is fitted a piston 205 so as to reciprocate. The piston turns a crankshaft (not shown) through a connecting rod 206. An intake camshaft 207 and an exhaust camshaft 208 arranged in parallel with the crankshaft are rotated synchronizing with the crankshaft at a rotational speed equal to that of the crankshaft. The intake camshaft 207 and the exhaust camshaft 208 are supported by intake cam holders 209 and exhaust cam holders 210 which are fixed to the cylinder head 203 by bolts. The cam holders 209, 210 are disposed at both ends of the row of cylinders and between neighboring cylinders. Each of the cam holders 209, 210 consists of an upper cam holder 209U (209U) and a lower cam holder 209L (210L).

Each cylinder 201 has a combustion chamber 211 formed between the piston 205 and the cylinder head 203, and a pair of intake ports 212 and a pair of exhaust ports 213 are opened to the combustion chamber 211. Intake valves 214 for opening and closing the intake ports and exhaust valves 215 for opening and closing the exhaust ports are provided in respective valve guides 216, 217 so as to slide. The intake valves 214 and the exhaust valves 215 are forced in closing direction by valve springs 218, 219 having upper ends supported by spring bearings 226, 227. The cylinder head 203 is provided with ignition plugs 220 facing respective combustion chambers 211.

In a valve moving chamber 221 formed between the cylinder head 203 and the head cover 204 is housed a direct type valve moving apparatus for opening and closing the intake valve 214 and the exhaust valve 215. The valve moving apparatus consists of an intake side valve moving apparatus $V_{IN}$ and an exhaust side valve moving apparatus $V_{EX}$. The intake side valve moving apparatus $V_{IN}$ comprises a camshaft 207, a cam piece 222, a lifter 224 and a hydraulic intake side driving mechanism $M_{IN}$ (switch means) for moving the cam piece 222 on the camshaft 207 in direction of rotary axis L1 of the camshaft or in direction A1 shown in FIG. 15. The exhaust side valve moving apparatus $V_{EX}$ comprises a cam shaft 208, a cam piece 223, a lifter 225 and a hydraulic exhaust side driving mechanism $M_{EX}$ (switch means) for moving the cam piece 223 on the camshaft 208 in the direction A1. Since the intake side valve moving apparatus $V_{IN}$ and the exhaust side valve moving apparatus $V_{EX}$, have basically the same construction, hereinafter mainly the intake side valve moving apparatus $V_{IN}$ will be described.

Figure 15:
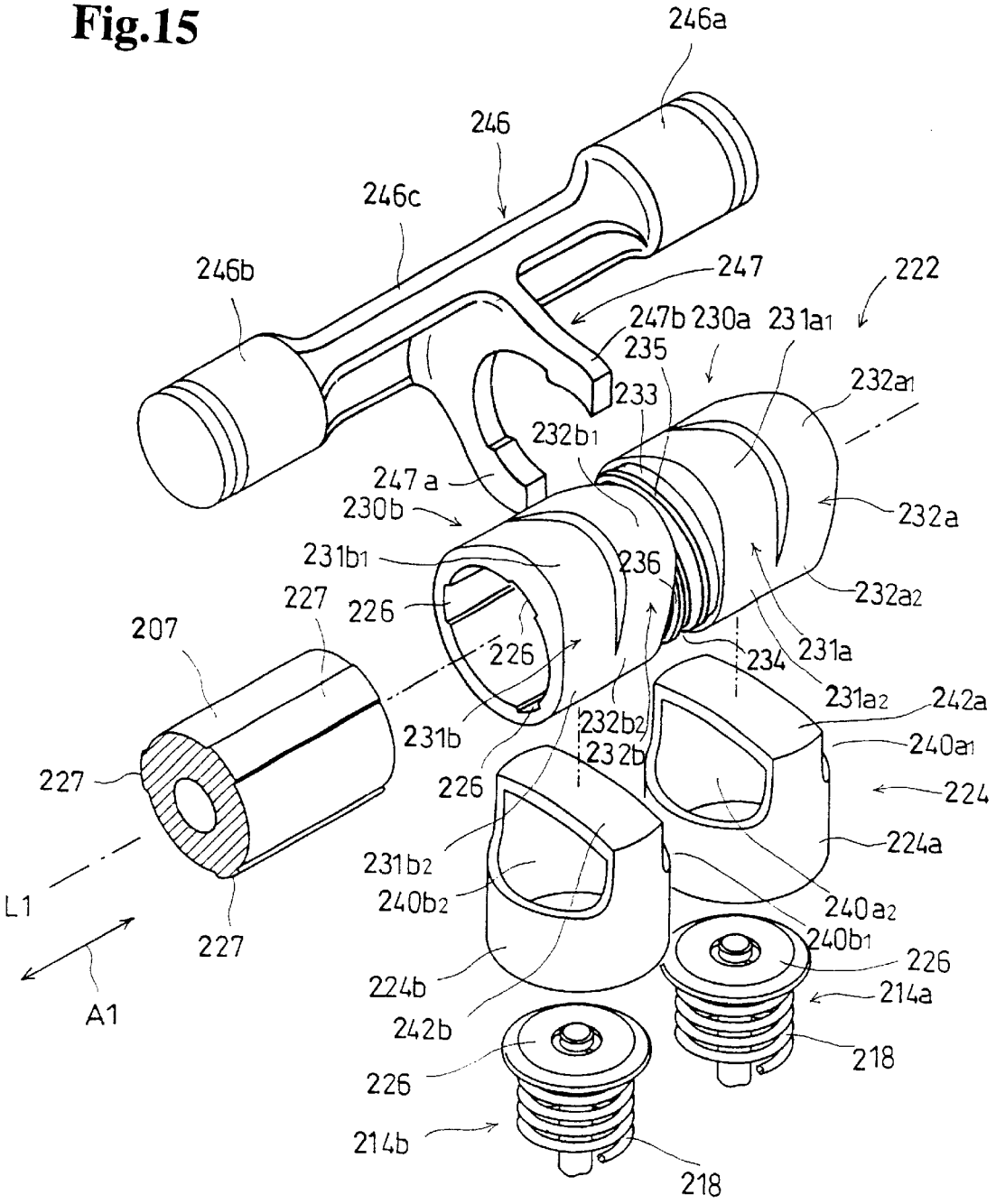
FIG. 15 is a partial exploded view of a intake side valve moving apparatus in the internal combustion engine of FIG. 14.

Referring to FIG. 15 too, the cam piece 222 of each cylinder 201 having an axial hole which the camshaft 207 passes through is spline-engaged with the camshaft 207 so as to slide axially and rotate together with the camshaft 207. Namely, on an inner peripheral surface of the cam piece 222, three axial grooves 226 extending in parallel with each other over the total length of the cam piece 222 are provided at regular intervals, and on an outer peripheral surface of the camshaft 207 are provided three parallel projecting lines 227 corresponding to the grooves 226.

On the cam piece 222 are disposed a first cam section 230*a* and a second cam section 230*b* axially in series and at a distance. On each of the first and second cam sections 230*a*, 230*b*, a low speed cam 231*a* (231*b*) and a high speed cam 232*a* (232*b*) having different cam-profiles are provided integrally neighboring in axial direction A1. Namely, the low speed cam 231*a* (231*b*) has a cam-profile comprising a nose portion with a relatively small projecting amount in radial direction and a predetermined operation angle in circumferential direction, and a base circle portion. On the one hand, the high speed cam 232*a* (232*b*) has a cam-profile comprising a nose portion with a projecting amount larger than that of the low speed cam and an operation angle larger than that of the low speed cam, and a base circle portion of the same diameter as the base circle portion of the low speed cam.

On a cylindrical section of the cam piece 222 formed between the first and second cam sections 230*a*, 230*b*, flange-like first and second engaging sections 235, 236 are provided and an annular guide groove 234 is formed between the first and second engaging sections 235, 236. Outer diameters of the first and second engaging sections 235, 236 are set so that when the base circle portions 231*a*2, 231*b*2, 232*a*2, 232*b*2 of the low speed cams 231*a*, 231*b* and the high speed cams 232*a*, 232*b* are in sliding contact with the lifters 224, the first and second engaging sections 235, 236 do not touch the lifters 224.

Figure 19:
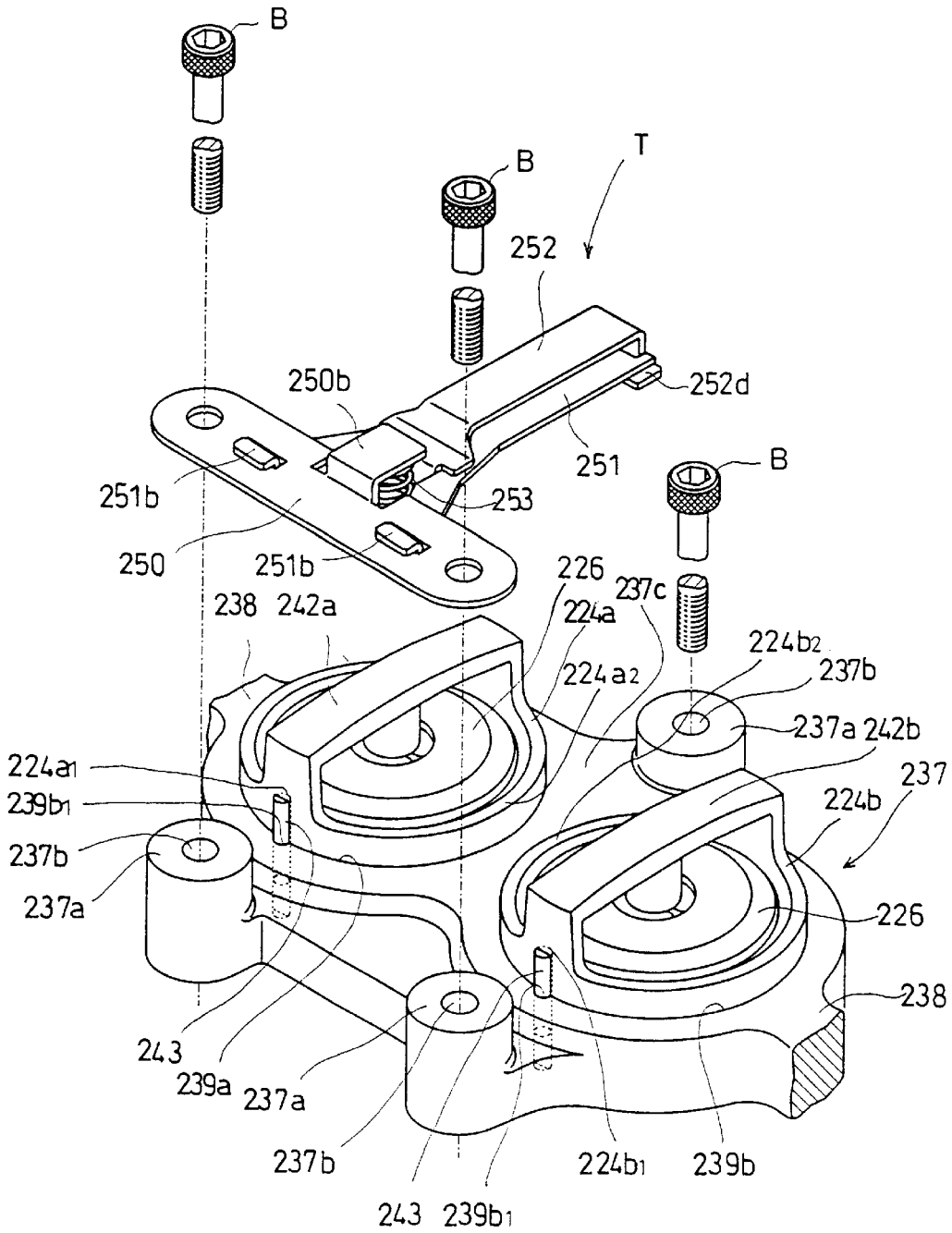
FIG. 19 is a partial perspective view showing a state of the trigger mechanism of FIG. 18 before it is attached to a lifter holder of the direct type valve moving apparatus of FIG. 14.

Under the cam piece 222, a first lifter 224*a* is disposed between the first cam section 230*a* and the first intake valve 214*a*, and a second lifter 224*b* is disposed between the second cam section 230*b* and the second intake valve 214*b*. The first and second lifters 224*a*, 224*b* are supported by a holder section 237. Each cylinder has four holder sections 237 and these holder sections are connected through connecting sections 238 (FIG. 19) to form a lift holder to be fixed to the cylinder head 203. As shown in FIG. 19, each holder section 237 is fixed to the cylinder head 203 by bolts B penetrating through holes 237*b* formed in three boss sections 237*a*. The first and second lifters 224*a*, 224*b* are fitted in first and second guide holes 239*a*, 239*b* formed in the holder section 237 so as to reciprocate in direction of axis of the first and second lifters 224*a*, 224*b*, that is, so as to slide up and down.

Each lifter 224*a* (224*b*) is formed in a cylinder having an opened lower end and an upper wall and has cut portions 240*a*1, 240*a*2 (240*b*1, 240*b*2) at an upper part and on both sides in the direction A1. The upper wall is partly cut off by the cut portion, and remaining portion of the upper wall forms a bridge-like slipper section 242*a* (242*b*) coming into sliding contact with the low speed cam 231*a* (231*b*) and the high speed cam 232*a* (232*b*). The upper surface of the slipper section 242*a* (242*b*) is formed in a cylindrical surface raised toward the first (second) cam section 30*a* (230*b*) and having an axis parallel with the direction A1.

Figure 20:
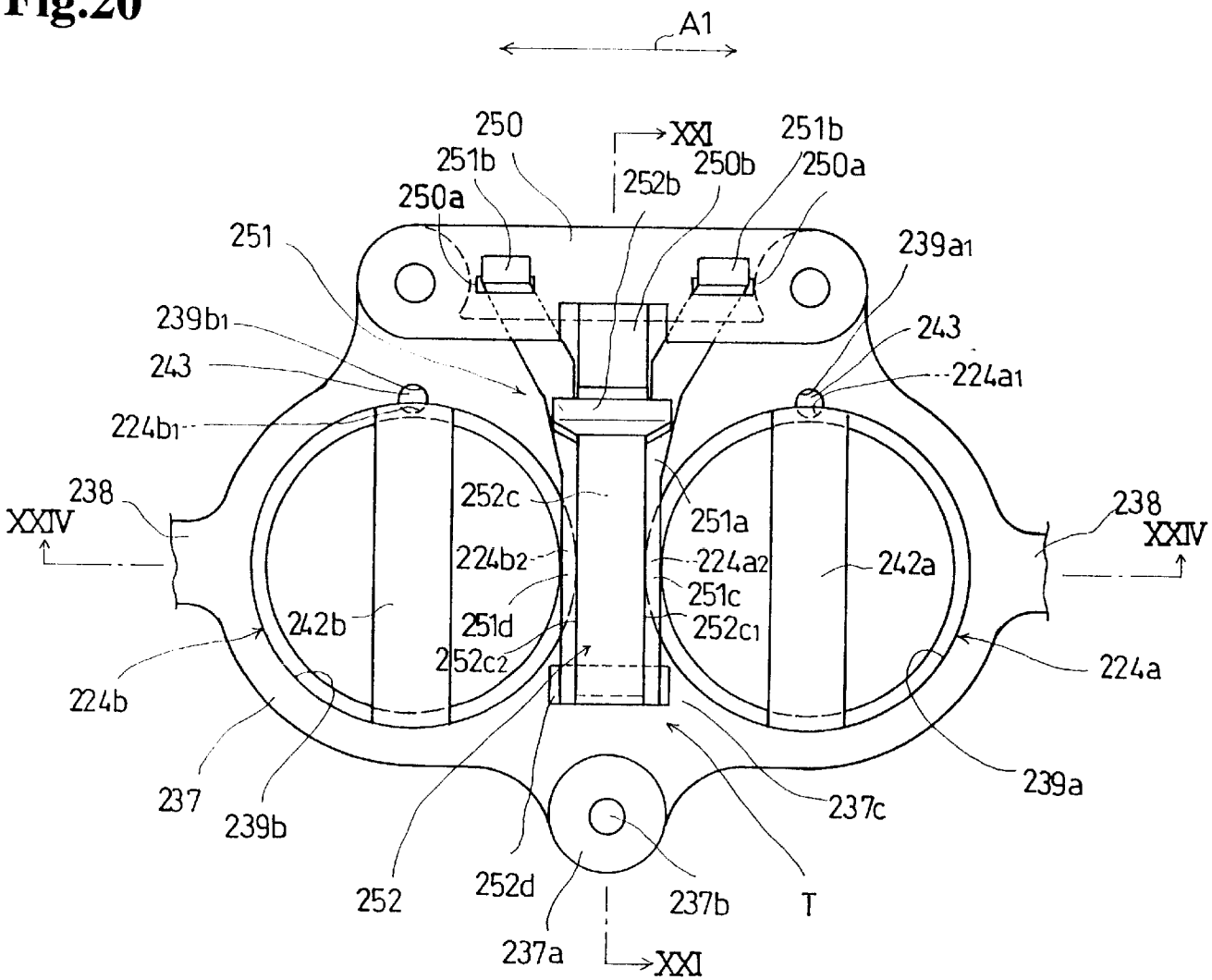
FIG. 20 is a partial plan view of the lifter holder attached with the trigger mechanism of FIG. 18.
Figure 21:
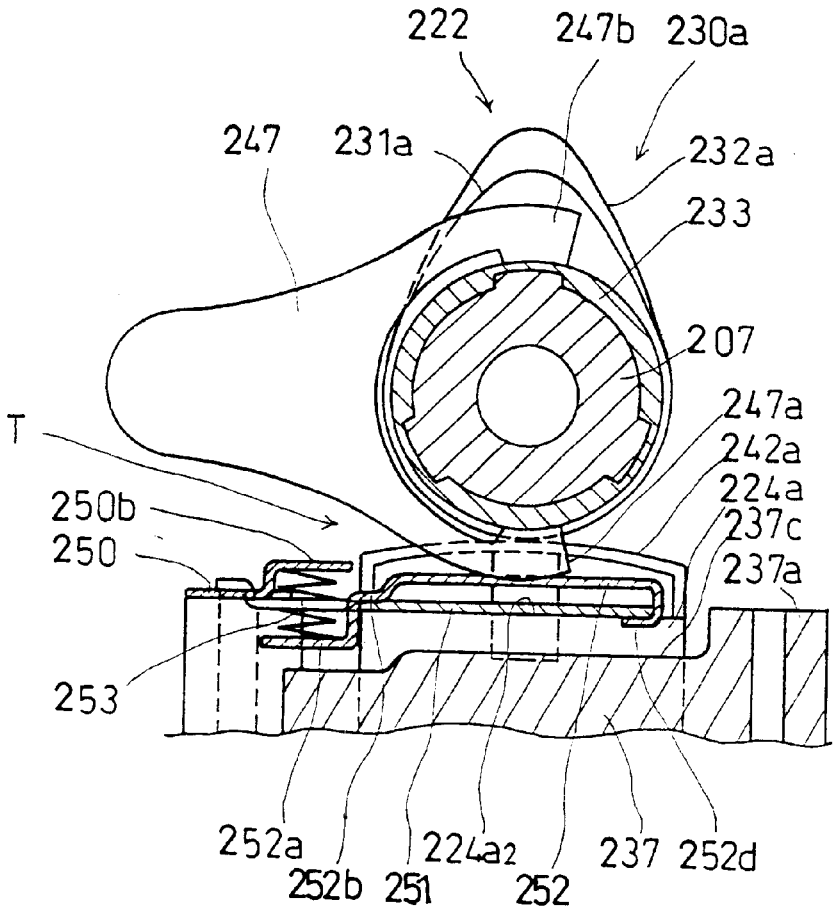
FIG. 21 is a sectional view taken along the line XXI—XXI of FIG. 20.

Referring to FIG. 20 too, on an outer surface of a side wall of the first (second) lifter 224*a* (224*b*) is formed an insertion groove 224*a*1 (224*b*1) having a semi-circular cross-section. The insertion groove extends in parallel with the axis of the lifter and has end walls at upper and lower ends. On the one side, on a peripheral surface of the first (second) guide hole 239*a* (239*b*) is formed a retaining groove 239*a*1 (239*b*1) facing the insertion groove 224*a*1 (224*b*1) and having a semi-circular cross-section similarly to the insertion groove 224*a*1 (224*b*1). The retaining groove has an opened upper end and a lower end provided with an end wall. A pin 243 which is somewhat shorter than the insertion groove 224*a*1 (224*b*1) is engaged with both the insertion groove 224*a*1 (224*b*1) and the retaining groove 239*a*1 (239*b*1) for preventing rotation of the lifter 224*a* (224*b*) relative to the holder section 237. But the lifter 224*a* (224*b*) is allowed to move up and down relatively to the holder section 237.

When the cam piece 222 is moved axially by the intake side driving mechanism $M_{IN}$, the low speed cam 231*a* (231*b*) or the high speed cam 232*a* (232*b*) of the first (second) cam section 230*a* (230*b*) is brought into sliding contact with the slipper section 242*a* (242*b*), so that the first (second) intake valve 214*a* (214*b*) is operated through the first (second) lifter 224*a* (224*b*) to open and close the intake port in accordance with the cam-profile of the corresponding cam.

Figure 16:
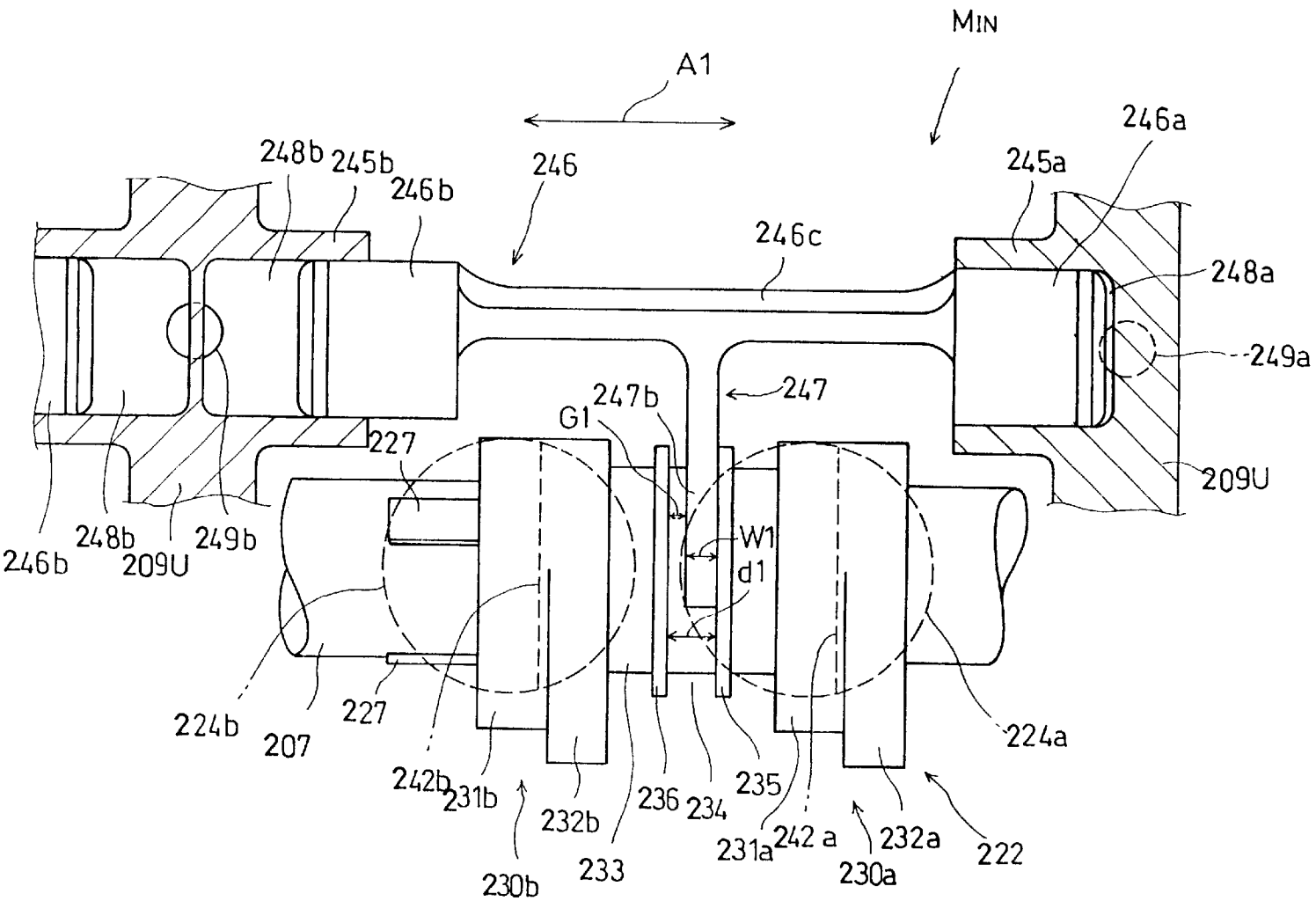
FIG. 16 is a view for explaining a positional relation between a intake side driving mechanism and a cam piece in low rotational speed region.
Figure 18:
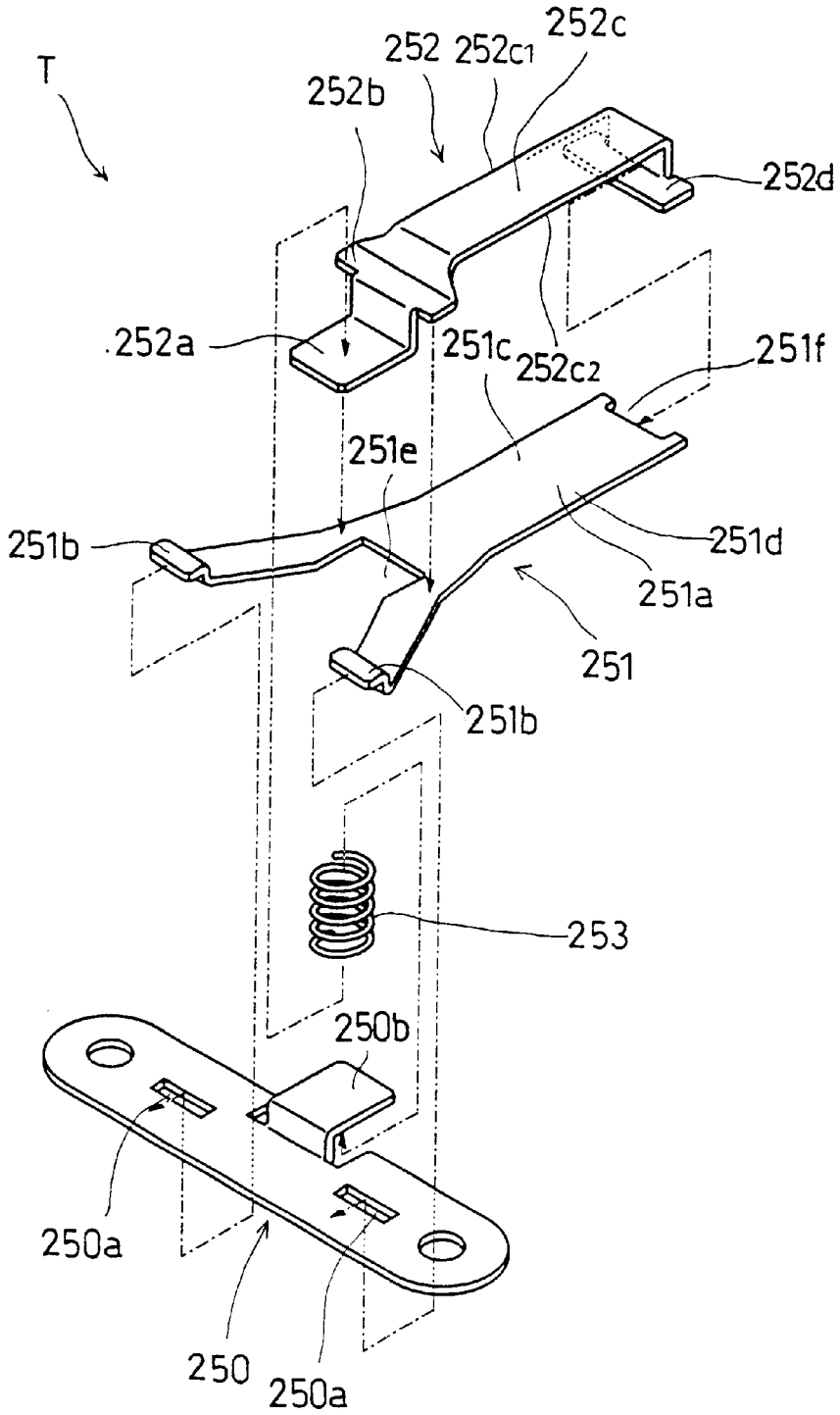
FIG. 18 is an exploded perspective view of a trigger mechanism of the direct type valve moving apparatus of FIG. 14.

As shown in FIGS. 16, 18, the intake side driving mechanism $M_{IN}$ includes a first cylindrical section 245*a* and a second cylindrical section 245*b* formed in respective boss section each projecting from adjacent upper cam holder 209U so as to face each other, and a double-action type driving piston 246. The double-action type driving piston 246 includes first and second piston sections 245*a* (246*b*) fitted in the respective cylindrical sections 245*a*, 245*b* so as to slide, a connecting section 246*c* connecting the piston sections 246*a*, 246*b* with each other, and an arm (manipulating member) 247 extending from the connecting section 246*c* toward the guide groove 234 of the cam piece 222. Between the first piston section 246*a* and the first cylindrical section 245*a* is formed a first oil pressure chamber 248*a*, and between the second piston section 246*b* and the second cylindrical section 245*b* is formed a second oil pressure chamber 248*b*.

The driving piston is subjected to a drive force in accordance with pressure of working oil supplied to the first and second oil pressure chambers 248*a*, 248*b* to reciprocate axially. The drive force is slightly larger than friction force generated between the cams and slipper sections by spring force of the valve spring 218 when the base circle portions of the cams are in sliding contact with the slipper sections, that is, when the first and second intake valves 214*a*, 214*b* are closed, and the drive force is smaller than friction force generated between the cams and the slippers by spring force of the valve spring 218 when the nose portions of the cams are in sliding contact with the slipper sections, that is, the first and second intake valve are opened. Therefore, switchover between the low speed cam and the high speed cam by the intake side driving mechanism $M_{IN}$ is carried out during the first and second intake valves are closed.

The arm 247 disposed between the first and second cam sections 230*a*, 230*b* is bifurcated so as to surround the cylindrical section 233 and has a first contact section 247*a* and a second contact section 247*b*. The contact sections 247*a*, 247*b* come into the guide groove 234 and touch the first and second engaging sections 235, 236 of the cam piece 232 in the axial direction A1. A distance between the first and second engaging sections 235, 236 is larger than a width W1 of the contact sections 247*a*, 247*b* in the axial direction A1, and when contact sections 247*a*, 247*b* touch any one of the engaging sections 235, 236, a predetermine gap Glis formed between the contact sections 247*a*, 247*b* and another engaging section. At least the first contact section 247*a* contacted with a trigger piece 252 to be mentioned later is projected radially from the first and second engaging sections 235, 236.

Next, a hydraulic system of the intake side driving mechanism $M_{IN}$ will be described. The first oil pressure chamber 248*a* is connected to a working oil passage (not shown) through an opening 249*a*. The working oil passage is formed in the cylinder block 202, the cylinder head 203 and the cam holder 209 to communicate with an oil pump driven by the crankshaft. Working oil pressure in the first oil pressure chamber 248*a* is controlled into high oil pressure or low oil pressure by a first control valve (not shown) provided in the working oil passage. Similarly, the second oil pressure chamber 248*b* is connected to a second oil passage (not shown) through an opening 249*b*, and working oil pressure in the second oil pressure chamber 248*b* is controlled into high oil pressure or low oil pressure by the second control valve Actions of the first and second control valves are controlled by a control apparatus (not shown) in which a signal detected by a rotational speed sensor as a engine operating condition sensor is inputted. When engine E is in a low rotational speed region that the engine rotates at a rotational speed less than a predetermined value, the first control valve controls working oil pressure so that pressure in the first oil pressure chamber 248*a* becomes low oil pressure, and the second control valve controls working pressure so that pressure in the second oil pressure chamber 248*b* becomes high oil pressure. At that time, the driving piston occupies a low speed position shown in FIG. 16. When rotational speed of the engine E rises beyond the predetermined value and the engine comes in a high rotational speed region, the first control valve controls working oil pressure so that the first oil pressure chamber 248*a* becomes high oil pressure, and the second control valve controls working oil pressure so that the second oil pressure chamber 248*b* becomes low oil pressure. At that time, the driving piston occupies a high speed position shown in FIG. 17.

Figure 17:
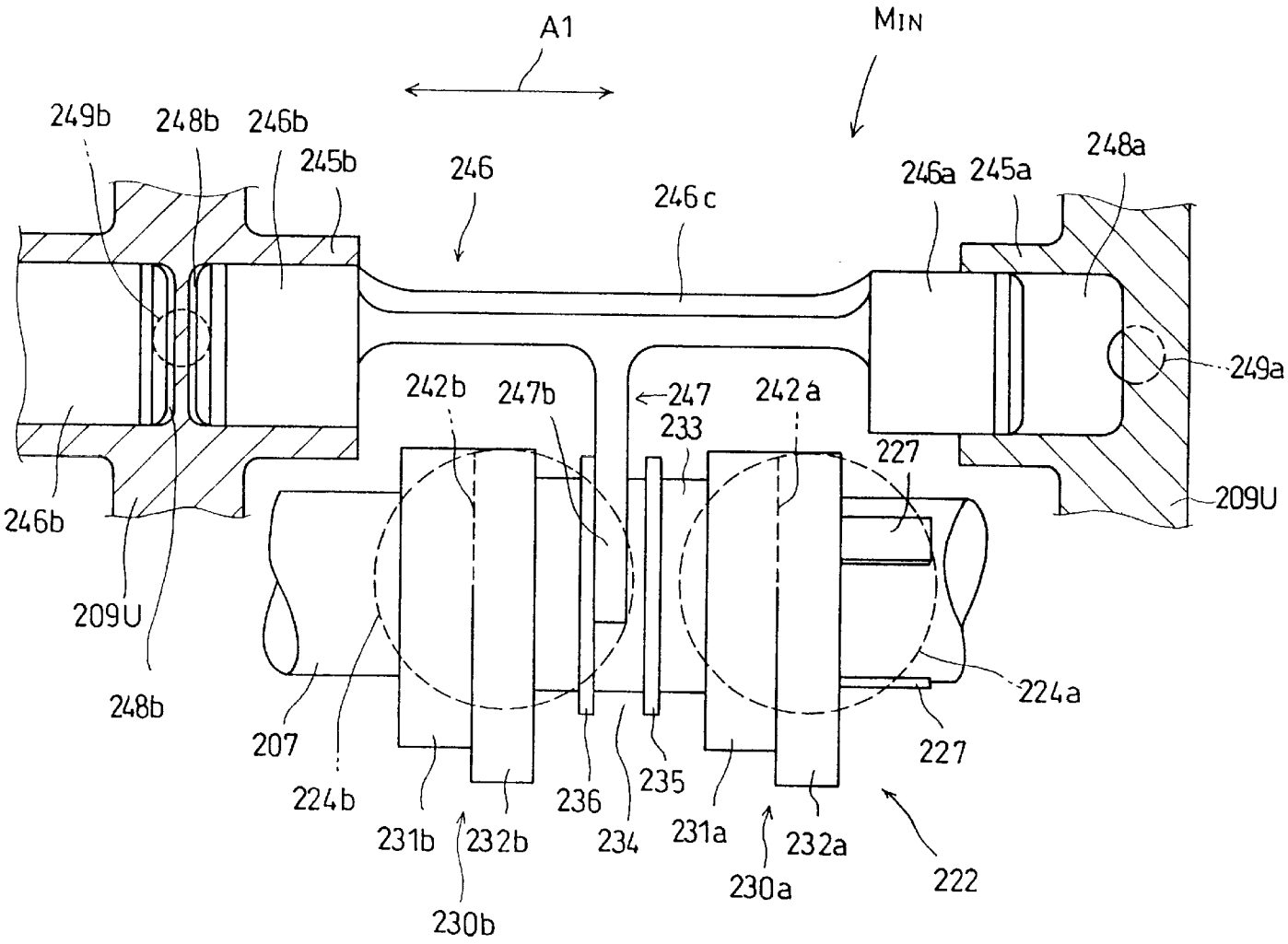
FIG. 17 is a view for explaining a positional relation between the intake side driving mechanism and the cam piece in high rotational speed region.

As shown in FIGS. 16 and 17, on both sides of a cam holder 209 positioned between a right side cylinder and a left side cylinder are disposed the second oil pressure chamber 248*b* belonging to the right side cylinder and the second oil pressure chamber 249*b* belonging to the left side cylinder symmetrically, and a working oil passage is used in common for both the second oil pressure chambers. This is also true regarding other cam holders positioned between two cylinders.

A hydraulic system of the exhaust side driving mechanism $M_{EX}$ is also supplied with controlled working oil similarly to above-mentioned intake side driving mechanism $M_{IN}$.

Next, referring to FIGS. 18 to 20, a trigger mechanism T for setting beginning time of switching action between the low speed cam 231*a* (231*b*) and the high speed cam 232*a* (232*b*) will be described. The switching action is carried out by the driving piston 246 moving the cam piece 222 through the arm 247. As shown in FIGS. 18 and 19, the trigger mechanism T includes a trigger bracket 250 fixed to the holder section 237 by two bolts B which fix a side of the holder section 237 near the center axis of the cylinder 201 to the cylinder head 203, a trigger base 251 supported on the trigger bracket 250 so as to rock, a trigger piece 252 supported on the trigger base 251 so as to rock, and a trigger spring 253 compressed between the trigger bracket 250 and the trigger piece 252. All of the trigger bracket 250, the trigger base 251 and the trigger piece 252 are formed from flat plates.

The trigger bracket 250 has a pair of engaging holes 250*a* longitudinally separated from each other, and a spring bearing section 250*b* disposed between the engaging holes 250*a* and projected upward for supporting an end of the trigger spring 253.

The trigger base 251 is formed in T-shape as a whole having a rectangular support section 251*a* and a pair of base end sections 251*b* bifurcated from the support section 251*a*. The base end section 251*b* are inserted in the engaging holes 250*a* from an under side of the trigger bracket 250 and contacted with an upper surface of the trigger bracket 250, so that the trigger base 251 is supported on the trigger bracket 250 so as to rock about the base end section 251*b*. In this state, the support section 251*a* is disposed between the first lifter 242*a* and the second lifter 242*b* as shown in FIG. 20. The support section 251*a* has a first contact section 251*c* and a second contact section 251*b* (FIG. 18) which are contacted with a first side wall upper surface portion 224*a*2 of the first lifter 224*a* and a second side wall upper surface portion 224*b*2 of the second lifter 224*b* (FIG. 19) respectively. As shown in FIG. 18, at an end of the support section 251*a* near the base end section 251*b* is formed an insertion groove 251*e* which a spring bearing section 252*a* of the trigger piece 252 passes through. At both sides of the insertion groove 251*e*, a contact section 252*b* of the trigger piece 252 is contacted with upper surfaces of the trigger base 251. At another end of the support section 251*a* is formed an engaging groove 251*f* in which a tip end portion of the trigger piece 252 is fitted.

As shown in FIGS. 18 to 20, the trigger piece 252 has a spring bearing section 252*a* positioned under the spring bearing section 250*b* of the trigger bracket 250 facing it and supporting a lower end of the trigger spring 253, a contact section 252*b*, first and second side surfaces 252*c*1, 252*c*2 touching the first contact section 247*a* of the arm 247, a regulating section 252*c*, and a stopper section 252*d*. The width of the regulating section 252*c* is determined based on the maximum movement of the driving section 246, the distance d1 between the first and second engaging sections 235, 236 and the width W1 of the first contact section 247*a* so that gaps G1, G3 to be described later are formed.

In state that the trigger mechanism T is attached to the holder section 237, the trigger mechanism T is positioned in a space formed between the camshaft 207 and the lifters 224*a*, 224*b* as shown in FIG. 14. When the base circle portions of the cams come into sliding contact with the slipper sections 242*a*, 242*b* to close the first and second intake valves 214*a*, 214*b*, the trigger base 251 is forced around the base end sections 251*b* by the trigger spring 253 so that the first and second contact sections 251*c*, 251*d* touch the first and second side wall upper surfaces 224*a*2, 224*b*2 of the lifters. The trigger piece 252 is forced around the contact section 252*b* touching the support section 251*a* of the trigger base 251 so that the stopper section 252*d* touches an under surface of the trigger base 251. In this state, the regulating section 252*c* of the trigger piece 252 is projected toward the camshaft 207 and the first and second side surfaces 252*c*1 , 252*c*2 are positioned in a moving course of the first contact section 247*a* of the arm 247.

When the first and second lifters 224*a*, 224*b* are pushed by the nose portions of the cams to lift (open) the first and second intake valves, the trigger base 251 having the first and second contact sections 251*c*, 251*d* contacted with the first and second side wall upper surfaces 224*a*2, 224*b*2 rocks about the base end sections 251*b* downward following the lifters 224*a*, 224*b*, and when the lifters has moved by a predetermined lift amount, the stopper section 252*d* touches an upper surface 237*c* of the holder section 237 to prevent further downward movement of the trigger base 251 and the trigger piece 252. Therefore, at a lift amount of the lifter exceeding the above-mentioned predetermined lift amount, the first and second contact sections 251*c*, 251*d* are not contacted with the first and second side wall upper surfaces 224*a*2, 224*b*2. The predetermined lift amount is suitably set so that at the predetermined lift amount, the regulating section 252*c* of the trigger piece 252 is positioned under the first contact section 247*a* of the arm 247. Therefore, the trigger base 251 functions as a control member for controlling movement of the trigger piece 252 in accordance with movement of the first and second lifters 224*a*, 224*b*.

Next, action of the above-mentioned embodiment will be described with reference to FIGS. 16, 17 and 21 to 28. Hereinafter action of the exhaust side driving mechanism $M_{IN}$ is described mainly, but also action of the exhaust side driving mechanism $M_{EX}$ is the same as the intake side driving mechanism $M_{IN}$.

When the engine E is in the low speed rotational speed region, the first control valve controls oil pressure in the first oil pressure chamber 248*a* so as to be low oil pressure, and the second control valve controls oil pressure in the second oil pressure chamber 248*b* so as to be high oil pressure. Therefore, the driving piston 246 occupies the low speed position shown in FIG. 16. At that time, the low speed cam 231*a* (231*b*) of the first (second) cam section 230*a* (230*b*) of the cam piece 222 is in sliding contact with the slipper section 242*a* (242*b*) of the first (second) lifter 224*a* (224*b*), and the first (second) intake valve 214*a* (214*b*) is opened and closed with a opening-closing time and a lift amount determined by cam-profile of the low speed cam 231*a* (231*b*). Since also the exhaust side driving mechanism $M_{EX}$ occupies the low speed position similarly to the intake side driving mechanism $M_{IN}$, the intake valves 214 and the exhaust valves 215 of each cylinder 201 is opened and closed with a small lift amount, a opening-closing time and a short valve opening period adapted to valve operating characteristic at the low rotational speed region.

Figure 24:
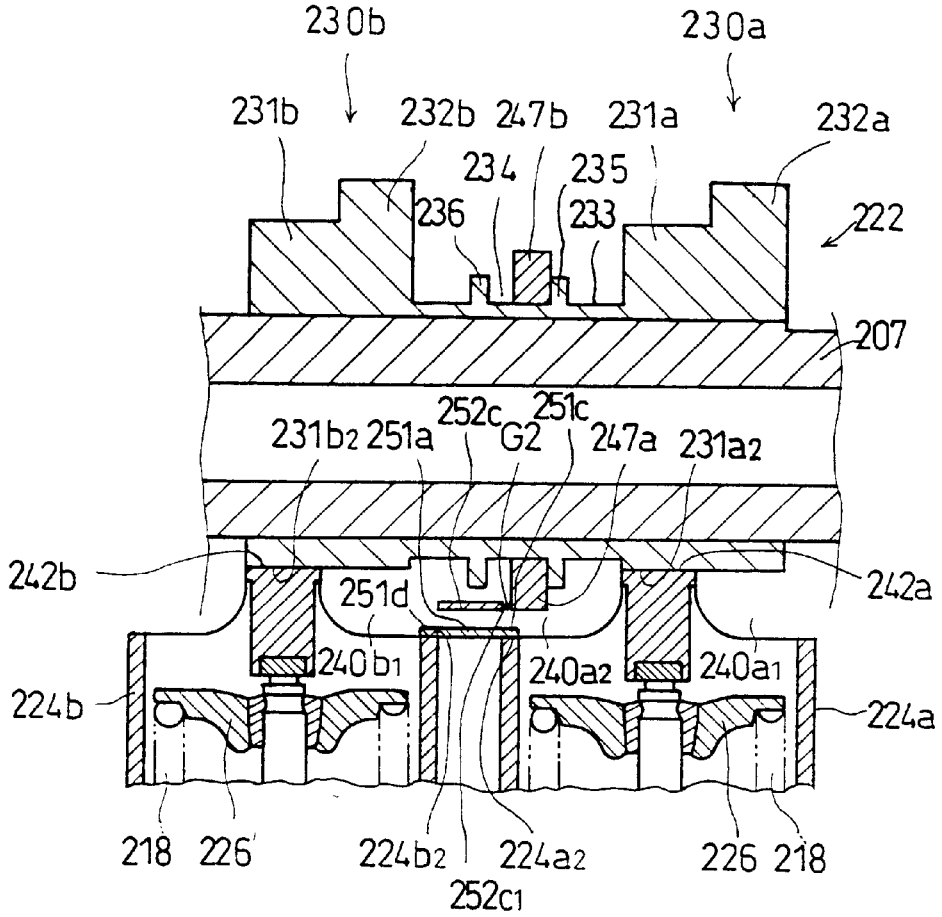
FIG. 24 is a partial sectional view taken along the line XXIV—XXIV of FIG. 20 for explaining action of the trigger mechanism.

At that time, as shown in FIG. 24, the first contact section 247*a* of the arm 247, the first and second engaging sections 235, 236 and the high speed cams 232*a*, 232*b*, which are radially projected more than the base circle portions 232*a*2, 231*b*2 of the low speed cams 231*a*, 231*b*, are not contacted with the first and second lifters 224*a*, 224*b* because of the cut portions 240*a*1, 240*a*2, 240*b*1. The first and second contact sections 247*a*, 247*b* touch the first engaging section 235 and a gap G1 of a predetermined width is formed between the first and second contact sections 247*a*, 247*b* and the second engaging section 236 (FIG. 16). Further, between the first side surface 252*c*1 of the regulating section 252*c* and the first contact section 247*a* is formed a gap G2 of a predetermined width smaller than that of the gap G1. The first and second contact sections 251*c*, 251*d* of the trigger base 251 touch the first and second side wall upper surfaces 224*a*2, 224*b*2. The second engaging section 236 is positioned opposite to the trigger piece 252 which is not contacted with the cam piece 222.

When the rotational speed of the engine E exceeds the predetermined rotational speed and the engine shifts to the high rotational speed region, the first control valve controls oil pressure in the first oil pressure chamber 248*a* so as to be high oil pressure, and the second control valve controls oil pressure in the second oil pressure chamber 248*b* so as to be low oil pressure. Therefore, the driving piston 246 is subjected to a drive force for moving the driving piston from the low speed position to the high speed position shown in FIG. 17, and the drive force acts on the arm 247.

Figure 25:
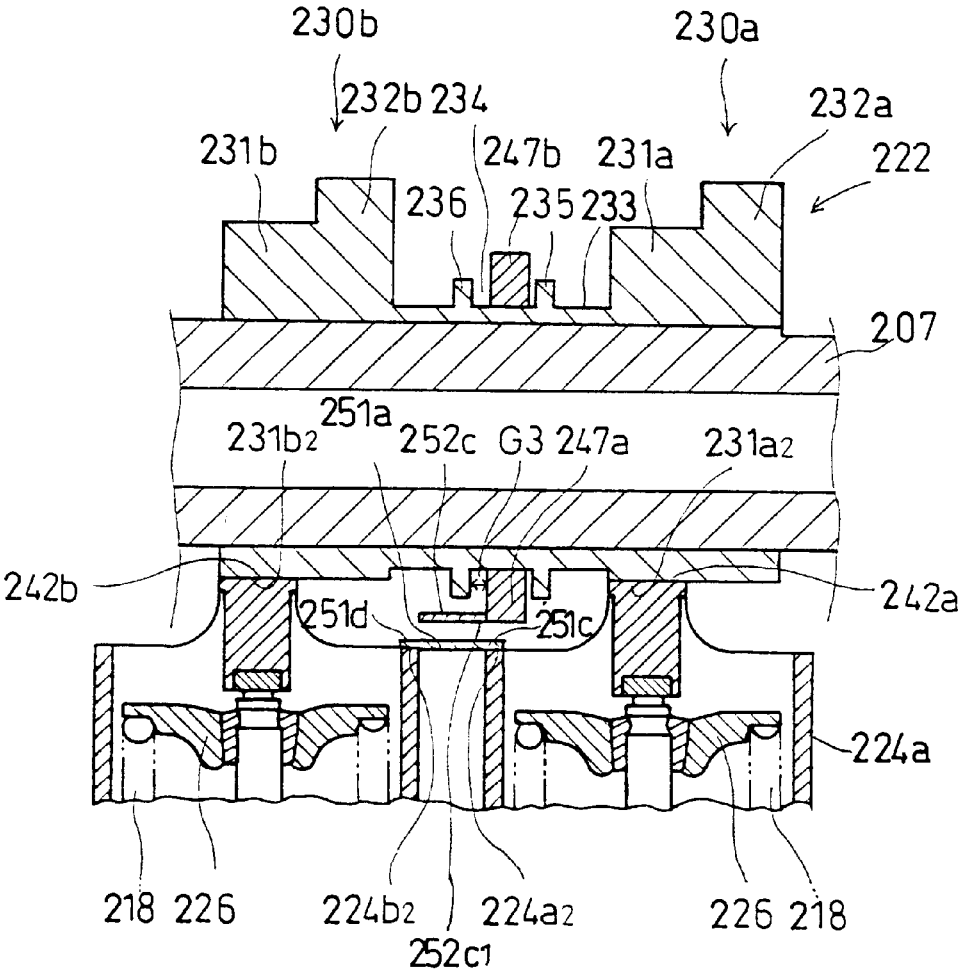
FIG. 25 is a view similar to FIG. 24.

At that time, if the first and second intake valves are closed, as shown in FIG. 25, movement of the arm 247 toward the second engaging section 236 is stopped by the regulating section 252*c* and the arm 247 occupies a waiting position. At this time, between the first contact section 247*a* and the second engaging section 236 is formed a gap G3 smaller than the gap G1 by the gap G2.

Figure 22:
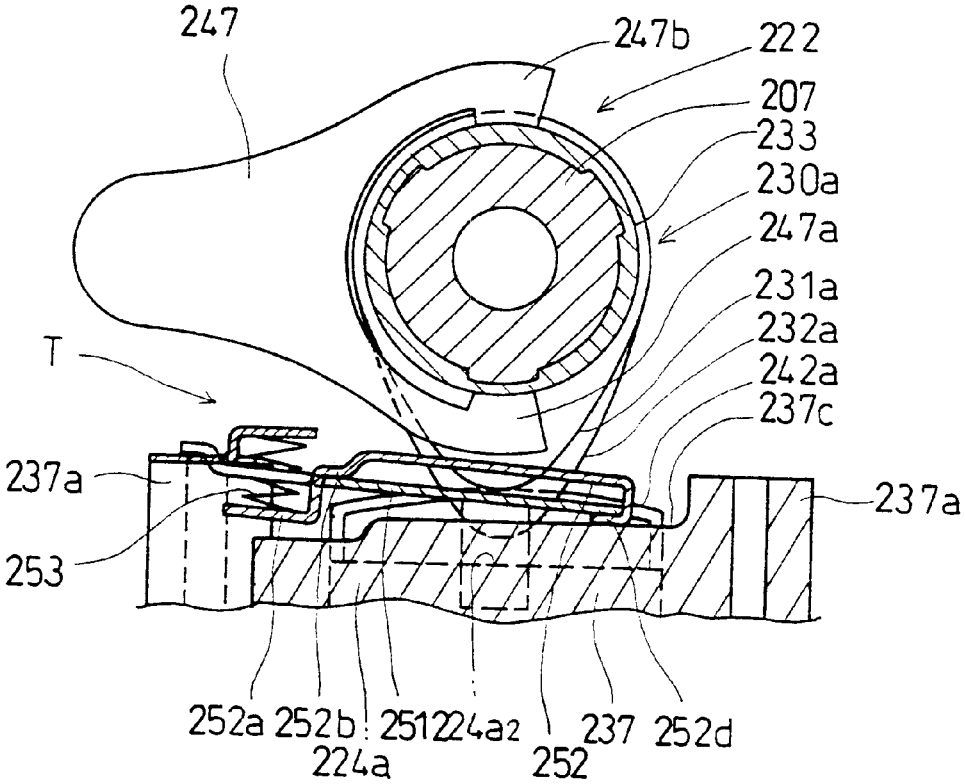
FIG. 22 is a view similar to FIG. 21 showing a state when the intake valve is in the maximum lift.
Figure 26:
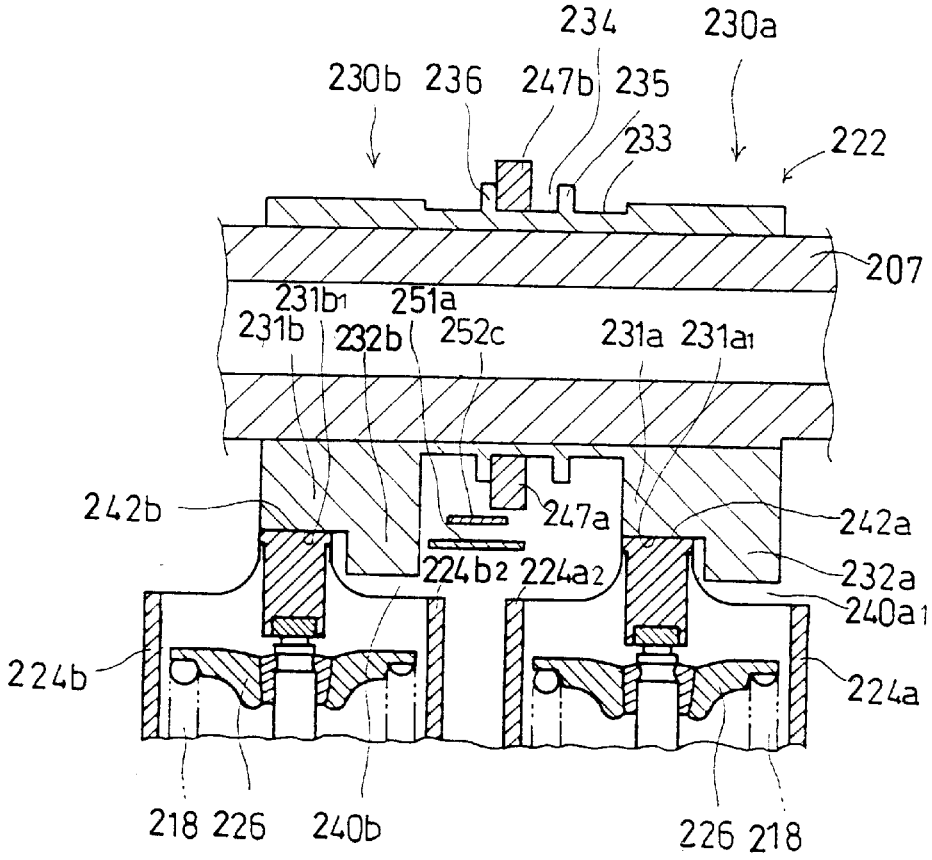
FIG. 26 is a view similar to FIG. 24.

After then, as the camshaft rotates further, the first and second lifters 224*a*, 224*b* are pushed down by the nose portions 231*a*1, 231*b*1 of the low speed cams 231*a*, 231*b*, and the first and second intake valves are opened. The trigger base 251 with the first and second contact sections 251*c*, 251*d* contacted with the first and second side wall upper surfaces 224*a*2, 224*b*2 by force of the trigger spring. 253 moves down together with the first and second lifters 224*a*, 224*b*. The trigger piece 252 also moves down similarly. When the intake valves 214*a*, 214*b* are opened by the predetermined lift amount, the stopper section 252*d* touches the upper surface 237*c* of the holder section 237 to prevent further movement of the trigger base 251 and the trigger piece 252, and the first and second contact sections 251*c*, 251*d* are separated from the first and second side wall upper surfaces 224*a*2, 224*b*2. At this time, the regulating section 252*c* is positioned below the first contact section 247*a*, therefore the arm 247 moves toward the second cam section 230*b* by the gap G3 to touch the second engaging section 236. In this state, the drive force of the arm 247 acts on the cam piece 222, however, since the intake valves 214*a*, 214*b* is opened to make the spring force of the valve spring 218 large and the drive force is set at the aforementioned value, friction force between the low speed cams 231*a*, 231*b* and the slipper sections 242*a*, 242*b* is larger than the drive force and the cam piece 222 can not move axially. FIGS. 22 and 26 show positional relations among the first contact section 247*a*, the first and second side wall upper surfaces 224*a*2, 224*b*2, the first and second contact sections 251*c*, 251*d* of the trigger base 251 and the regulating section 252*c* of the trigger piece 252 when the first and second intake valves 214*a*, 214*b* are opened with the maximum lift amount.

After the first and second intake valves 214*a*, 214*b* reach the maximum lift amount, the low speed cams 231*a*, 231*b* rotate further so that the lift amount is reduced to the predetermined lift amount. The side wall upper surfaces 224*a*2, 224*b*2 touch the contact sections 251*c*, 251*d* of the trigger base 251. When the low speed cams 231*a*, 231*b* rotate to reduce the lift amount and the lifters 224*a*, 224*b* moves upward, the trigger base 251 and the trigger piece 252 move upward together with the lifters and touch an outer peripheral surface of the first contact section 247*a*. At that time, since the intake valves 214*a*, 214*b* is opened and the friction force between the low speed cams 231*a*, 231*b* and the slipper sections 241*a*, 242*b* is larger than the aforementioned drive force, the driving piston 246 can not move the cam piece axially.

Figure 23:
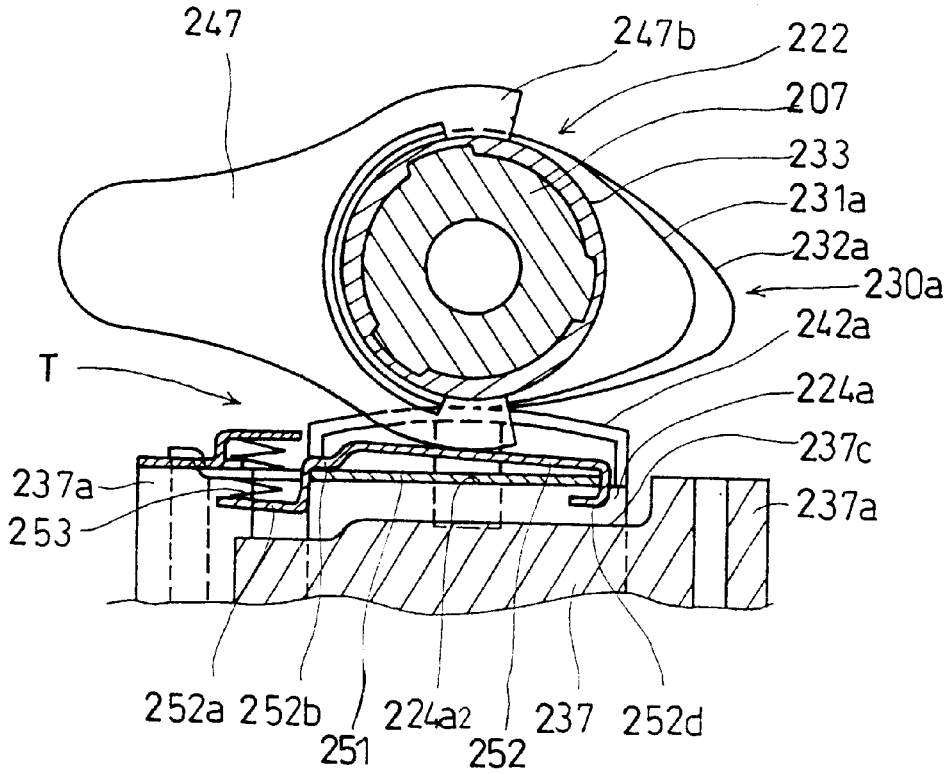
FIG. 23 is a view similar to FIG. 21 showing a state of the intake valve immediately before it is closed.
Figure 27:
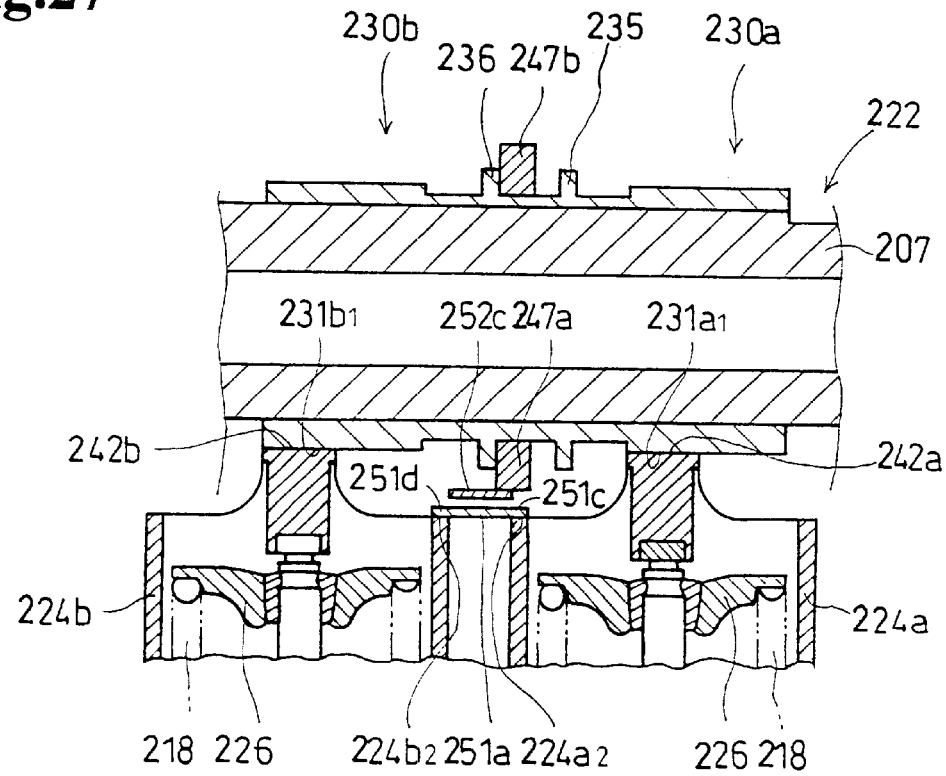
FIG. 27 is a view similar to FIG. 24.

When the low speed cams rotate further, only the trigger base 251 moves upward together with the lifters 224*a*, 224*b* while the regulating section 252*c* is kept in a state that it touches the first contact section 247*a*. FIGS. 23 and 27 show a state just before the base circle portions 231*a*2, 231*b*2 of the low speed cams 231*a*, 231*b* come into sliding contact with the slipper sections 242*a*, 242*b*.

Figure 28:
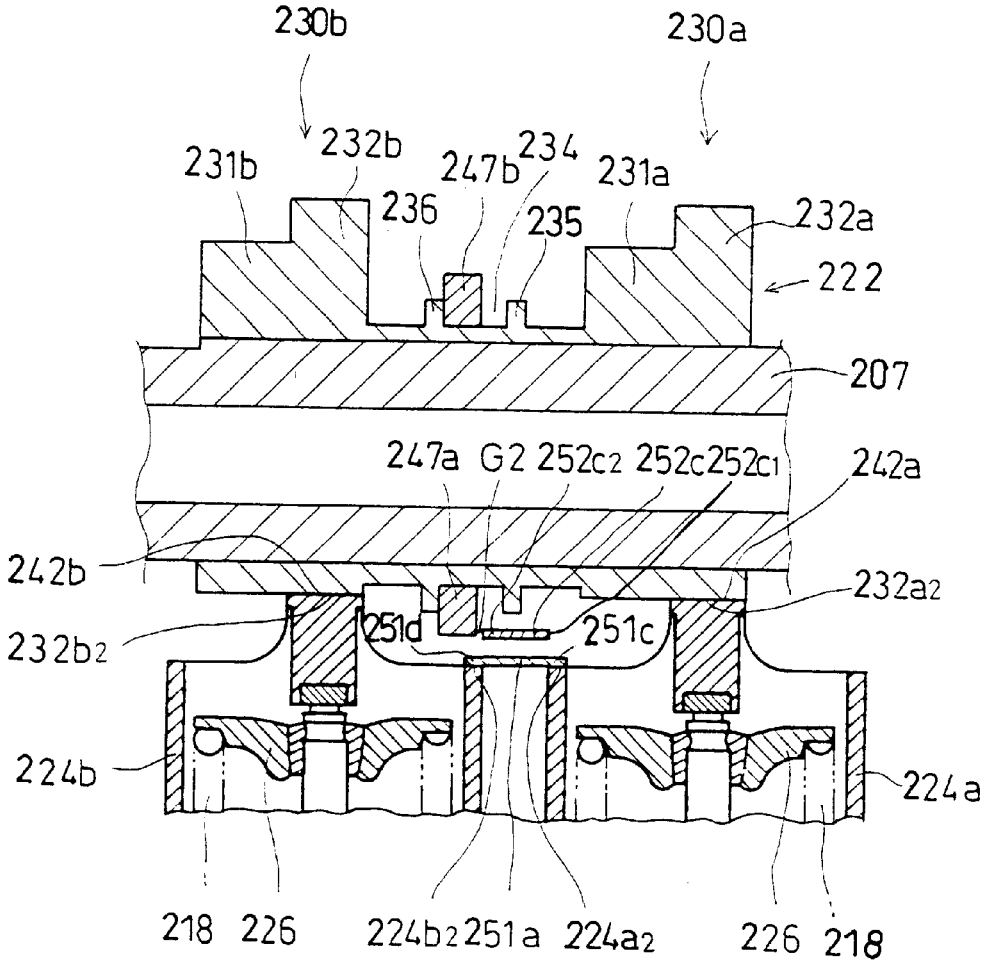
FIG. 28 is a view similar to FIG. 24.

Immediately after the base circle portions 231*a*2, 231*b*2 of the low speed cams 231*a*, 231*b* come into sliding contact with the lifters 242*a*, 242*b* to close the intake valves 214*a*, 214*b*, the aforementioned drive force of the drive piston 246 overcomes the friction force between the low speed cams 231*a*, 231*b* and the slipper sections 242*a*, 242*b*, and the driving piston 246 moves the cam piece 222 axially through the first and second contact sections 247*a*, 247*b* and the second engaging section 236. Thus, the base circle portions of the high speed cams 232*a*, 232*b* come into sliding contact with the slipper sections 242*a*, 242*b* (high speed position). Namely, switching from low speed cams 231*a*, 231*b* to the high speed cams 232*a*, 232*b* is completed. At that time, as shown in FIG. 28, the first contact section 247*a* is positioned near the second lifter 224*b*, and between the first contact section 247*a* and the second side surface 252*c*2 of the trigger piece 252 is formed a gap G2 which is equal to the gap G2 in FIG. 24. The first engaging section 235 is opposite to the trigger piece 252 and the trigger piece 252 is not contacted with the cam piece 222.

Therefore, the intake valves 214*a*, 214*b* are opened and closed with a opening-closing time and a lift amount determined by the cam-profile of the high speed cams 232*a*, 232*b*. Since the exhaust side mechanism $M_{EX}$ also occupies a high speed position similarly to the intake side driving mechanism $M_{IN}$, the intake valves 214*a*, 214*b* and the exhaust valves 215 are opened and closed with a large lift amount, a opening-closing time and a long valve opening period adapted to valve operating characteristic at the high rotational speed region.

When the rotational speed of the engine E is lowered to a speed less than the above-mentioned predetermined rotational speed and the engine shifts from the high rotational speed region to the low rotational speed region, working oil in the first oil pressure chamber 248*a* becomes of low oil pressure and working oil in the second oil pressure chamber 248*b* becomes of high oil pressure, owing to the actions of the first and second control valves. Therefore, the driving piston 246 moves the cam piece 222 in a direction opposite to the moving direction in the above-mentioned case, and actions similar to the above-mentioned actions are carried out between the trigger piece 252 and the first contact section 247*a*. Thus, switching to the low speed cams 231*a*, 231*b* is carried out on the base circle portions 232*a*2, 232*b*2 of the high speed cams 232*a*, 232*b*.

Even if the operation region of the engine E shifts between the low rotational speed region and the high rotational speed region when the intake valves 214*a*, 214*b* are opened, the driving piston does not move the cam piece 222 since the drive force of the driving piston 246 is set as described above. When the camshaft 207 rotates further and the intake valves 214*a*, 214*b* are closed firstly, the switching action between the low speed cams 231*a*, 231*b* and the high speed cams 232*a*, 232*b* is carried out.

Next, working and effect of the above-mentioned embodiment will be described. The description is made regarding the intake side valve moving apparatus $V_{IN}$, but it is the same regarding the exhaust side valve moving apparatus $V_{EX}$.

Owing to the trigger mechanism T, the switching action is started immediately after he intake valves is closed and carried out during the base circle portions of the cams is in sliding contact with the lifters. Therefore, the switching can be carried out surely, a collision of the cams against the lifters and partial wearing of the lifters are prevented, smooth sliding motion of the lifters can be ensured, and occurrence of noise and lowering of durability of the lifters and cams are prevented.

Since the intake valves 214*a*, 214*b* are operated by the low speed cams 231*a*, 231*b* and the high speed cams 232*a*, 232*b* through the first and second lifters 224*a*, 224*b*, the intake side valve moving apparatus $V_{IN}$ is made low. Moreover, the trigger mechanism T is disposed under the camshaft 207 utilizing the space under the camshaft 207, therefore the intake side valve moving apparatus $V_{IN}$ with the trigger mechanism T is miniaturized, and accordingly the valve moving chamber 221 and the engine E are miniaturized. As compared with the aforementioned prior art in which a rocker arm support shaft, a trigger lever support shaft and a cam switching mechanism are disposed around a camshaft, only the intake side driving mechanism $M_{IN}$ is disposed around the camshaft 207, therefore the intake side valve moving apparatus $V_{IN}$ with the trigger mechanism T is miniaturized in this respect too.

When the intake side driving mechanism $M_{IN}$ is not carrying out the switching action, as shown in FIGS. 24 and 28, the first contact section 247*a* of the arm 247 does not touch the trigger piece 252 of the trigger mechanism T, so that abrasion of the both is restrained and durability of the both is improved. Since trigger mechanism T does not touch the rotating cam piece 222, abrasion of the trigger mechanism is restrained. Since engagement and disengagement of the trigger piece 252 with the first contact section 247*a* are carried out utilizing upward and downward movement of the first and second lifters 224*a*, 224*b*, any other member for operating the trigger mechanism T is unnecessary, so that an operating mechanism for operating the trigger mechanism T simplified and the intake side driving mechanism $M_{IN}$ with the trigger mechanism T can be miniaturized. Since trigger base 251 is disposed so that it touches the first and second side wall upper surfaces 224*a*2, 224*b*2 from above, the intake side driving mechanism $M_{IN}$ is miniaturized in plan.

Since the trigger base 251 and the trigger piece 252 are disposed between the first and second lifters 224*a*, 224*b* further between the first and second cam sections 230*a*, 230*b* of the cam piece 222, the intake side valve moving apparatus $V_{IN}$ can be miniaturized in axial direction of the camshaft.

Since the first contact section 247*a* of the arm 247, the first and second engaging sections 235, 236 and the high speed cams 232*a*, 232*b* are disposed utilizing the cut portions 240*a*1, 240*a*2, 240*b*1, axial length of the cam piece 222 can be made short.

Since the trigger mechanism T is disposed between the camshaft 207 and the first and second lifters 224*a*, 224*b*, the intake side valve moving apparatus $V_{IN}$ can be miniaturized in axial direction of the lifter. Further, the trigger base 251 touches the first and second side wall upper surfaces 224*a*2, 224*b*2 formed owing to providing the cut portions 240*a*2, 240*b*1, namely, also the trigger mechanism T is disposed utilizing the cut portions 240*a*2, 240*b*1. Therefore, the intake side valve moving apparatus $V_{IN}$ can be further miniaturized in axial direction of the camshaft and in axial direction of the lifter.

The trigger piece 252 composed of a flat plate extending along the axial direction of the camshaft A1 is contacted with the first contact section 247*a* of the arm 247 moving in the direction A1 at the first and second side surfaces 252*c*1, 252*c*2. Therefore, rigidity of the trigger piece 252 is high and the trigger piece can regulate the movement of the arm 247 surely.

Since the trigger piece 252 is required only to remain in the moving course of the first contact section 247*a*, degree of freedom of shape and arrangement of the trigger piece 252 is large. Therefore, the trigger piece 252 can be applied to the intake side valve moving apparatus $V_{IN}$ of various constructions to contribute to miniaturization of the intake side valve moving apparatus $V_{IN}$. Further, since the first contact section 247*a* which is a part of the arm 247 of the intake side driving mechanism $M_{IN}$ touches the trigger piece 252, any other member for touching the trigger piece 252 is unnecessary, so that construction of the intake side valve moving apparatus $V_{IN}$ can be simplified.

Since the trigger mechanism T is fixed to the holder section 237 utilizing the bolts B for fixing the holder section 237 to the cylinder head 203, number of parts and assembling man-hour cam be reduced. Further, since the trigger mechanism T is fixed to the lifter holder which has high rigidity in order to hold the first and second lifters 224*a*, 224*b*, the trigger mechanism T can be fixed strongly.

The guide groove 234 for receiving the first and second contact sections 247*a*, 247*b* of the arm 247 is formed by the first and second engaging sections 235, 236 positioned opposite to the trigger piece 252 in the axial direction of the lifter A2. Therefore, width of the guide groove 234 can be made small and the trigger mechanism T can be miniaturized in the axial direction of the camshaft A1.

Next, another embodiment of the invention will be described with reference to FIGS. 29 to 35. This embodiment is different from the above-mentioned embodiment chiefly in construction of the trigger mechanism T, and in other construction, this embodiment is the same as the above-mentioned embodiment. Therefore, description of the same part will be omitted or simplified. In the following description, members of the present embodiment identical with or corresponding to members of the above-mentioned embodiment are shown by the same symbols.

Figure 29:
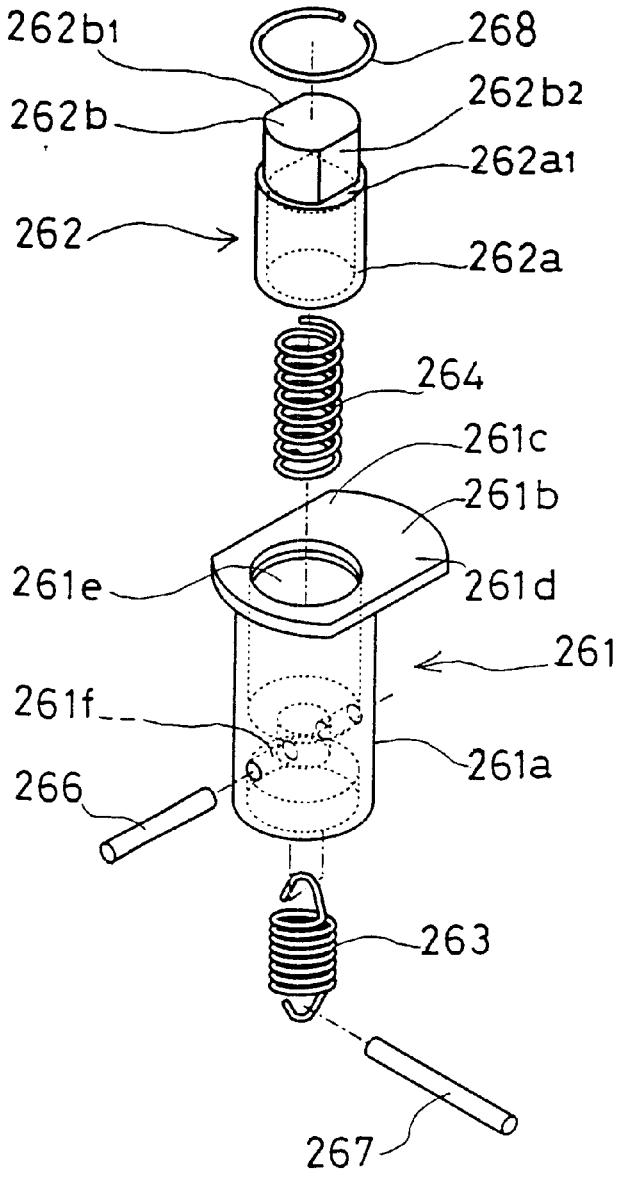
FIG. 29 is an exploded perspective view of a trigger mechanism of a direct type valve moving apparatus according to other embodiment of the present invention.
Figure 30:
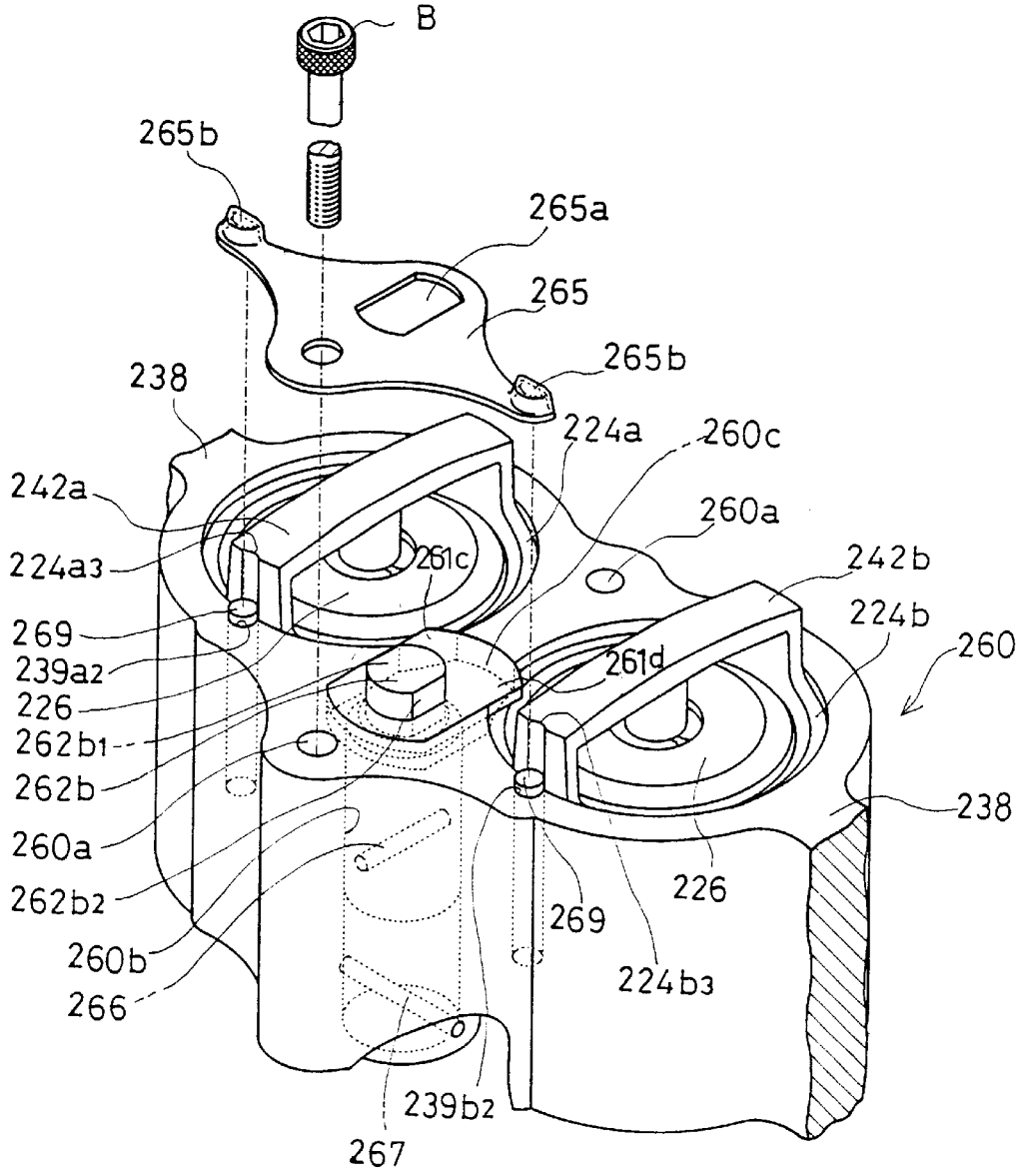
FIG. 30 is a partial perspective view showing a state that the trigger mechanism of FIG. 29 is attached to the lifter holder of the direct type valve moving apparatus.
Figure 31:
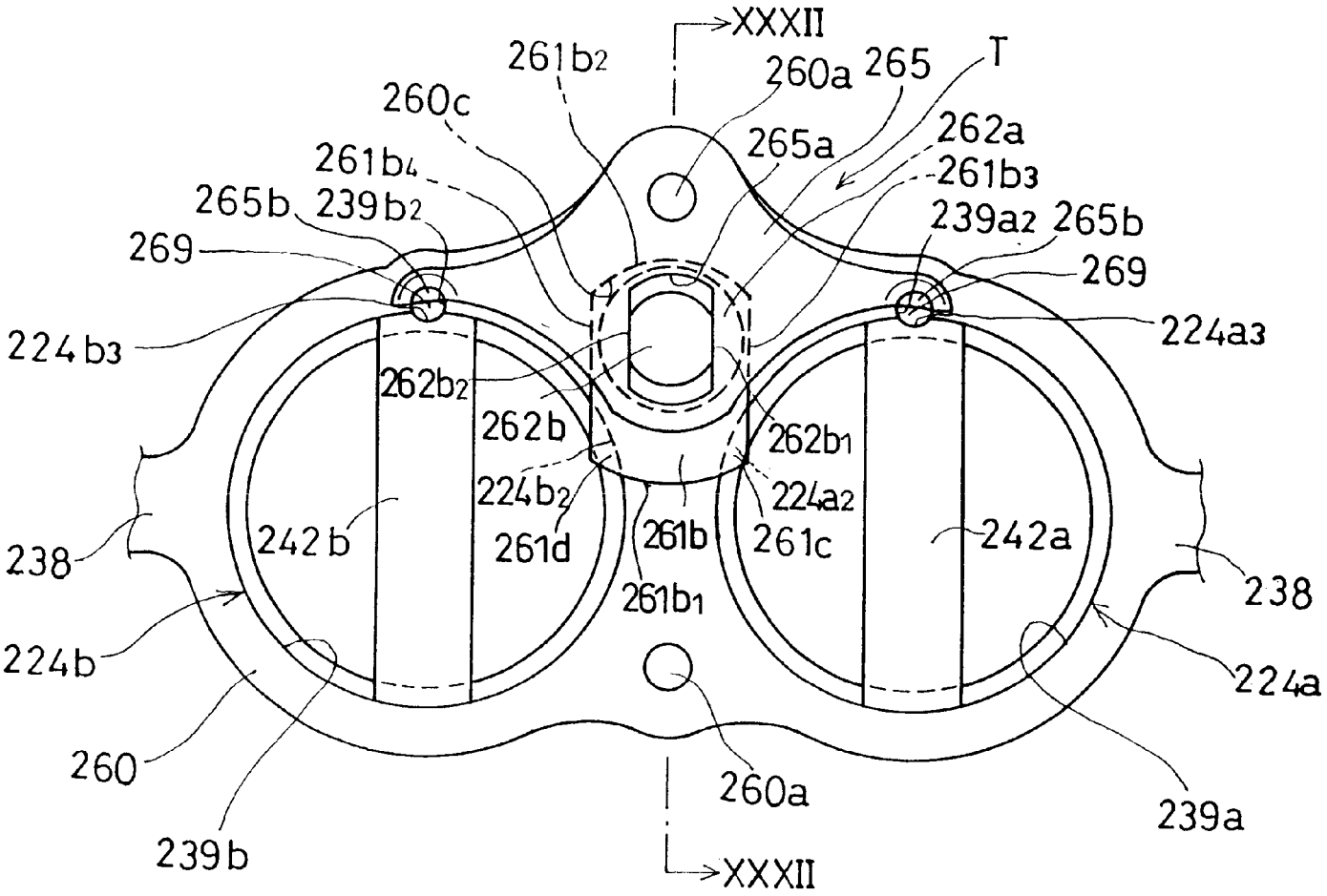
FIG. 31 is a partial plan view of the lifter holder attached with the trigger mechanism of FIG. 29.

Referring to FIGS. 29 to 31, a holder section 260 of a lifter holder is fixed to the cylinder head 203 by bolts B inserted in penetrating holes 260*a*. The trigger mechanism is formed on a position of the holder section 260 between the first and second guide holes 239*a*, 239*b* and near the center axis of the cylinder 201. The trigger mechanism T comprises a trigger body 261 fitted so as to slide in a circular hole 260*b* having an axis parallel with the axis of the lifter 224, a columnar trigger piece 262 fitted so as to slide in the trigger body, a first trigger spring 263 consisting of a tensile coil spring, a second trigger spring 264 consisting of a compressive coil spring and a plate 265 fixed to the holder section 260.

The trigger body 261 has a cylinder section 261*a* to be fitted in the receiving hole 260*b* and a flat-plate-like flange section 261*b* formed integrally at an upper end of the cylinder section 261*a*. The flange section 261*b* has a first arcuate portion 261*b*1, a second arcuate portion 261*b*2, a first linear portion 261*b*3 and a second linear portion 261*b*4 (FIG. 31). The flange section 261*b* is fitted so as to slide in a recess 260*c* formed in the holder section 260 and having the same shape as the flange section 261*b* to prevent turning of the trigger body 261. Similarly to the support section 251*a* of the above-mentioned embodiment, the flange section 261*b* has a first and second contact sections 261*c*, 261*d* for touching the first and second side wall upper surface 224*a*2, 224*b*2 of the first and second lifters 224*a*, 224*b*. The first trigger spring 263 is tensed between a retaining pin 266 pressed into the cylinder section 261*a* and a retaining pin 267 pressed in the holder section 260, and the first and second contact sections 261*c*, 261*d* are forced to touch the first and second side wall upper surfaces 224*a*2, 224*b*2 of the first and second lifters 224*a*, 224*b* by spring force of the first trigger spring 263.

The trigger piece 262 is disposed between the first cam section 230*a* and the second cam section 230*b*, and has a cylindrical piston section 262*a* with a top wall 262*a*1 fitted so as to slide in an inner hole 261*e* of the cylinder section 261*a*, and a plate-like regulating section 262*b* projecting from an upper surface of the piston section 262*a*. Between a lower surface of the top wall 262*a*1 and a flange-like spring bearing section 261*f* provided on an inner surface of the cylinder section 261*a* neighboring the retaining pin 266 is inserted the second trigger spring 264 so that the trigger piece 262 is forced upward by spring force of the second trigger spring 264. An upper surface of the top wall 262*a*1 touches a stop ring 268 fitted to an upper portion of the cylinder section 261*a* to regulate a maximum upper position of the trigger piece 262. A width of the regulating section 262*b* in the axial direction A1 is determined in the same manner as the width of the regulating section 252*c* of the above-mentioned embodiment.

After the trigger mechanism T is attached to the holder section 260, the plate 265 having a guide hole 265*a* for the regulating section 262*b* is put on the trigger piece 262. The plate 265 is fixed to the holder section 260 by the bolt B. The guide hole 265*a* has a shape slightly larger than that of the regulating section 262*b* and functions as a turning stopper of the trigger piece 262.

On peripheral surfaces of the first and second guide holes 239*a*, 239*b* are formed insertion grooves 239*a*2, 239*b*2 of semi-circular cross-sections extending in parallel with the axis of the lifter (namely, in axial direction A2). The insertion grooves 239*a*2, 239*b*2 have opened upper ends and lower end wall surfaces. On the one hand, retaining grooves 224*a*3, 224*b*3 similar to the insertion grooves 239*a*2, 239*b*2 are formed on outer surfaces of the lifters 224*a*, 224*b* facing the insertion grooves. Pins 269 are inserted in the insertion grooves 239*a*2, 239*b*2 and retained by the retaining grooves 224*a*3, 224*b*3, so that turning of the lifters 224*a*, 224*b* relative to the holder section 260 is prevented. In order to prevent escape of the pins 269, the plate 265 is formed with retaining sections 265*b* covering end surfaces of the pins 265. Also, the plate 265 touches the flange section 261*b* of the trigger body 261 to prevent that the trigger body 261 slips out toward the camshaft 207 owing to vibration of the engine E or the like.

Figure 32:
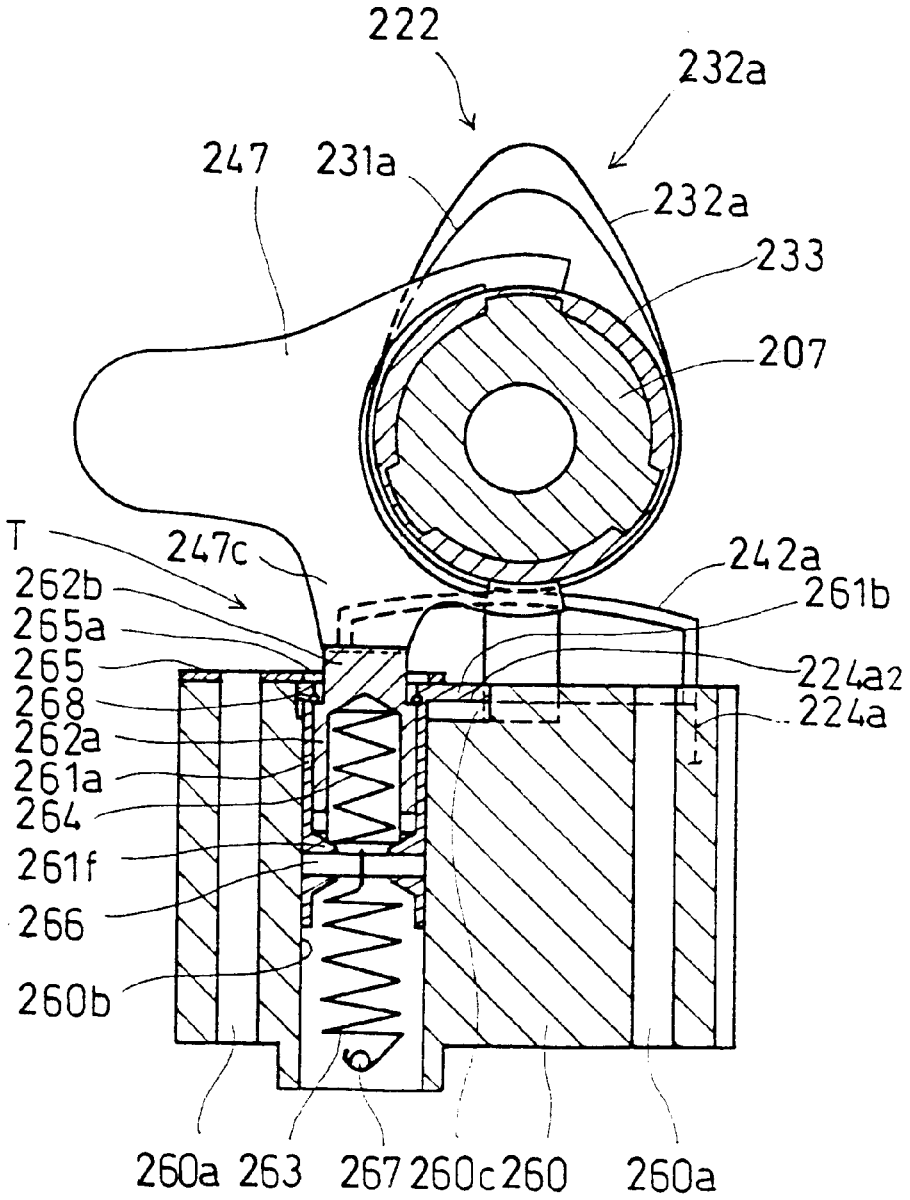
FIG. 32 is a sectional view taken along the line XXII—XXII of FIG. 31.

As shown in FIG. 32, the arm 247 of the intake side driving mechanism $M_{IN}$ is formed with a third contact section 247*c* projecting downward at a position near the driving piston 246. The third contact section 247*c* touches a first side surface 262*b*1 of the regulating section 262*b* to occupy a waiting position similar to that of the above-mentioned embodiment. Referring to FIG. 35, a radial size of the second contact section 247*a* is about equal to those of the first and second engaging sections 235, 236, and the third contact section 247*c* is projected downward more than the second contact section 247*a*. Relation between the third contact section 247*c* and the regulating section 262*b* is the same as relation between the second contact section 247*a* and the regulating section 252*c* in the above-mentioned embodiment.

When the intake valves 214*a*, 214*b* are closed, the trigger body 261 is forced by the first trigger spring 263 so that the first and second contact sections 261*c*, 261*d* of the flange section 261*b* touch the first and second side wall upper surfaces 224*a*2, 224*b*2, and the trigger piece 262 is forced by the second trigger spring 263 so that the top wall 262*a*1 touches the stop ring 268. In this state, the first and second side surfaces 262*b*1, 262*b*2 of the regulating section 262*b* are positioned in a moving course of the third contact section 247*c*.

When the intake valves 214*a*, 214*b* are being opened, the trigger body 261 and the trigger piece 262 move downward in a state that the first and second contact sections 261*c*, 261*d* of the flange section 261*b* touch the first and second side wall upper surfaces 224*a*2, 224*b*2, and when the first and second lifters 224*a*, 224*b* has moved by the predetermined lift amount, the flange section 261*b* touches a bottom surface of the recess 260*c* of the holder section 260 to prevent further downward movement of the trigger piece 262. Therefore, the first and second contact sections 261*c*, 261*d* are separated from the first and second side wall upper surfaces 224*a*2, 224*b*2. Accordingly, the flange section 261*b* has the function of the stopper section 252*d* of the above-mentioned embodiment, and the trigger body 261 functions as a control member for controlling movement of the trigger piece 262 in accordance with movement of the first and second lifters 224*a*, 224*b*. The predetermined lift amount is suitably set so that the regulating section 262*b* of the trigger piece 262 is positioned under the third contact section 247*c* of the arm 247 at the predetermined lift amount.

Figures 35A, 35B, 35C, 35D, 35E:
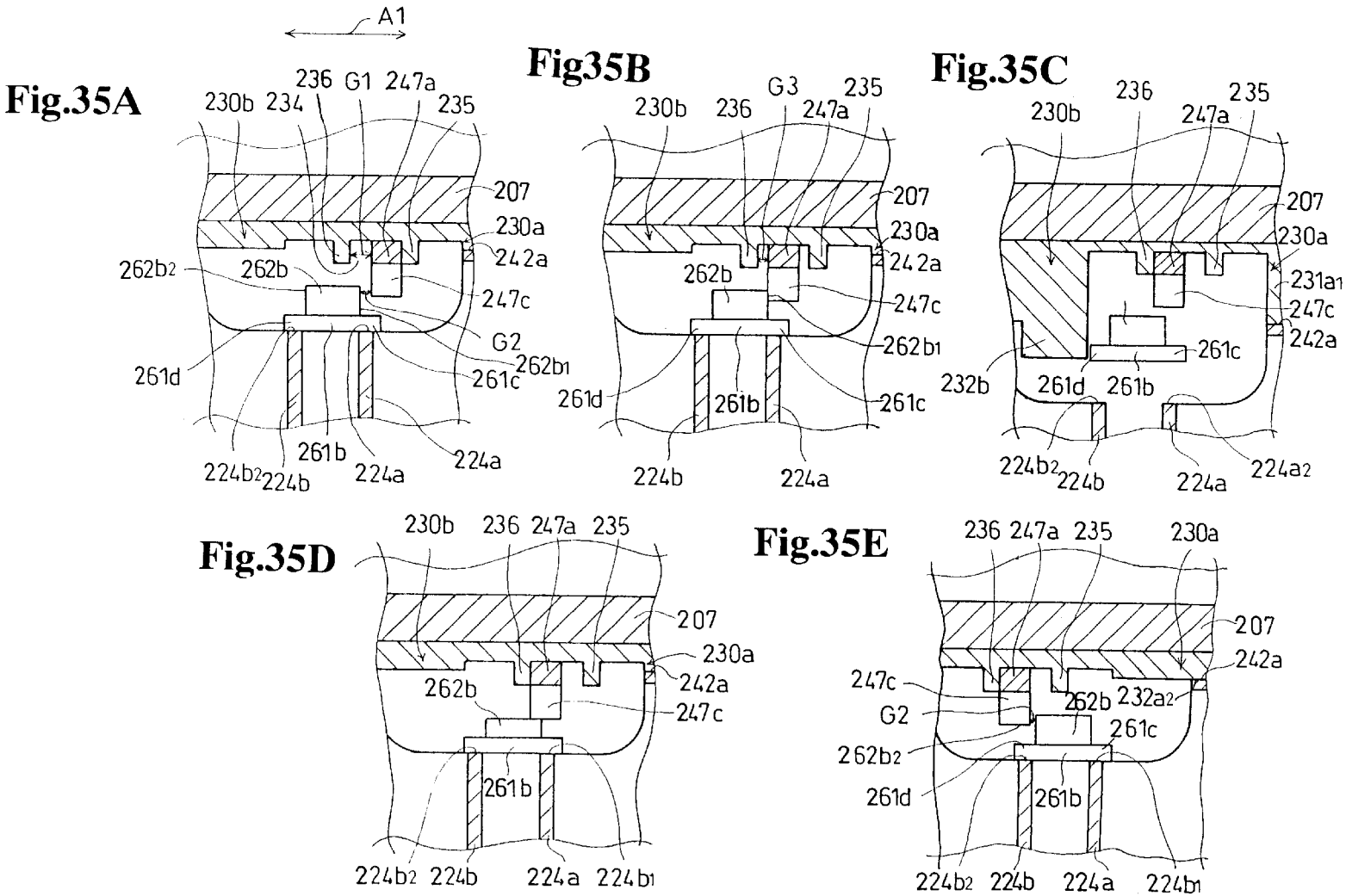
FIGS. 35A, 35B, 35C, 35D and 35E are partial sectional views corresponding to FIGS. 24 to 28 for explaining action of the trigger mechanism of FIG. 29.

As shown in FIG. 35A, when the engine E is in the low rotational speed region, the first contact section 247*a* touches the first engaging section 235, a predetermined gap G1 is formed between the first contact section 247*a* and the second engaging section 236, and a predetermined gap G2 smaller than the gap G1 is formed between the first side surface 262*b*1 of the regulating section 262*b* and the first contact section 247*a*. The first and second contact sections 261*c*, 261*d* of the flange section 261*b* touch the first and second side wall upper surfaces 224*a*2, 224*b*2.

If the engine E is shifted to the high rotational speed region, drive force of the driving piston 246 acts on the arm 247. And when the first and second intake valves 214*a*, 214*b* are closed firstly after beginning of action of the drive force, as shown in FIG. 35B, the arm 247 moves toward the second cam section 230*b*, the third contact section 247*c* touches the first side surface 262*b*1, of the regulating section 262*b* remaining in the moving course of the third contact section 247*c*, and the arm 247 occupies the waiting position where movement of the arm 247 in the axial direction A1 is prevented. At this time, between the first contact section 247*a* and the second engaging section 236 is formed a gap G3 smaller than the gap G1 by the gap G2.

Figure 33:
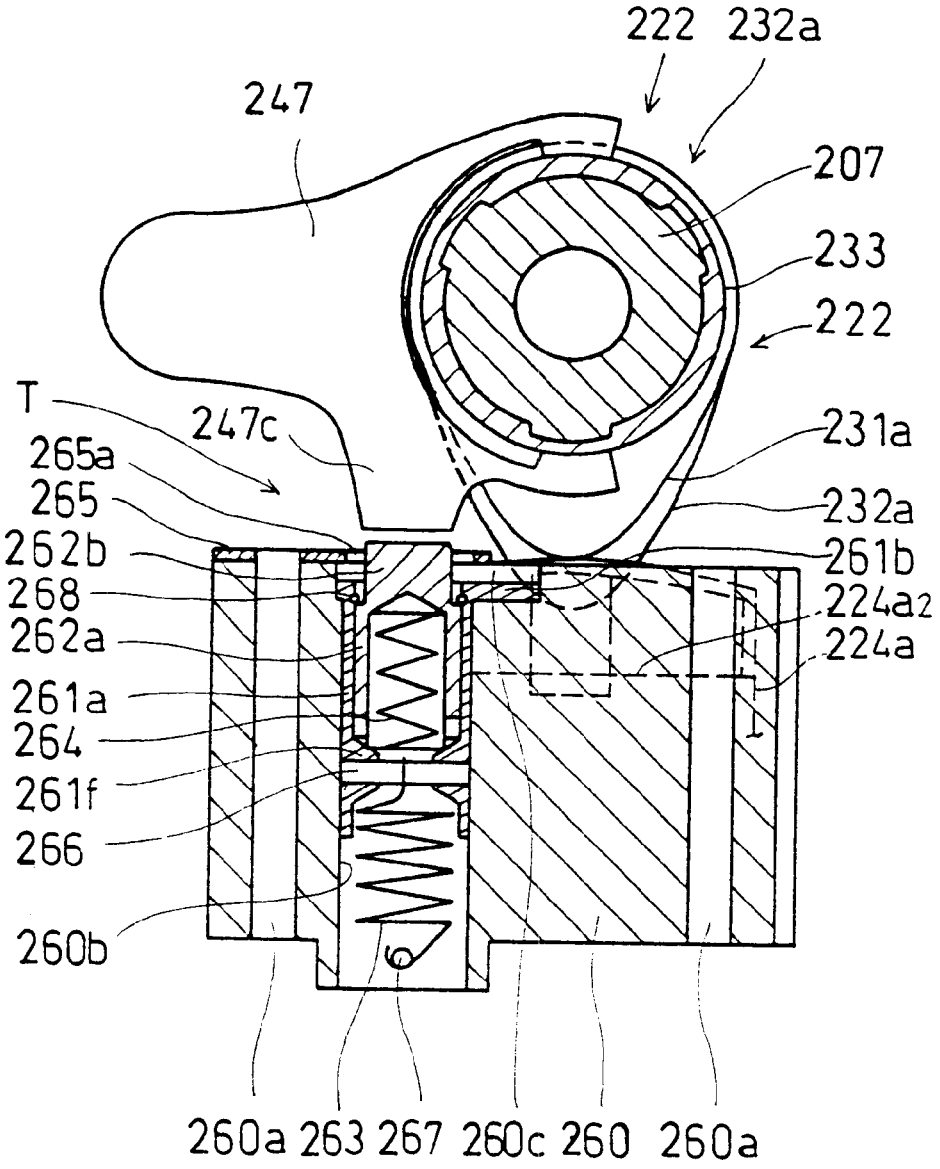
FIG. 33 is a view similar to FIG. 32 showing a state that the intake valve is in the maximum lift.

After then, when the camshaft 207 rotates further and the lifters 224*a*, 224*b* are pushed by the nose portions 231*a*1, 231*b*1 of the low speed cams 231*a*, 231*b* to open the intake valves 214*a*, 214*b*, the trigger body 261 with the contact sections 261*c*, 261*d* touching the side wall upper surface 224*a*2, 224*b*2 moves downward together with the trigger piece 262 following the lifters 224*a*, 224*b* owing to spring force of the first trigger spring 263. When the lifters 224*a*, 224*b* move downward further and the intake valves 214*a*, 214*b* are lifted by the predetermined lift amount, the flange section 261*b* touches the bottom surface of the recess 260*c* to prevent further downward movement of the trigger body 261 and the trigger piece 262. At this time, the regulating section 262*b* is positioned under the third contact section 247*c*, the first side surface 262*b*1 is separated from the third contact section 247*c*, the arm 247 moves toward the second cam section 230*b* by a distance corresponding to the gap G3, and the third contact section 247*c* positioned above the regulating section 262*b* so as to be movable relatively to the regulating section. In this state, the above-mentioned drive force acts on the cam piece 222 through the arm 247. However, since the intake valves 214*a*, 214*b* are opened, friction force between the low speed cams 231*a*, 231*b* and the slipper sections 242*a*, 242*b* are larger than the above drive force, the cam piece can not move axially. FIGS. 33 and 35*c* show positional relation among the third contact section 247*c*, the first and second side wall upper surfaces 224*a*2, 224*b*2, the first and second contact sections 261*c*, 261*d* of the flange section 261, and the regulating section 262*b* of the trigger piece 262 when the first and second intake valves 214*a*, 214*b* are opened with the maximum lift amount.

After the intake valves 214*a*, 214*b* reach the maximum lift amount, the low speed cams 231*a*, 231*b* rotate further to reduce the lift amount. And at the predetermined lift amount, the side wall upper surfaces 224*a*2, 224*b*2 touch the contact sections 261*c*, 261*d* of the flange section 216*b*. When the low speed cams 231*a*, 231*b* rotate further to move the lifters 224*a*, 224*b* upward, the trigger body 261 and the trigger piece 262 move upward and an upper surface of the regulating section 262*b* touches a lower surface of the third contact section 247*c*. At this time, since the intake valves 214*a*, 214*b* are opened and friction force between the low speed cams 231*a*, 231*b* and the slipper sections 242*a*, 24*ab* is larger than the above-mentioned drive force, the cam piece 222 does not move axially.

Figure 34:
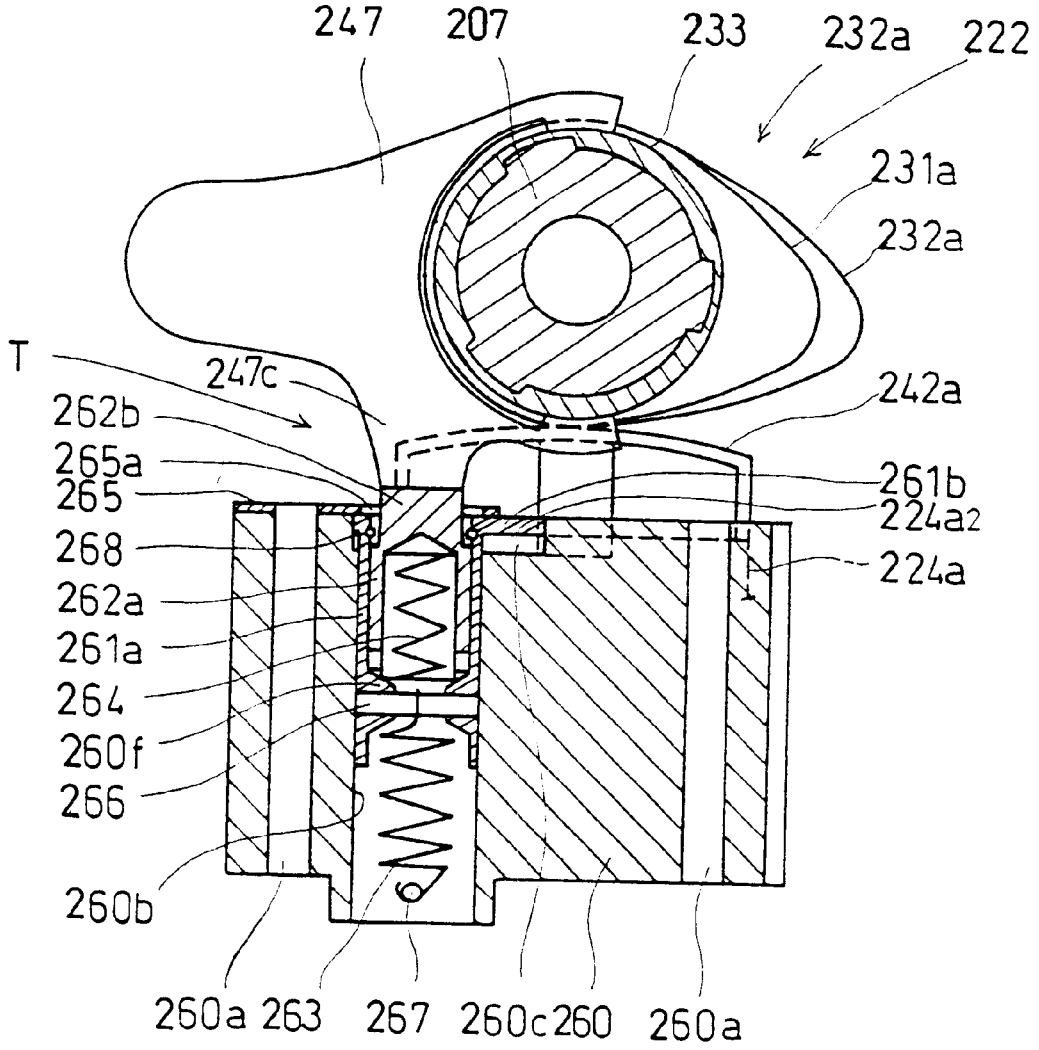
FIG. 34 is a view similar to FIG. 32 showing a state immediately before the intake valve is closed.

When the low speed cams 131*a*, 131*b* rotate further, the regulating section 262*b* keeps the state that it touches the third contact section 247*c* and only the trigger body 261 moves upward together with the lifters 224*a*, 224*b*. FIGS. 34 and 35D show a state immediately before the base circle portions 231*a*2, 231*b*2 of the low speed cams 231*a*, 231*b* touch the slipper sections 242*a*, 242*b*.

Immediately after the intake valves 214*a*, 214*b* are closed, the above-mentioned drive force of the driving piston 246 overcomes friction force between the low speed cams 231*a*, 231*b* and the slipper sections 241*a*, 241*b*, the first and second contact sections 247*a*, 247*b* push the second engaging section 236 to move the cam piece 222 axially, and the cam piece 222 occupies the high speed position where the base circle portions 232*a*2, 232*b*2 of the high speed cams 232*a*, 232*b* come into sliding contact with the slipper sections 242*a*, 24*a* b as shown in FIG. 35E. Thus switchover from the low speed cams 231*a*, 231*b* to the high speed cams 232*a*, 232*b* is completed. At this time, the third contact section 247*c* is positioned near the second lifter 224*b*, and between the third contact section 247*c* and the second side surface 262*b*2 of the regulating section 262*b* is formed a gap G2 equal to the gap G2 shown in FIG. 35A.

Switchover from the high speed cams to the low speed cams is also carried out in the same manner when the base circle portions 232*a*2, 232*b*2 of the high speed cams 232*a*, 232*b* are in sliding contact with the lifters.

Similarly to the above-mentioned embodiment, when the operation region of the engine E shifts between the low rotational speed region and the high rotational speed region, if the intake valves 214*a*, 214*b* are opened, the driving piston 246 does not move the cam piece 222, and when the camshaft 207 rotates further and the intake valves 214*a*, 214*b* are closed firstly, switchover between the low speed cams and the high speed cams is carried out.

Figure 36:
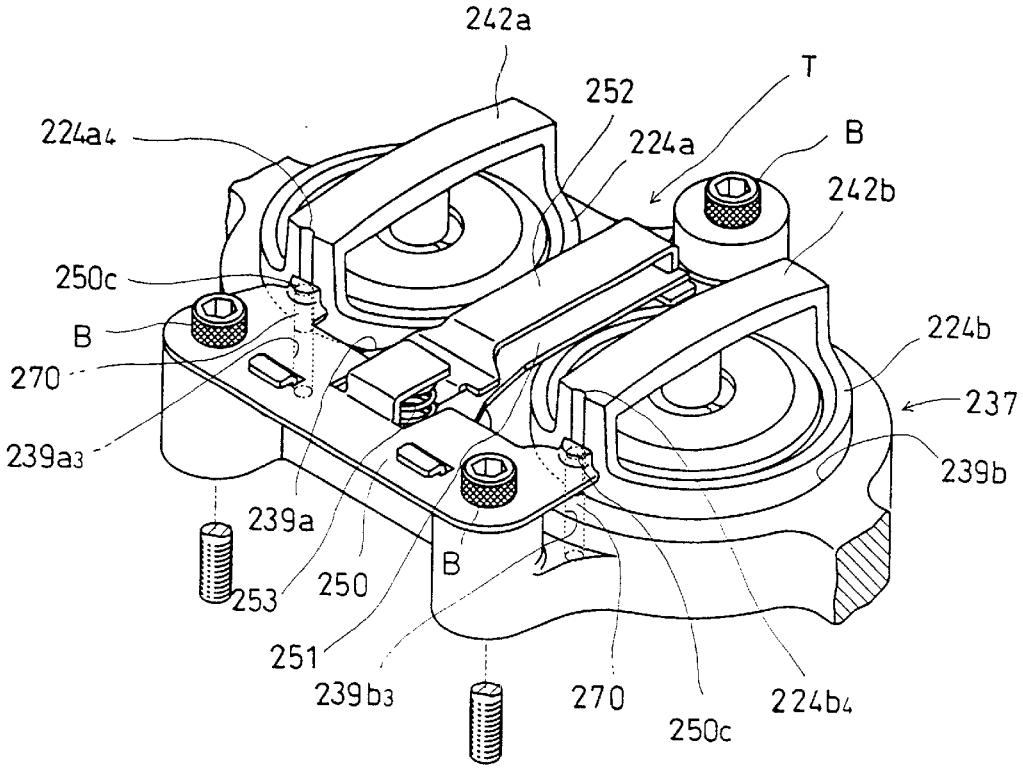
FIG. 36 is a partial perspective view of a lifter holder attached with a trigger mechanism according to further another embodiment of the present invention.

In the embodiment shown in FIG. 19, the trigger bracket 250 may be integrally provided with a stopper sections 250*c* covering upper surfaces of the pins 243 for preventing escape of the pins as shown in FIG. 36. In this case, similarly to the embodiment of FIG. 19, on peripheral surfaces of the first and second guide holes 239*a*, 239*b* are formed insertion grooves 239*a*1, 239*b*1 each having a semi-circular cross-section, an opened upper end and a lower end provided with an end wall. On the one hand, on outer surfaces of first and second lifters 224*a*, 224*b* continuing to the slipper sections 242*a*, 242*b* are formed retaining grooves 239*a*4, 239*b*4 each having a semi-circular cross-section, an opened upper end and a lower end provided with an end wall. Pins 270 which are somewhat shorter than the insertion grooves 239*a*3, 239*b*3 are inserted. The pins 270 are engaged with the insertion grooves 239*a*3, 239*b*3 and the retaining grooves 224*a*4, 224*b*4, which are longer than the insertion grooves 239*a*3, 239*b*3, for preventing rotation of the lifters 224*a*, 224*b* relative to the holder section 237. Otherwise, the pin 243 itself may be formed integrally with the trigger bracket 250 for reducing number of parts.

Though the lifter is fitted so as to slide in the lifter holder fixed to the cylinder head according to the above-mentioned embodiments, the cylinder head may be formed with a guide hole for the lifter. In this case, the cylinder head constitutes a lifter holding member.

The engine may have one intake valve and one exhaust valve for each cylinder, or the engine may have more than three intake valves or exhaust valves for each cylinder. Further, the lifter may have a top wall not provided with cut portions.

What is claimed is:

1. A valve moving apparatus of an internal combustion engine having an intake camshaft provided with at least one intake cam piece for opening and closing an intake valve and an exhaust camshaft provided with at least one exhaust cam piece for opening and closing an exhaust valve, at least one of said intake cam piece and said exhaust cam piece having a variable cam piece provided with a variable cam section having different valve operating characteristics changing in direction of a rotary axis of said intake camshaft or said exhaust camshaft for opening and closing said intake valve or said exhaust valve in accordance with said valve operating characteristic including lift amount and operation angle, wherein said variable cam piece is provided on said intake camshaft or said exhaust camshaft so as to slide in direction of said rotary axis;

a driving mechanism for moving said variable cam piece in direction of said rotary axis in accordance with engine operating condition to change said valve operating characteristic of said intake valve or said exhaust valve;

said driving mechanism comprises a movable member driven so as to reciprocate along a center axis and arms extending from said movable member toward said intake camshaft or said exhaust camshaft having contact sections contacted with both side surfaces of said variable cam piece in direction of said rotary axis, respectively; and said center axis of said movable member is positioned near a center axis of a cylinder of said internal combustion engine more than said rotary axis of said intake camshaft or said exhaust camshaft.

2. A valve moving apparatus of an internal combustion engine as claimed in claim 1, wherein said driving mechanism has a pair of arms extending from said movable member toward said camshaft and having said contact section, and said movable member has a recess for allowing passing of said rotating variable cam section.

3. A valve moving apparatus of an internal combustion engine as claimed in claim 2, wherein said movable member has both ends supported by respective neighboring cam holders.

4. A valve moving apparatus of an internal combustion engine as claimed in claim 1, wherein an intake or exhaust rocker arm is provided between at least one of said intake cam piece and said exhaust cam piece and said intake valve or said exhaust valve to open and close said intake valve or said exhaust valve, said intake or exhaust rocker arm is pivoted on a intake or exhaust rocker shaft, said driving mechanism has an oil passage for supplying oil pressure to both end portions of said movable member, and said oil passage is constituted so as to pass through an inner portion of said rocker shaft.

5. A valve moving apparatus of an internal combustion engine as claimed in claim 1, wherein a valve lifter is disposed between one of said intake cam piece and said exhaust cam piece and at least one of said intake valve and said exhaust valve to come into sliding contact with said intake valve or said exhaust valve, and said valve lifter is provided with a cut portion for escape of said intake cam piece or said exhaust cam piece not coming into contact with said valve lifter.

6. A valve moving apparatus of an internal combustion engine as claimed in claim 5, wherein said cut portion forms an opening penetrating said valve lifter so as to connect inner and outer sides of said valve lifter with each other.

7. A valve moving apparatus of an internal combustion engine as claimed in claim 6, wherein each of said intake cam piece and said exhaust cam piece has a first cam section and second cam section arranged in series in direction of said rotary axis, each of said intake valve and said exhaust valve includes a first engine valve and a second engine valve provided for the same cylinder, said valve lifter includes a first valve lifter disposed between said first engine valve and said first cam section and a second valve lifter disposed between said second engine valve and said second cam section, and said driving mechanism selectively switch over said first cam section and said second cam section coming into sliding contact with said first valve lifter and said second valve lifter respectively.

8. A valve moving apparatus of an internal combustion engine as claimed in claim 1, wherein a valve lifter is provided between one of said intake cam piece and said exhaust cam piece and said intake valve or said exhaust valve, and said valve lifter has a cut portion for escape of said arm.

9. A valve moving apparatus of an internal combustion engine as claimed in claim 8, wherein said cut portion forms an opening connecting inner and outer sides of said valve lifter with each other.

10. A valve moving apparatus of an internal combustion engine as claimed in claim 9, wherein each of said intake cam piece and said exhaust cam piece has a first cam section and a second cam section arranged in series in direction of said rotary axis, each of said intake valve and said exhaust valve includes a first valve and second valve provided for each cylinder, said valve lifter includes a first valve lifter disposed between said first valve and said first cam section and a second valve lifter disposed between said second valve and said second cam section, and said driving mechanism selectively switches over said first cam section and said second cam section coming into sliding contact with said first valve lifter and said second valve lifter respectively.

11. A valve moving apparatus of an internal combustion engine as claimed in claim 1, wherein a valve lifter coming into sliding contact with one of said intake valve and said exhaust valve is provided between one of said intake cam piece and said exhaust cam piece and said intake valve or said exhaust valve, and a trigger mechanism for setting a switching action beginning time of said driving mechanism when said intake valve or said exhaust valve is opened is disposed under said intake camshaft or said exhaust camshaft.

12. A valve moving apparatus of an internal combustion engine as claimed in claim 11, wherein said trigger mechanism is disposed between said intake or exhaust camshaft and said lifter.

13. A valve moving apparatus of an internal combustion engine as claimed in claim 11, wherein said trigger mechanism is disposed overlapping with said lifter in moving direction of said lifter and acts in accordance with movement of said lifter.

14. A valve moving apparatus of an internal combustion engine as claimed in claim 1, wherein each of said intake cam piece and said exhaust cam piece includes a first cam section and a second cam section, said intake valve or said exhaust valve includes a first valve and a second valve provided for each cylinder, said lifter includes a first lifter disposed between said first valve and said first cam section and a second lifter disposed between said second valve and said second cam section, and said trigger mechanism is disposed between said first lifter and said second lifter in direction of said rotary axis.

15. A valve moving apparatus of an internal combustion engine as claimed in claim 1, wherein said internal combustion engine has a lifter holding member separated from a cylinder head for holding said lifter, and said trigger mechanism is fixed to said lifter holding member by means of a fixing member for fixing said lifter holding member to said cylinder head.

16. A valve moving apparatus of an internal combustion engine having an intake camshaft provided with at least one intake cam piece for opening and closing an intake valve and an exhaust camshaft provided with at least one exhaust cam piece for opening and closing an exhaust valve, at least one of said intake cam piece and said exhaust cam piece having a variable cam piece provided with a variable cam section having different valve operating characteristics changing in direction of a rotary axis of said intake camshaft or said exhaust camshaft for opening and closing said intake valve or said exhaust valve in accordance with said valve operating characteristic including lift amount and operation angle, wherein said variable cam piece is provided on said intake camshaft or said exhaust camshaft so as to slide in direction of said rotary axis;

a driving mechanism for moving said variable cam piece in direction of said rotary axis in accordance with engine operating condition to change said valve operating characteristic of said intake valve or said exhaust valve;

said driving mechanism comprises a movable member driven so as to reciprocate along a center axis and arms extending from said movable member toward said intake camshaft or said exhaust camshaft having contact sections contacted with both side surfaces of said variable cam piece in direction of said rotary axis, respectively;

said center axis of said movable member is positioned near a center axis of a cylinder of said internal combustion engine more than said rotary axis of said intake camshaft or said exhaust camshaft; and said variable cam piece has cams adjacent to each other having respective base circle portions smoothly connected with each other.

17. A valve moving apparatus of an internal combustion engine as claimed in claim 11, wherein said variable cam piece has cams adjacent to each other having respective base circle portions smoothly connected with each other.

* * * * *